US008430434B2

(12) United States Patent
Fiedler

(10) Patent No.: US 8,430,434 B2
(45) Date of Patent: Apr. 30, 2013

(54) MECHANICAL-MAGNETIC CONNECTING STRUCTURE

(75) Inventor: Joachim Fiedler, Berlin (DE)

(73) Assignee: Fidlock GmbH, Berlin (DE)

( * ) Notice: Subject to any disclaimer, the term of this patent is extended or adjusted under 35 U.S.C. 154(b) by 587 days.

(21) Appl. No.: 12/373,395

(22) PCT Filed: Jul. 12, 2007

(86) PCT No.: PCT/DE2007/001245

§ 371 (c)(1),
(2), (4) Date: Jul. 21, 2010

(87) PCT Pub. No.: WO2008/006357

PCT Pub. Date: Jan. 17, 2008

(65) Prior Publication Data

US 2010/0283269 A1 Nov. 11, 2010

(30) Foreign Application Priority Data

Jul. 12, 2006 (DE) ..... 10 2006 032 522
Jul. 5, 2007 (DE) ..... 10 2007 031 399

(51) Int. Cl.
*E05C 17/56* (2006.01)
*E05C 19/16* (2006.01)

(52) U.S. Cl.
USPC ..... 292/251.5

(58) Field of Classification Search ..... 292/251.5, 292/307 R, 318, 321, 10, 17, 80, 81, 87, 303; 24/627, 303, 629, 297, 664, 107, 109, 581.1, 24/581.11, 604, 313; 70/276
See application file for complete search history.

(56) References Cited

U.S. PATENT DOCUMENTS

| | | | | |
|---|---|---|---|---|
| 3,266,112 | A | 8/1966 | O'Kane et al. | |
| 3,266,122 | A | 8/1966 | O'Kane et al. | |
| 4,736,494 | A * | 4/1988 | Marchesi | 24/303 |
| 4,847,959 | A * | 7/1989 | Shimada et al. | 24/671 |
| 5,233,732 | A | 8/1993 | Yamanishi | |
| 5,323,516 | A | 6/1994 | Hartmann | |
| 5,367,891 | A | 11/1994 | Furuyama | |
| 5,515,581 | A | 5/1996 | Kaufmann | |
| 6,182,336 | B1 | 2/2001 | Bauer | |

(Continued)

FOREIGN PATENT DOCUMENTS

| | | |
|---|---|---|
| DE | 1 226 816 | 10/1966 |
| DE | 299 03 507 | 8/2000 |

(Continued)

*Primary Examiner* — Thomas Beach
*Assistant Examiner* — Faria Ahmad
(74) *Attorney, Agent, or Firm* — Henry M. Feiereisen LLC

(57) ABSTRACT

A connecting structure includes a locking device having a spring locking element and a locking piece for locking the connecting modules, and a magnet/armature structure having a magnet and an armature. The locking device and the magnet/armature structure are functionally linked by in that the magnet and the armature are displaceable, the magnet or the armature is coupled to the locking piece via a coupling device so that the locking piece, when displaced between the magnet and the armature, can be brought into a non-locking position; The magnetic force is chosen so that the connecting modules are pulled towards each other during closing, thereby pushing the spring locking element against the locking piece until it snaps into engagement and the magnetic force is weakened during release after the non-engagement position between the locking piece and the spring locking element is reached to enable separation of the modules.

17 Claims, 76 Drawing Sheets

U.S. PATENT DOCUMENTS

| | | | | |
|---|---|---|---|---|
| 6,295,702 | B1 | 10/2001 | Bauer | |
| 6,505,385 | B2 | 1/2003 | Grunberger | |
| 7,583,500 | B2 * | 9/2009 | Ligtenberg et al. | 361/679.27 |
| 2003/0131452 | A1 | 7/2003 | Revel | |
| 2003/0229974 | A1 | 12/2003 | Zemer et al. | |
| 2004/0244419 | A1 | 12/2004 | Suzuki | |
| 2007/0251062 | A1 | 11/2007 | Saitoh et al. | |

FOREIGN PATENT DOCUMENTS

| | | | |
|---|---|---|---|
| EP | 1 529 459 | | 5/2005 |
| FR | 1351339 | A | 1/1964 |
| FR | 2 361 129 | | 3/1978 |
| FR | 2 394 266 | | 1/1979 |
| FR | 2 612 378 | | 9/1988 |
| GB | 942282 | A | 11/1963 |
| GB | 2264975 | A | 9/1993 |
| JP | 59-115908 | | 8/1984 |
| JP | 61-205526 | | 12/1986 |
| JP | 63-108318 | | 7/1988 |
| JP | 6-127 | | 1/1994 |
| JP | 2001-286321 | | 10/2001 |
| JP | 2007-530184 | | 11/2007 |
| RU | 2 096 979 | C1 | 11/1997 |
| RU | 2007 113 550 | | 10/2008 |
| WO | WO 02/21960 | A1 | 3/2002 |
| WO | WO 03/005847 | | 1/2003 |

* cited by examiner

Section A-A

Section B-B

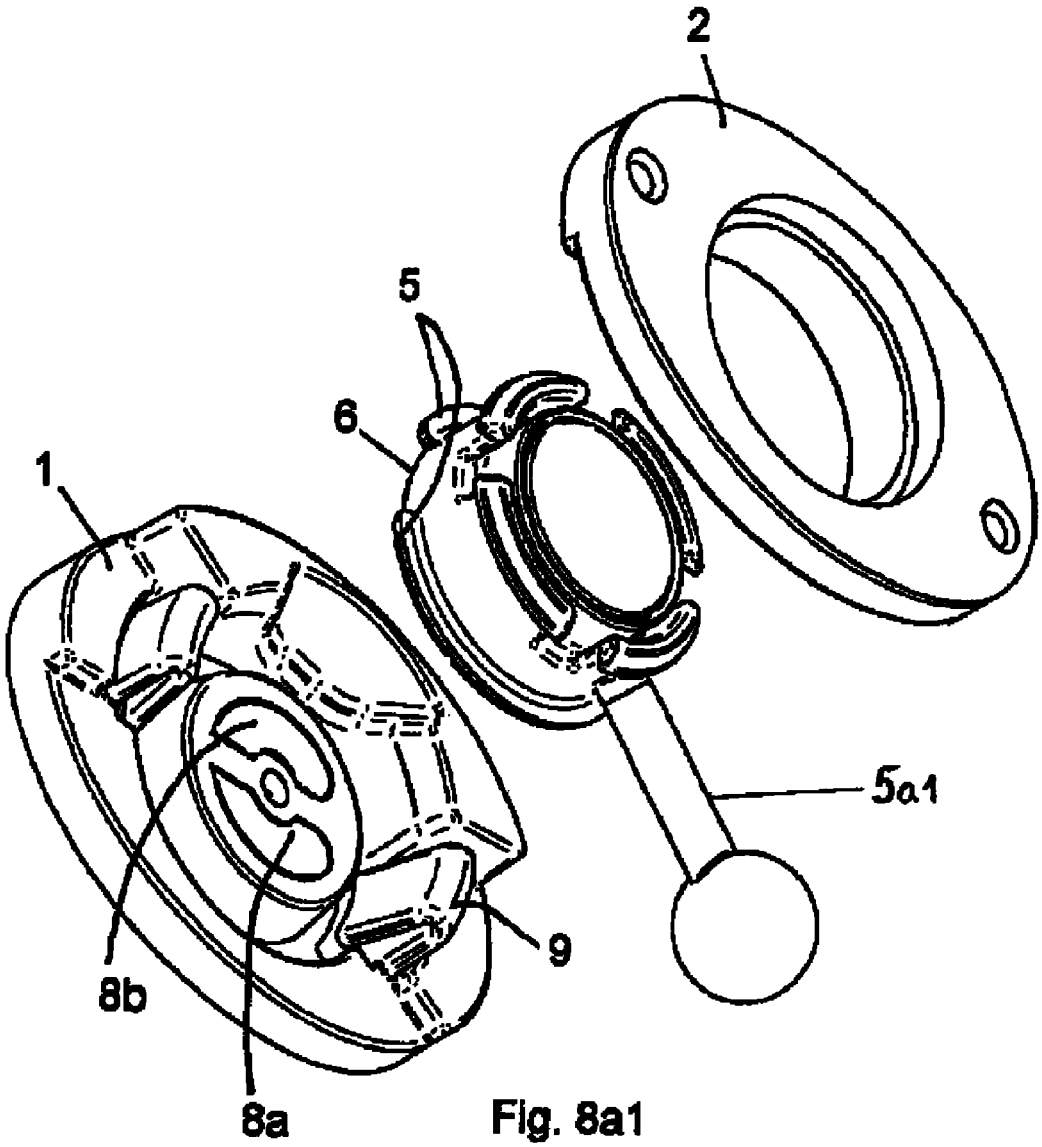
Fig. 8a1

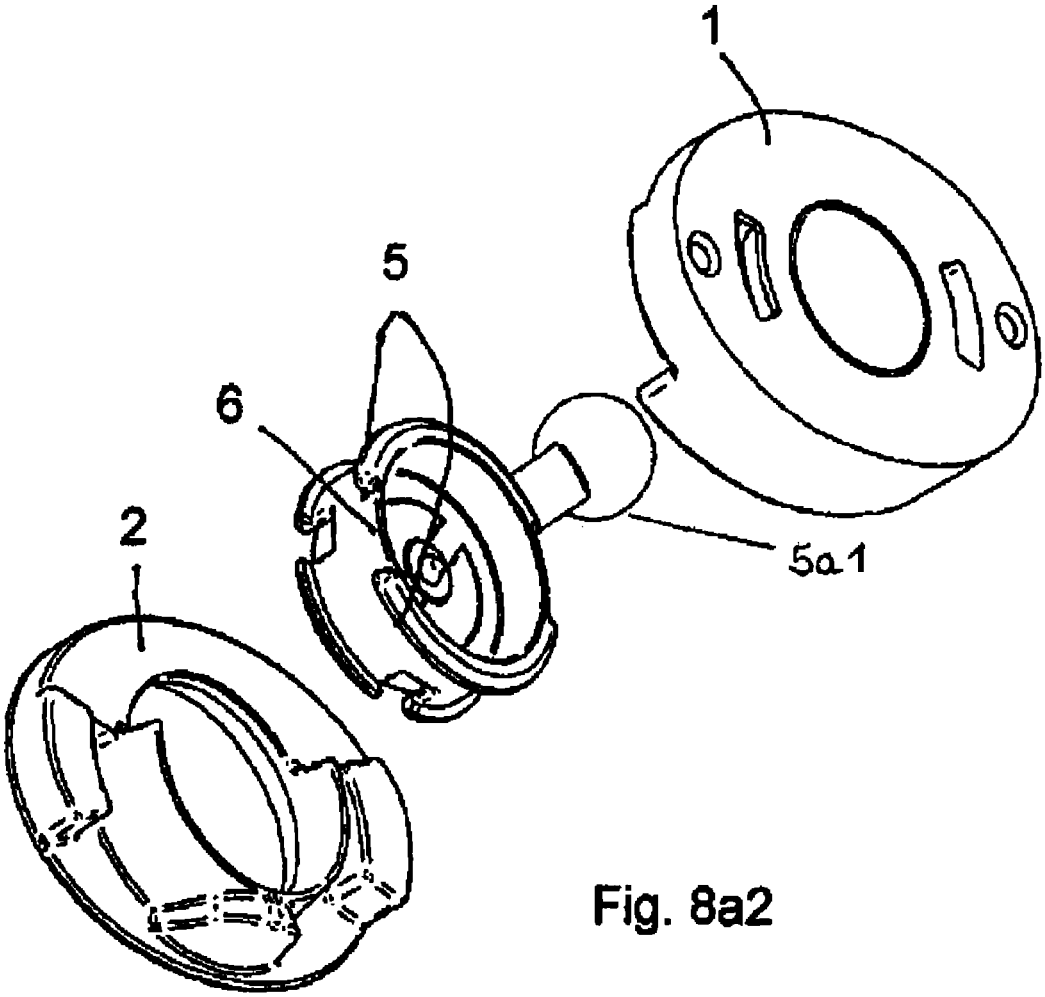
Fig. 8a2

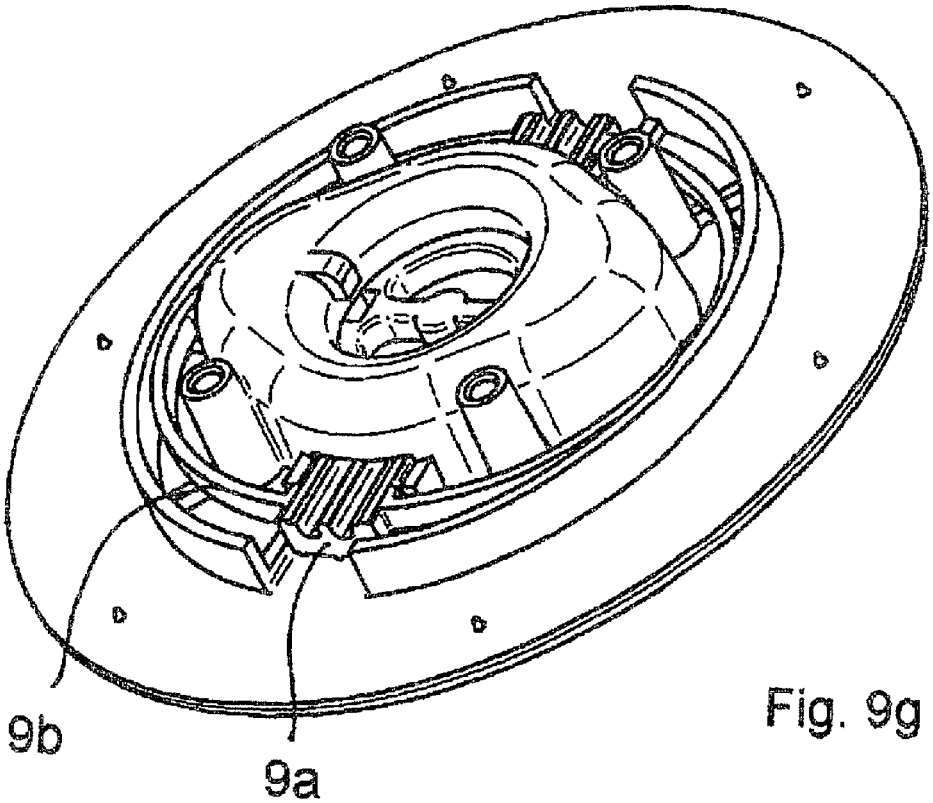
Fig. 9g
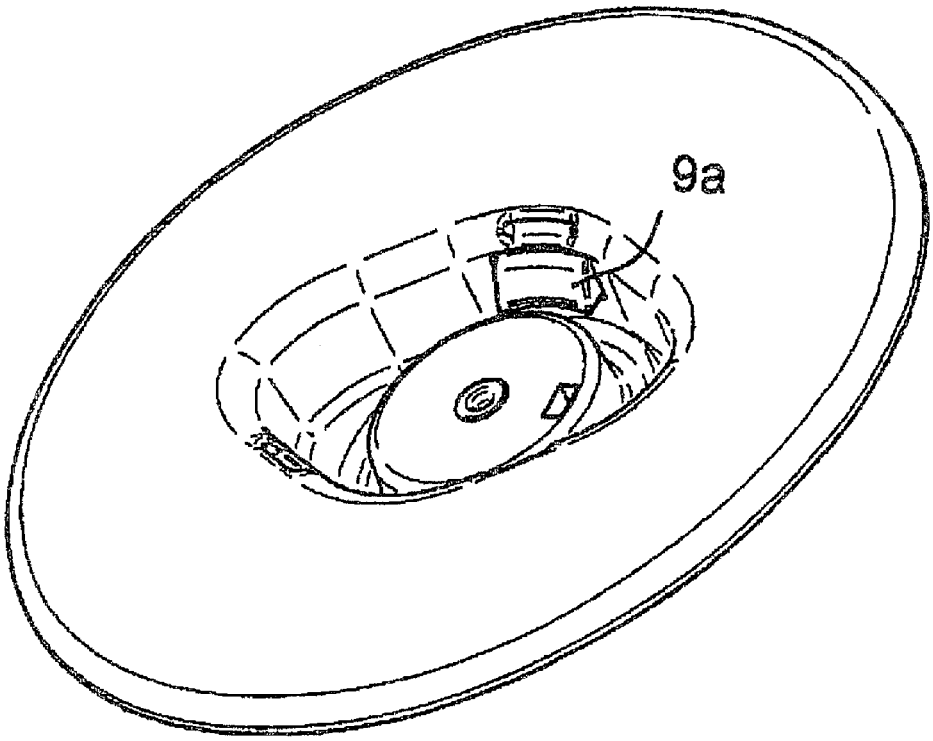

Section B-B

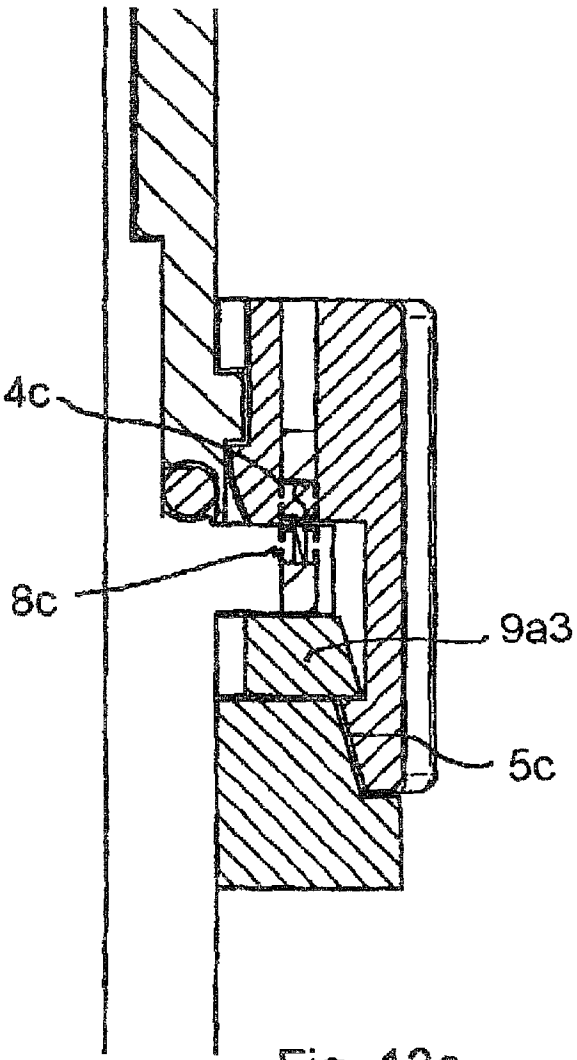
Fig. 13c
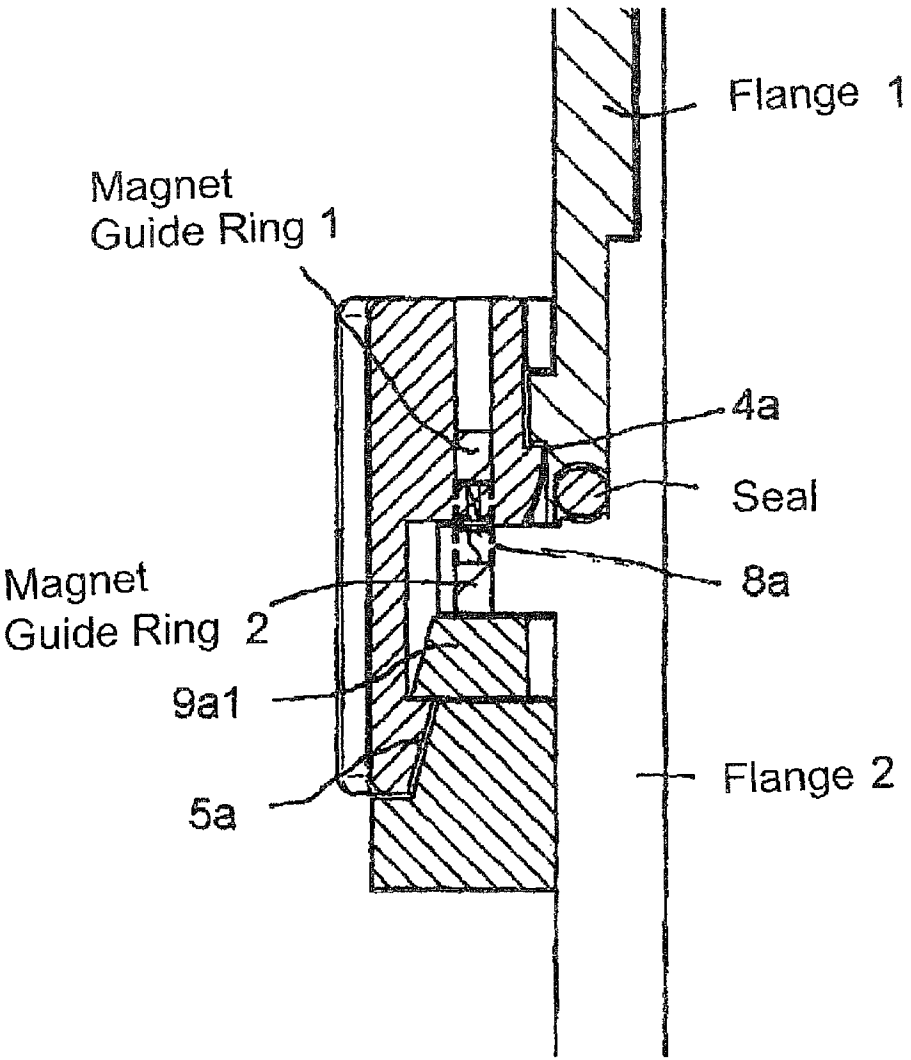

MECHANICAL-MAGNETIC CONNECTING STRUCTURE

CROSS-REFERENCES TO RELATED APPLICATIONS

This application is the U.S. National Stage of International Application No. PCT/DE2007/001245, filed Jul. 12, 2007, which designated the United States and has been published as International Publication No. WO 2008/006357 and which claims the priorities of German Patent Application, Serial No. 10 2006 032 522.2, filed Jul. 12, 2006, and German Patent Application, Serial No. 10 2007 031 399.5, filed Jul. 5, 2007, pursuant to 35 U.S.C. 119(a)-(d).

BACKGROUND OF THE INVENTION

The invention relates to a mechanical-magnetic connecting structure, i.e., a mechanical interlock supported by a magnetic force, which is suitable in particular for closures used on bags, backpacks and similar objects, wherein this recitation is not intended to limit the field of use of the invention.

Basically, such connecting structures can be divided into two main groups. There are mechanical connecting structures with opening and closure mechanisms made of a combination of mostly formfitting or force-transmitting elements. Frequently springs are used to maintain an interlocked state, so that closing and opening must be preformed against the spring force. Such connecting structures are known to a skilled artisan, so that reference will only be made to the state-of-the-art in subclasses IPC A44B.

Another main group of the connecting structures are magnetically operating connecting structures, where the magnetic force is used to hold the connection together. These connecting structures also sufficiently known to a skilled artisan for closures of bags and other containers, so that reference will here only be made to the state-of-the-art in subclasses IPC E05C.

Also known are combinations of these two main groups. In these combinations, it is typically attempted to satisfy specific requirements for a connecting structure through a suitable combination of the different properties of a mechanical connection and a magnetic connecting structure.

For a better understanding of the advantages of the invention, several major properties of the mechanical and magnetic pole connecting structures will now be explained.

A formfitting mechanical interlock has typically a mechanical component which is under tension, compression or shear when a load is applied to the interlock. The magnitude of the mechanical resistance of this component defines the stability of the connecting structure. Mechanical connecting structures can be produced cost-effectively, because very inexpensive steel parts or plastic parts can be employed for bag closures.

These mechanical connecting structures have essentially the property that a spring locking force must be exceeded when the components are plugged together. Handling of the connecting structure is therefore sometimes not very comfortable, so that magnetic connecting structures are substituted, because these attract each other automatically due to the magnetic force.

The force experienced during closing and opening is frequently referred to as haptic. In particular with manually operated closures, the haptic must be adapted to the force transmitted by the human hand.

With magnetic connections where the magnetic force is used directly to prevent the connection from opening, the magnet and the associated armature must be dimensioned commensurate with the holding force. These connections find practical application if no particular requirements are imposed on the holding force and the haptic.

However, in certain applications the closures must be oversized, for example when meeting certain safety requirements. This may be necessary, for example, for a backpack carried by mountain climbers. This backpack must not open even if many times the normal holding force is applied to the closure, which may occur, for example, during a fall. Closures with such a required characteristic are therefore constructed as mechanical closures because mechanical structures can have high safety factors without increased complexity or cost. These connecting structures therefore dominate the mass market.

Also known from the state-of-the-art are different mechanical connecting structures, wherein magnets are employed in addition to a mechanical interlock. However, these magnets are only used to hold the mechanical interlock together in the closed position. The magnetic force is here used instead of the spring force of a mechanical spring. This structure has an objectionable haptic. They can be closed relatively easily, but are more difficult to open.

No connecting structures are known in the art for the following requirements:

a. Locking is mechanical,
b. The connecting structure contracts automatically in the main loading direction,
c. The connecting structure can be easily opened, i.e., has a good haptic.

SUMMARY OF THE INVENTION

It is therefore an object of the invention to provide a connecting structure which simultaneously satisfies all three requirements a) to c).

This object is attained with a mechanical-magnetic connecting structure having two connecting modules and used for connecting two elements, to each of which a corresponding one of the collecting modules can be attached.

The connecting structure has the following features:

A locking device with at least one spring locking element arranged in one of the connecting modules, and a movable locking piece for formfittingly locking the connecting modules arranged in the other connecting module. The spring locking element is configured so as to be urged against the locking piece during closure of the connecting structure. The spring locking element, the locking piece and the contacting area sections of the spring locking element and of the locking piece are configured so that the spring locking element is in a structurally determined direction and snaps into the locking piece, when the locking element and the locking piece move towards one another. A person skilled in the art will understand that the term "spring" is merely intended to describe the property "springy". Accordingly, all embodiments employing plastic materials are included. It is also clear that the "springy" or the "elastic" property can also be associated with the locking piece, wherein the springy or elastic deflection of the locking piece is not identical to the displacement of the locking piece for opening.

The locking piece and the locking element are constructed so as to have sufficient mechanical stability commensurate with actual or possible loads.

The locking piece is also movable so that it can be brought from an engagement position, in which the spring locking element is in engagement with the locking piece, into a non-engagement position, where the spring locking element is not in engagement with the locking piece. This combination of features will now be described in more detail:

When the connecting structure is snapped together, a formfitting connection is produced. To release this formfitting connection, the movable locking piece is moved in a direction in which the locking piece is no longer in engagement with the spring locking element, i.e., it is moved from the engagement position into the non-engagement position.

If the locking piece, e.g., a rod and the spring locking element has a hook-shaped head, which is pushed against the rod during closure, then the spring locking element is deflected and thereafter snaps in, whereby the hook-shaped head hooks behind the rod, i.e., is in the engagement position.

As an additional feature, the locking piece has a recess, hereinafter referred to as gap. When the locking piece is moved relative to the spring locking element so that the hook-shaped head and the gap are in opposition, a formfitting connection no longer exists, because of the gap is dimensioned so that the hook-shaped head is no longer supported in the gap. A skilled artisan will understand that the end of the locking piece also has the effect of the aforedescribed gap, i.e., if a locking piece is no longer present, then the exemplary hook-shaped head can no longer be supported. The skilled artisan will also understand that this displacement can be a rotation or a pivoting motion.

The connecting structure further includes a magnet-armature construction, wherein the magnet is arranged in one of the connecting modules and the armature in the other connecting module. The magnetic force between the armature and the magnet is selected to be large enough so that during the closure process the connecting modules are pulled towards one another from a predetermined minimum distance on, so that the spring locking element is urged against the locking piece until it snaps into engagement. In other words, magnet and armature are dimensioned so that the spring force of the spring locking element is overcome. It is clear to the skilled artisan that the magnet-armature structure may not only include a single magnet and a single armature. In the following, a magnet-armature structure refers to any combination of magnets and armatures which at least attract one another, whereby the skilled artisan is aware that the armature is made of a ferromagnetic material or may also be a magnet. Certain magnet-armature structures not only attract one another, but can also repel each other when two magnetic poles with identical polarity face one another. Except for special additional conditions, it is immaterial if the magnet moves relative to the armature or the armature moves relative to the magnet. It is also clear that the interaction between magnet and armature is the same as the interaction between two attracting magnets.

When the connecting modules are connected, a mechanical interlock as well as a magnetic attraction exist. It should be mentioned, however, that the magnetic attraction is only an insignificant part of the main force representing the load on the connection. The magnet-armature structure is used almost exclusively for automatically closing the connection.

To provide the aforementioned comfortable haptic when the magnet is separated from the armature, the connecting module 1 with a magnet and the connecting module 2 with the armature are moved laterally until the magnetic force becomes sufficiently weak so that the module can be easily separated by hand. This is the case when the surface of the armature facing the magnet becomes sufficiently small. It is clear that the displacement between the magnet and the armature can also be a rotation or a pivoting motion.

The movable magnet is coupled to the locking piece, i.e., the locking piece moves together with the magnet, wherein the term "coupled" does not exclusively indicate that the locking piece must be rigidly connected with the magnet. Coupling may also include a connection by way of a spring. Coupling also exists when a catch displaces the locking piece, without the catch actually contacting the locking piece, i.e., when play exists. These relationships will be explained in more detail in the description with reference to exemplary embodiments.

The invention will now be summarized:

When the magnet is displaced far enough away from the armature, so that the attractive magnetic force between the armature and the magnet is sufficiently weak, then the spring locking element is located simultaneously in the gap of the locking piece, i.e., in the non-engagement position. In this position, the connecting device is both mechanically unlocked as well as magnetically released. Mechanical unlocking did not require moving the spring locking element, i.e., the spring force of the spring locking element is overcome by the magnetic force only during closure, whereas the spring force is zero, during opening because the spring locking element is not deflected.

It will be understood that this connecting structure has a particularly soft opening haptic, because for the opening process, only the magnetic force must be weakened or completely eliminated by lateral movement of the magnet and armature. Of the other hand, the connecting structure is, when connected, as stable as a mechanical connecting structure.

It is clear that the aforedescribed position between locking piece and gap and between armature and magnet must not exist during closure of the connecting structure, i.e., during the closing operation, the locking piece and the spring locking element must face each other so as to snap together. On the other hand, during closure the magnet and the armature must be in a opposing position where the magnetic force between magnet and armature is strong enough to exceed the spring force of the spring locking element to enable them to snap together. In other words, before the connecting structure is connected, it must be ensured that the locking structure and the magnet-armature structure are in their respective initial position which enables them to be pulled towards one another and snap together. This return of the functional element of the locking structure and the magnet-armature structure is effected by restoring means. It is known to the skilled artisan how mechanical components can be brought from a first position into a second position. This is accomplished merely by applying a force to the component. In the present invention, the force from a return spring is preferably used which is pretensioned during opening of the connecting structure. A skilled artisan will understand that this return spring must only be strong enough to urge the functional elements, which were moved during opening, back into their initial position. This only requires a very small force, so that only a very weak return spring is required, thereby maintaining the aforementioned soft and comfortable haptic.

The return can also be done magnetically. This effect is sufficiently known to a skilled artisan, so that only one possibility of many will be described: when an armature and a magnet adhere to one another, this magnetic connection can be released by moving the armature away from the magnet. When the attracting areas of magnet and armature have the same size, then the attracting surface section becomes smaller when the armature and magnet are displaced laterally relative to one another. Because the magnet and armature are held together by the magnetic force in the initial position, a restoring force has to be exceeded during displacement. The smaller the friction between the attracting surfaces, the greater the restoring force. This effect which is known to a person skilled in the art can be enhanced when the magnet and the armature have certain shapes and/or magnetization. For example, it is clear that a suitably magnetized triangular armature surface will be oriented toward an also triangular magnet surface.

According to an advantageous embodiment of the invention, the magnet/armature structure has several locking elements or a locking element with several locking sections. With this embodiment of the invention, for example, the applied force can be better distributed.

According to an advantageous embodiment of the invention, the magnet-armature structure has a coupling device which has play in the travel direction of the movable magnet, so that the locking piece is pulled by a limit stop towards the magnet only when the play is taken up. This embodiment has the advantage that travel of the magnet from the armature can be greater than the distance by which the locking piece must be moved until the gap is located in opposition to the spring locking element. In this embodiment, a connecting structure can be manufactured where due to structural limitations the travel of the magnet from the armature must be greater then the distance over which the locking piece is moved.

According to an advantageous embodiment of the invention, the magnet-armature structure has as a coupling device a coupling spring with a spring force that extends along the travel direction of the magnet and the locking piece. This embodiment has the advantage that with this feature combination the connecting structure is safely prevented from opening under load. The spring is dimensioned so that in an unloaded state of the mechanical locking device, the locking piece is pulled along during movement of the magnet by the coupling device. Under load, the friction force between the spring locking element and the locking piece is greater than the spring force, i.e., the magnet can be moved, for example, by hand without causing the magnetic interlocked to open. When the mechanical interlock is released, the spring pulls or pushes the locking piece into the opening direction, so that the connection can be opened immediately.

According to an advantageous embodiment of the invention, the magnet-armature structure has a coupling device which has play in the travel direction of the movable magnet, so that the locking piece is pulled by a limit stop towards the magnet only when the play is used up. Also provided is a return tension spring for the locking unit having a spring force extending along the trouble direction of the locking piece. When the magnet is moved by the armature and the play of the coupling device is used up, the return spring is stretched. When the connection is released, magnet and armature are pulled in opposing positions and the rocking piece is pulled into its initial position.

According to an advantageous embodiment of the invention, the magnet-armature structure has a coupling device which has play in the travel direction of the movable magnet, so that the locking piece is pulled by a limit stop towards the magnet only when the play is used up. Also provided is a return tension spring for the locking piece which provides a spring force extending along the travel direction of the locking piece. When the magnet is moved by the armature and the play of the coupling device is taken up, the return spring is compressed. When the connection is released, magnet and armature are pulled in opposing positions while the locking piece is simultaneously pushed into its initial position.

A skilled artisan will infer from the aforedescribed that a number of such combinations exists where limits stops, catches and springs are used which, however, share all the same inventive concept, so that the skilled artisan can select a suitable combination commensurate with the technical boundary conditions, without requiring an inventive step. In particular, tension springs and compression springs can be combined.

According to an advantageous embodiment of the invention, an operating device which can be controlled manually or by foot can be provided for moving the magnet or the armature, which is supported in one of the two connecting modules.

According to an advantageous embodiment of the invention, an object that can be gripped by hand is provided on one of the connecting modules, wherein the object can be placed by hand on the other connecting module. This embodiment of the invention is suitable, for example, to connect a bicycle light to the bicycle handlebar. In this case, the armature is directly connected to the object in one piece.

According to an advantageous embodiment of the invention, the magnet-armature structure has at least one magnet in one connecting module and at least one ferromagnetic armature or a magnet poled for attraction in the other connecting module. This arrangement is preferred when a cost-effective connection is required.

According to an advantageous embodiment of the invention, the magnet-armature structure has a magnet with two ferromagnetic guide plates in one connecting module and a ferromagnetic armature in the other connecting module, wherein the guide plates are arranged so that they are in magnetic operative connection with the ferromagnetic armature while the magnet does not touch the armature. This arrangement is preferred when a robust connection is required, because the magnet surface in this magnet-armature structure does not mechanically touch the surface of the armature, thus preventing damage to the sensitive magnet surface, for example during repeated travel, even if a foreign object, such as sand, is enters in between.

According to an advantageous embodiment of the invention, the magnet-armature structure has in one connecting module a magnet with a ferromagnetic guide plate and in the other connecting module a ferromagnetic armature, wherein the magnet and the guide plate are arranged so that they are in operative magnetic connection with the ferromagnetic armature. This arrangement is preferred for an effective use of the magnetic force, which is attained by concentrating the magnetic field lines in the magnetic guide plate.

According to an advantageous embodiment of the invention, the magnet-armature structure has in each connecting module a magnet with ferromagnetic guide plates, wherein the guide plates in the closed position oppose one another and attract one another. This arrangement is preferred when a robust connection with a high pulling force is required in the closed state and at least a small repulsion is desired during opening.

According to an advantageous embodiment of the invention, the magnet-armature structure has two opposing magnets, which are both in an attracting position in the closed position of the connection and which are both in a repulsive position in the open position. This arrangement is preferred when a connection with a high attractive force in the close position and a high repulsive force during opening is required.

According to an advantageous embodiment of the invention, the magnet-armature structure has a magnet arrangement wherein a magnet and a ferromagnetic armature are arranged in each connecting module so that the magnets face the armature in the closed position, whereas the magnetic poles that are poled to repel each other face each other in the open position. This arrangement is preferred when a cost-effective connection with high attractive force in the closed position and a small repulsive force during opening is required.

BRIEF DESCRIPTION OF THE DRAWING

The invention will now be described in more detail with reference to exemplary embodiments illustrated in the appended drawings.

DETAILED DESCRIPTION OF PREFERRED EMBODIMENTS

Figure 1A:
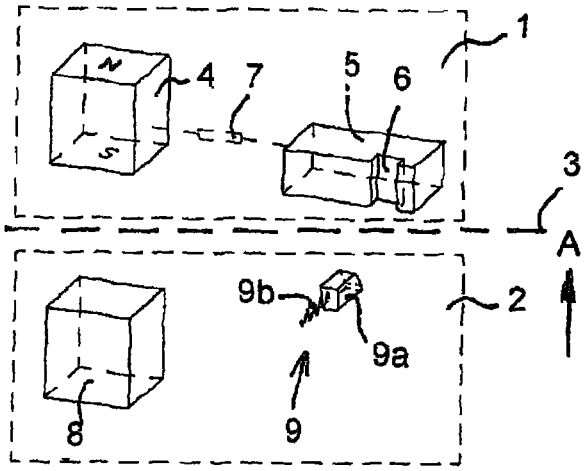
FIGS. 1*a-e* show a schematic diagram of the invention.
Figure 1B:
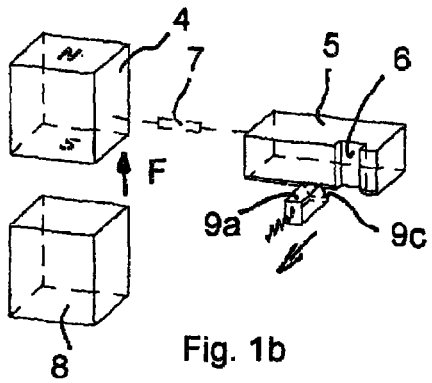
Figure 1B:
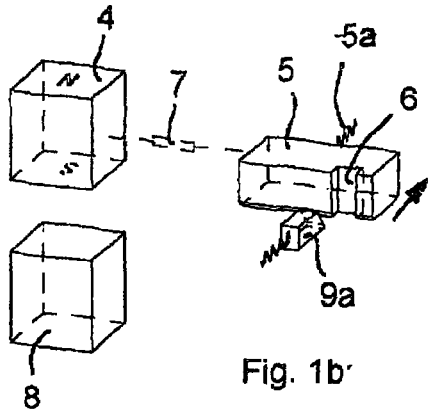
Figure 1C:
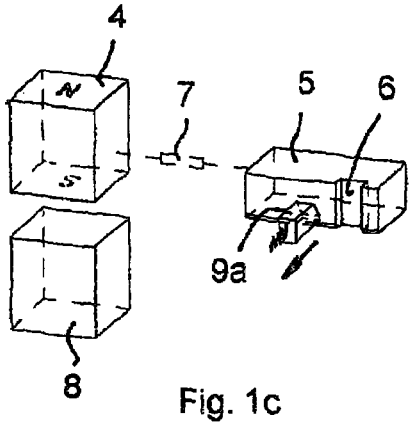
Figure 1C:
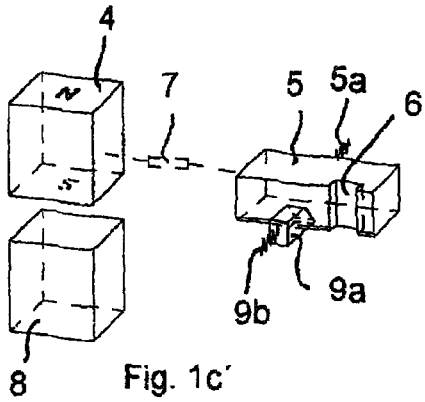
Figure 1D:
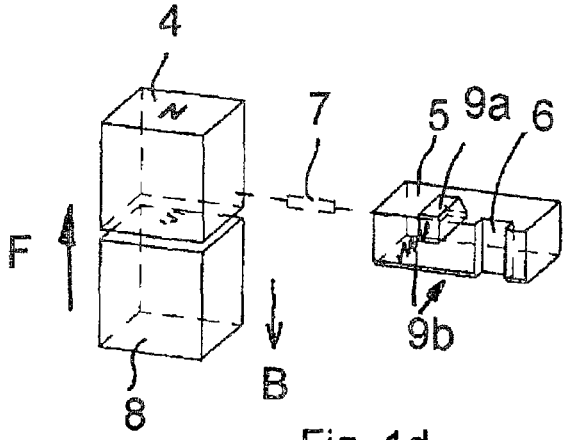

The general operation of the invention is described in the schematic diagram in FIGS. 1*a* to 1*e*. FIG. 1*f* shows a special function.

The connecting modules have the reference symbol 1 and 2 which are separated by the separation line 3 to enhance legibility. Both connecting modules therefore face each other with a separation, i.e., with a gap therebetween.

The connecting module 1 consists of a magnet 4, a locking piece 5 with a gap 6. The locking piece 5 is connected with the magnet 4 via a coupling device 7.

The connecting module 2 consists of a ferromagnetic armature 8 and a spring locking element 9 which has a locking member 9*a* and a spring section 9*b*. When the movable connecting module 2 approaches the stationary connecting module 1 in the direction of arrow A, the position shown in FIG. 1*b* is attained.

In this position, the locking member 9*a* contacts the locking piece 5 with an engagement surface 9*c* which can be beveled. The springily supported locking member 9*a* is urged against the bottom edge of the locking piece 5 by the magnetic force F between the magnets 4 and 8. The magnetic force F and the spring constant of the spring section 9*b* are dimensioned such that the spring section 9*b* springs back towards the arrow, thereby reaching a position according to FIG. 1*c*.

In this intermediate position, the locking member 9*a* slides back towards the arrow. When reaching the upper edge of the locking piece 5, the spring section 9*b* urges the locking member 9 direction of the arrow indicated in FIG. 1*d*.

In this position, the magnet surface and the armature surface are in direct contact or in close proximity, with the locking member 9*a* located on the surface of the locking piece 5, i.e., the interlock is snapped together. It is therefore no longer possible to pull the connecting module 2 in the direction of arrow B, because this is prevented by the interlock.

It should be noted that magnetic force does not substantially affect the stability of the connection.

Figure 1E:
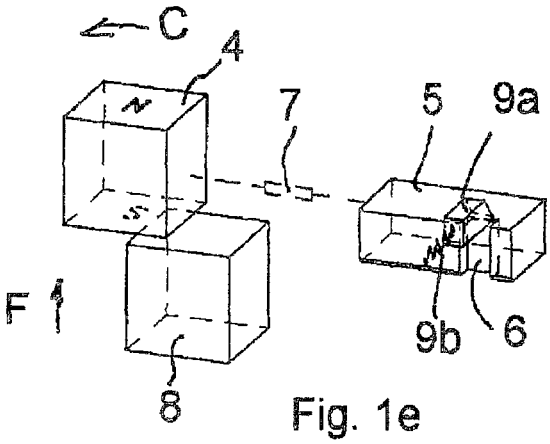
Figure 1F:
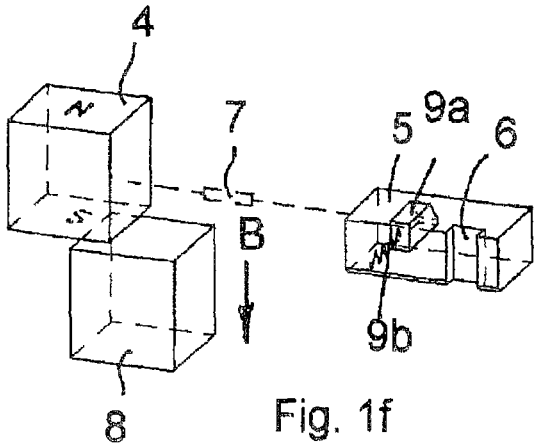
FIG. 1*f* shows a particular application of the invention.

Release of the connecting modules 1 and 2 from one another is shown in FIG. 1*e*. The magnet 4 is here moved sideways from the armature 8 in the direction of arrow C, which accomplishes two functions:

a. The spring locking element 9 is moved until the locking member 9*a* faces the gap 6, whereby the interlock is released, i.e., the gap is so large that the locking member 9*a* is the longer supported.

b. The magnetic force F in substantially weakened by the lateral displacement of the magnet 4, so that the armature is no longer or only weakly attracted by that magnet.

These two functions lead to a haptically comfortable soft opening of the connection, because the jerk-like separation that is otherwise typical for the magnetic closure does not occur because of the substantially weaker magnetic force F.

After separation of the connecting modules, the magnet-armature arrangement is returned to the initial position by measures to be described below; it should be noted that the magnetic properties already cause an automatic return. A person skilled in the art understands that the degree of the return depends on several factors, with the friction between magnet and armature being an important factor.

The coupling device 7 will now be described. The coupling device 7 is a rigid or an elastic connection between the magnet 4 and the locking piece 5. The coupling device 7, however, can also be a partially rigid and loose connection, i.e., a connection with play.

It will be initially assumed that the coupling device 7 is a rigid connection. In this case, the magnet 4, the coupling device 7 and the locking piece 5 can be viewed as an integral body. Accordingly, the force attack point of the displacement force Fv can be freely selected. In FIG. 1*e*, the displacement force Fv is applied on the magnet 4.

When the coupling device 7 is a tension spring, then the force attack point can no longer be freely selected, i.e., the force attack point for the displacement force Fv on the magnet 4 must be selected, as illustrated in FIG. 1*e*.

FIG. 1*f* shows a general embodiment of the invention which will now be described in connection with FIG. 1*e*. The coupling device 7 is a tension spring. As seen in FIG. 1*e*, the locking piece 5 is displaced simultaneously with the displacement of the magnet 4. In FIG. 1*f*, the connected connecting modules 1 and 2 are under tension in the direction B, i.e., the locking piece 5 and the locking member 9*a* of the spring locking element are pressed against each other. This area contact between the superpositioned surface sections under pressure prevents the locking piece from being pulled by the tension spring into the direction in which the magnet was displaced. This produces a safety interlock which cannot be opened under load, because only the magnet can be displaced.

The locking piece is blocked, because the friction force is greater than the spring force of the tension spring.

FIGS. 1*b*' and 1*c*' will now be described. A skilled artisan will understand that the operation of the spring section 9*b* can also be assumed by the locking piece 5, if the locking piece 5 can resiliently deflect towards the arrow by a spring section 5*a*. Also possible is a combination, i.e., both a spring section 9*b* and a spring section 5*a* can be provided. FIGS. 1*b*' and 1*c*' therefore show the same functional phases as FIGS. 1*b* and 1*c*.

Embodiments of the coupling device described so far relate to the rigid and elastic coupling device. If the coupling device is a connection with play, then the operation cannot be explained with reference to FIG. 1. Instead, the following Figures will be used.

Figure 2A:
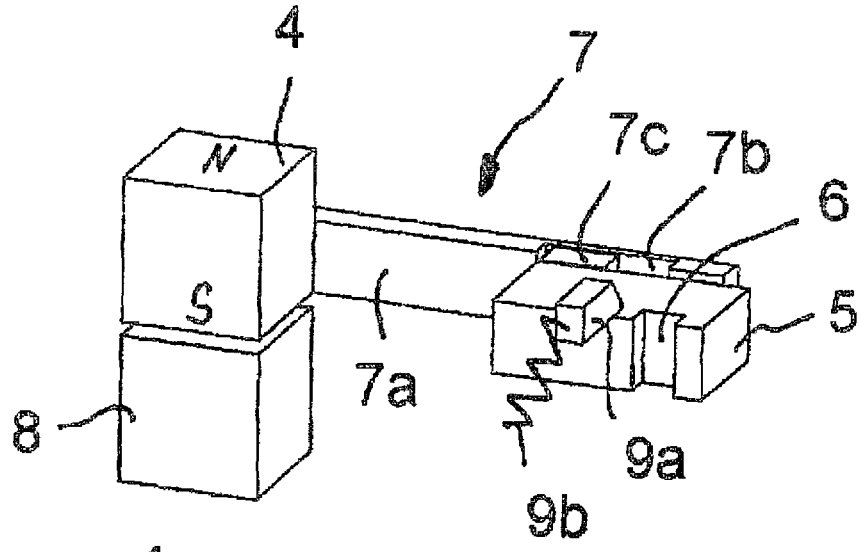
FIGS. 2*a-b* show a schematic diagram of the invention with a first special coupling device.
Figure 2B:
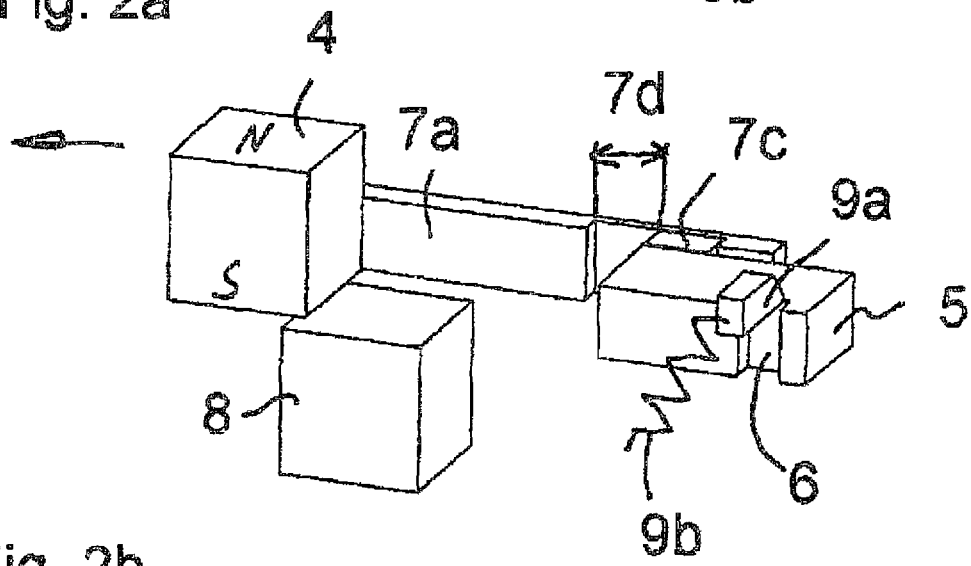

FIGS. 2*a-b* show a special coupling device 7. Because the general function of the invention has already been described in FIG. 1, not all operating phases will be illustrated in the following. FIG. 2*a* shows a closed connecting structure, i.e., this functional phase 2*a* corresponds to the functional phase in FIG. 1*d*.

The magnet 4 is connected with the locking piece 5 by a coupling device 7. The coupling device 7 has play 7*d* along the travel direction of the magnet during opening. As seen in FIG. 2, a coupling insert piece 7*c*, which is fixedly connected with the locking piece 5, engages in a coupling recess 7*b*. The coupling recess 7*b* is longer than the coupling insert piece 7*c*, thus producing coupling play 7*d*. In FIG. 2*a*, the coupling insert piece 7*c* contacts the left end of the coupling recess 7*b*. When the magnet 4 is displaced towards the arrow, then the coupling plate 7*a* with the coupling recess 7*b* also moves in this direction, until the coupling insert piece 7*c* makes contact with the right end of the coupling recess 7*b*, i.e., the coupling play 7*d* was traversed without causing the locking piece to move. When the magnet is displaced further, the locking piece 5 is entrained so that, as known from FIG. 1*e*, the locking member 9*a* faces the gap 6 in which the locking member 9*a* is no longer supported. The connecting structure is then opened, so that the formfitting interlock is released and the attractive force between the magnet 4 and the armature 8 is weakened or severely weakened. This produces a comfortable haptic opening characteristic, when the connecting structure is opened by hand. Return to the initial position according to FIG. 2 is effected by suitable measures.

The advantage of this coupling devices with play is that the magnet-armature structure can be designed to produce a particularly soft haptic, in that the travel distance of the magnet 4 is particularly long, whereas the travel distance of the locking piece can be at the same time smaller. This can be advantageously applied, for example, for an interlock where several narrow spring locking elements are made to simultaneously overlap with several gaps, in order to attain uniform closure.

Figure 3A:
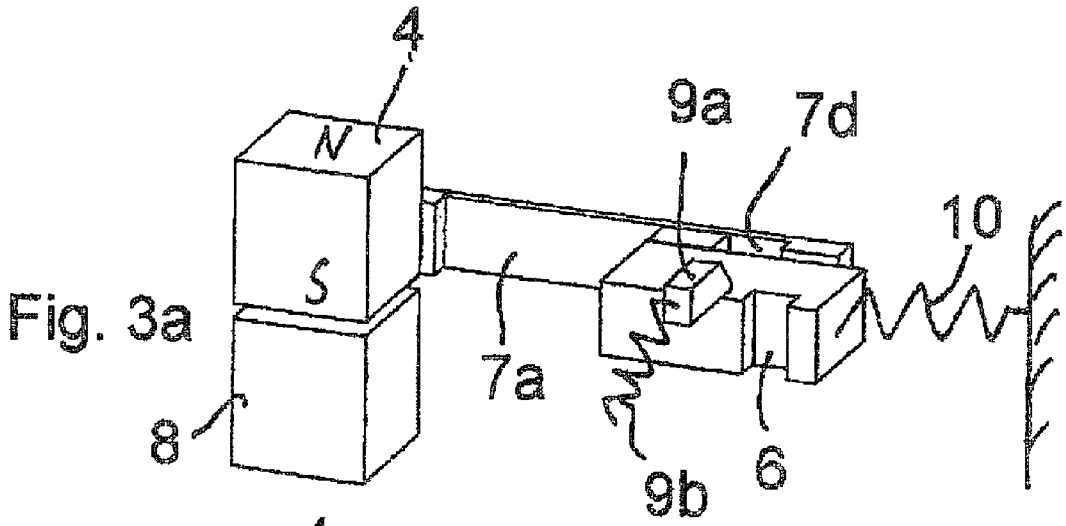
FIGS. 3*a-b* show a schematic diagram of the invention with a second special coupling device.
Figure 3B:
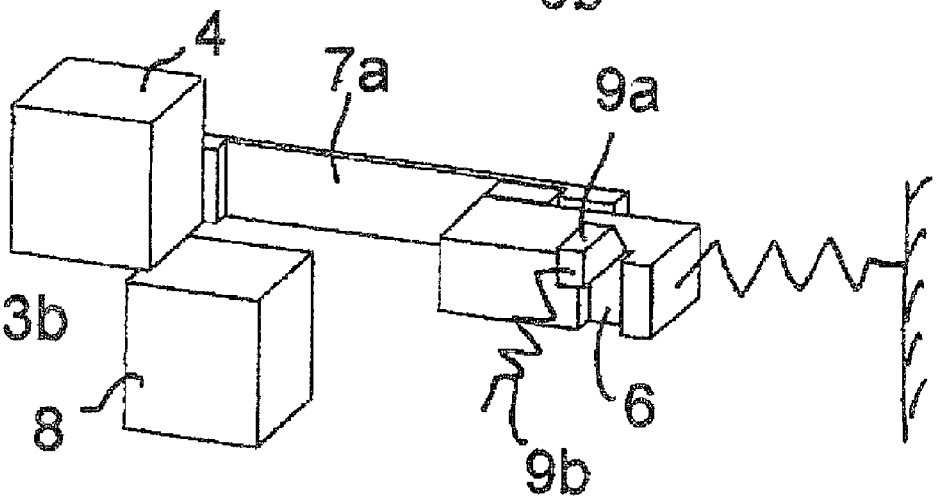

FIGS. 3*a-b* show another special coupling device 7.

The general function has already been described in FIG. 1 and the special effect of a coupling with play was described with reference to FIG. 2. The coupling recess 7*b* is significantly longer. In addition, a return spring 10 is coupled to the locking piece 5, which is stretched during displacement of the magnet 4, when the coupling play 7*d* is taken up. After the connecting structure is opened, i.e., after release, the locking piece return spring 10*a* pulls the locking piece 5 back again.

The advantage of these coupling devices with play is a reliable return into the closed position independent of magnetic return; it is used, for example, for closures for safety belts.

Figure 4A:
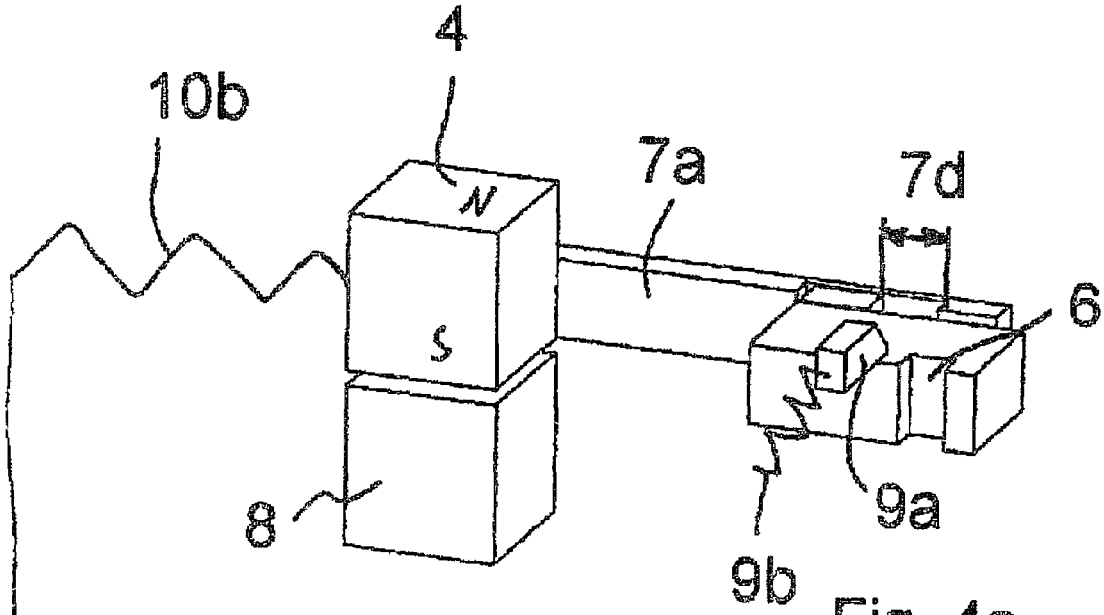
FIGS. 4*a-b* show a schematic diagram of the invention with a third special coupling device.
Figure 4B:
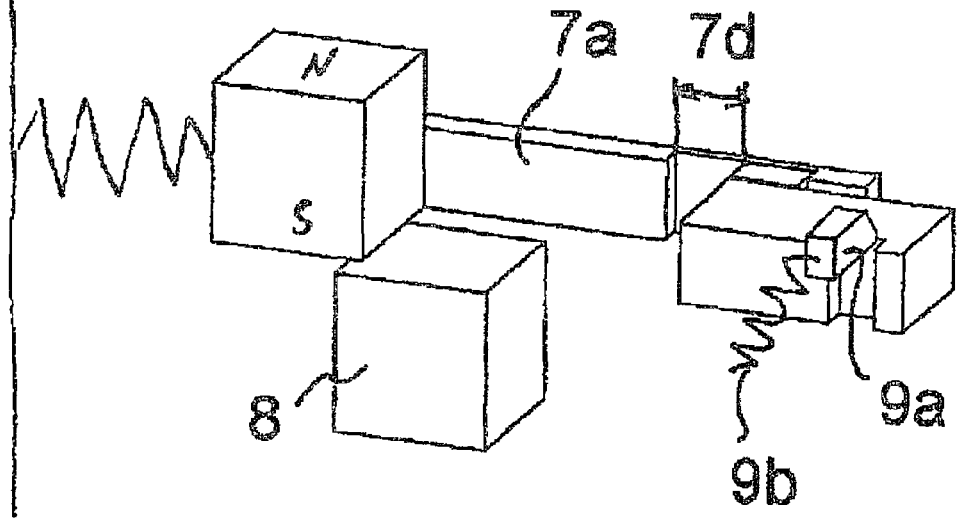

FIGS. 4*a-c* show another special coupling device 7.

The general function has already been described in FIG. 1 and the special effect of a coupling with play was described with reference to FIG. 2. In addition, a magnet return spring 10*b*, which is compressed when the magnet 4 is moved, is coupled to the magnet 4. After the connecting structure is opened, i.e., after unlocking, the magnet return spring 10*b* pushes the magnet back again with the coupling device 7 and hence also with the locking piece 5, when the coupling play 7*d* is taken up.

The advantage of these coupling devices with play is that the magnets are always in the position of maximal attraction when the modules approach and therefore effectively attract one another. These coupling devices are employed in closures with poor access, with are to be moved towards one another as little as possible.

Figure 5A:
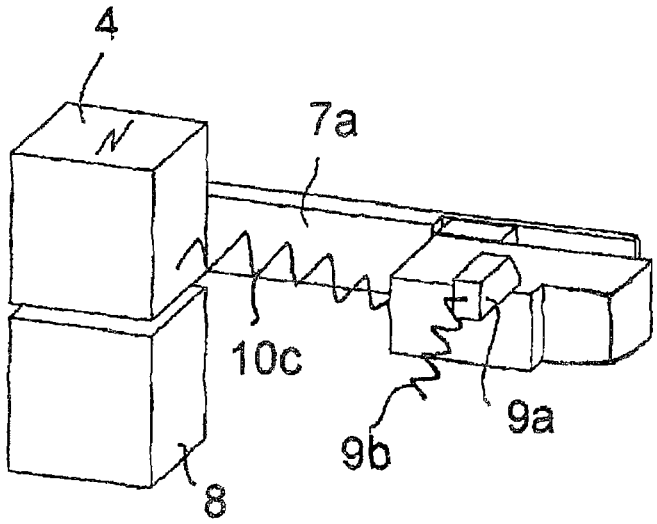
FIGS. 5*a-c* show a schematic diagram of the invention with a fourth special coupling device.
Figure 5B:
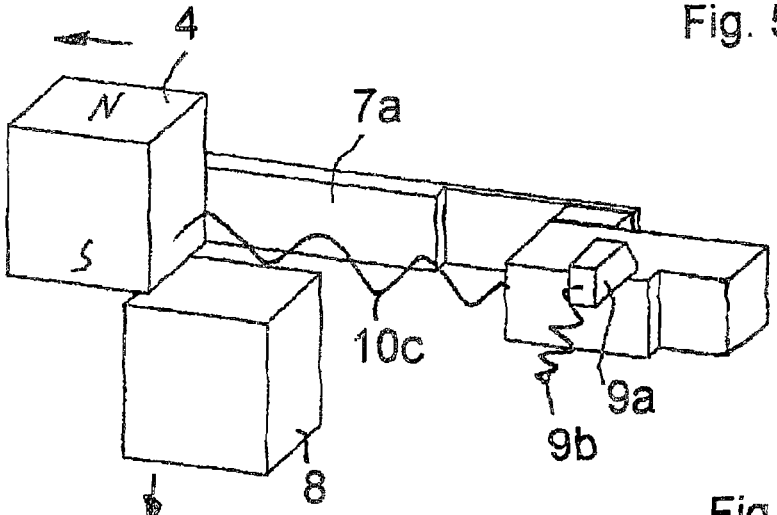
Figure 5C:
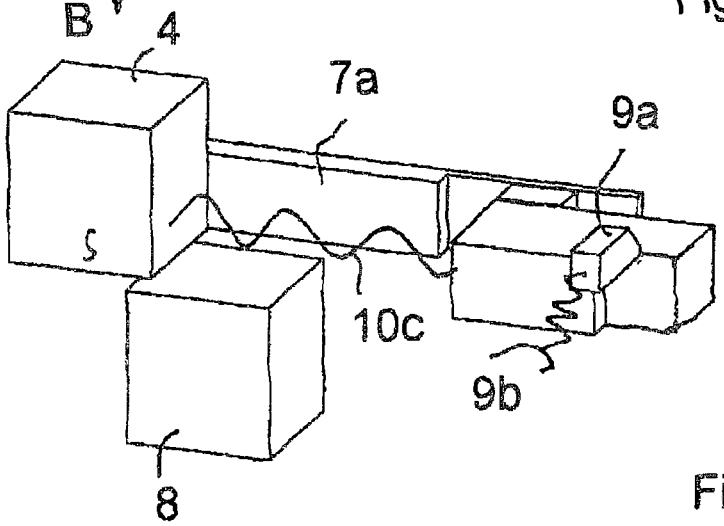

FIGS. 5*a-c* show another special coupling device 7.

The general function has already been described in FIG. 1 and the special effect of a coupling with play was described with reference to FIG. 2. This coupling structure relates to a safety function against opening under load, as already described with reference to FIG. 1*f*. FIG. 5*a* shows the closed connecting structure under load, i.e., the locking member 9*a* is pressed on the locking piece 5 in the direction of the arrow. A magnet-locking piece coupling spring 10*c* is arranged between the locking piece 5 and the magnet 4. When the magnet 4 is moved according to FIG. 5*b* in the direction of the arrow, then the magnet-locking piece coupling spring 10*c* expands, while the locking member 9*a* holds the locking piece 5 in its position. When the force F in the direction of arrow B is removed, the magnet-locking piece coupling spring 10*c* pulls the locking piece 5 to the left, so that the locking member 9*a* is no longer in engagement. The locking piece 5 is returned to the right by the left end section of the coupling recess 7*b*.

The advantage of these coupling devices with play is the aforedescribed prevention of opening under load. This type of closure device is employed for closures in mountaineering or yacht equipment to securely connect belts, ropes, cables, etc.

The schematic diagrams of FIGS. 1 to 5 will now be described with reference to particular exemplary embodiments. If possible, the correlation between the exemplary embodiments and the schematic diagrams of FIGS. 1 to 5 forming the basis for these embodiments is indicated.

A person skilled in the art will appreciate that the movements of the magnet and the locking piece and other elements are not limited to movement on a straight line. The movement along a straight line, however, is best suited for an explanation, so that a straight movement is selected for a description of the schematic diagrams of the invention in FIGS. 1 to 5. A skilled artisan will also understand that many variants exist for the arrangement of coupling devices and their design, for example, by combining the illustrated variants, so that a skilled artisan can find suitable combinations or the modifications, without having to perform an inventive step.

In the following two special exemplary embodiments, the movement of the magnetic is along a straight line.

FIG. 6 shows a closure for bags or school backpacks.

Figure 6A:
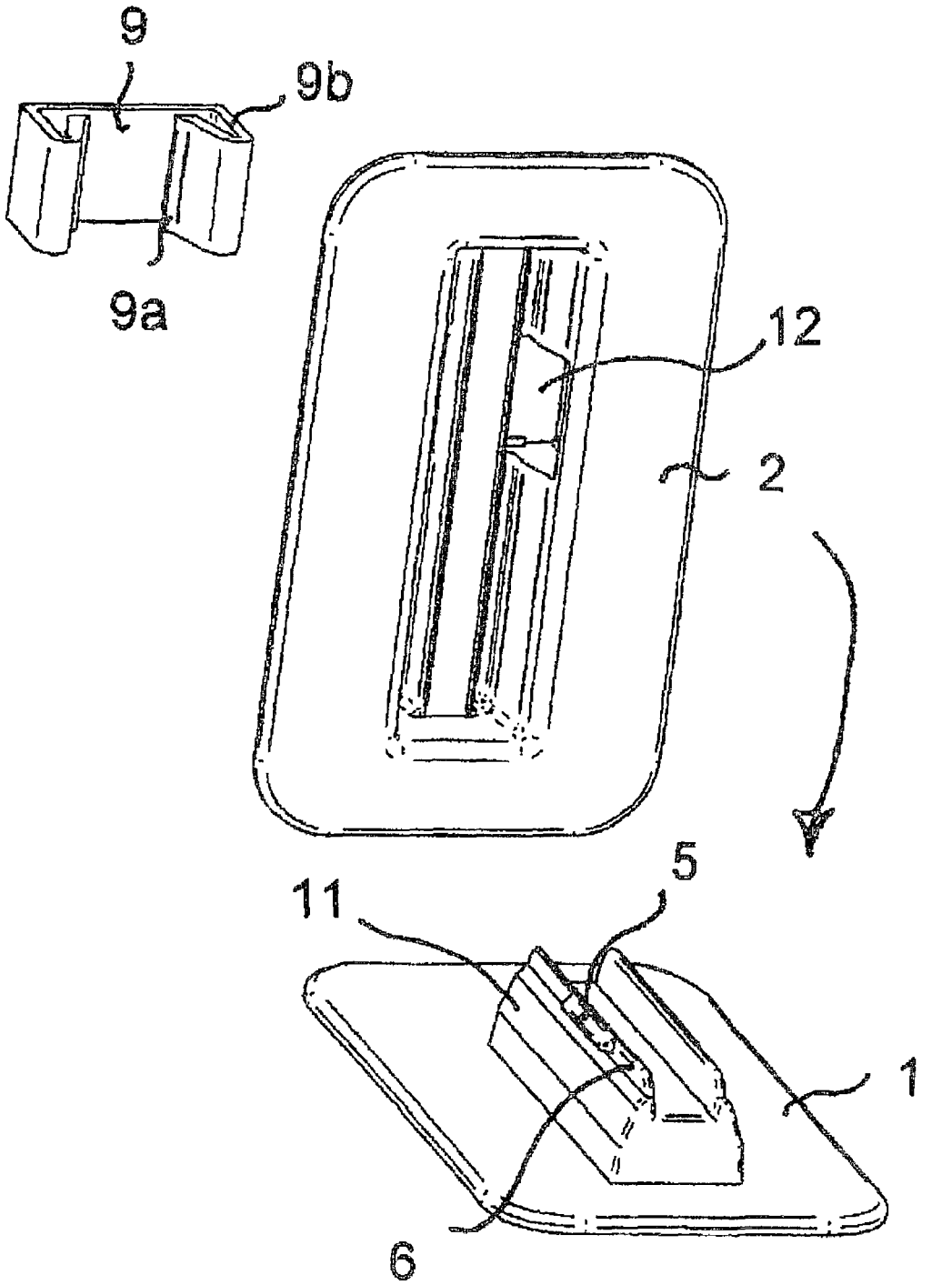
FIG. 6 shows the invention in a first special exemplary embodiment.

FIG. 6*a* shows a perspective view of the essential components. The closure consists of the connecting modules 1 and 2, which are attached to the bag. These can be attached in essence in different ways, for example by sewing, gluing, or with rivets or screws. The following embodiments will not recite the particular attachment options, because a skilled artisan will understand how such products are attached. The connecting module 1 is configured as a plug with an elongated, wedge-shaped plug-in segment 11. A stationary locking piece 5 with a gap 6 is formed in the plug-in segment 11. The spring locking element 9 is shown separately and is inserted into the spring locking element receiving opening 12 towards the arrow. The magnets are illustrated in the following views.

Figure 6B:
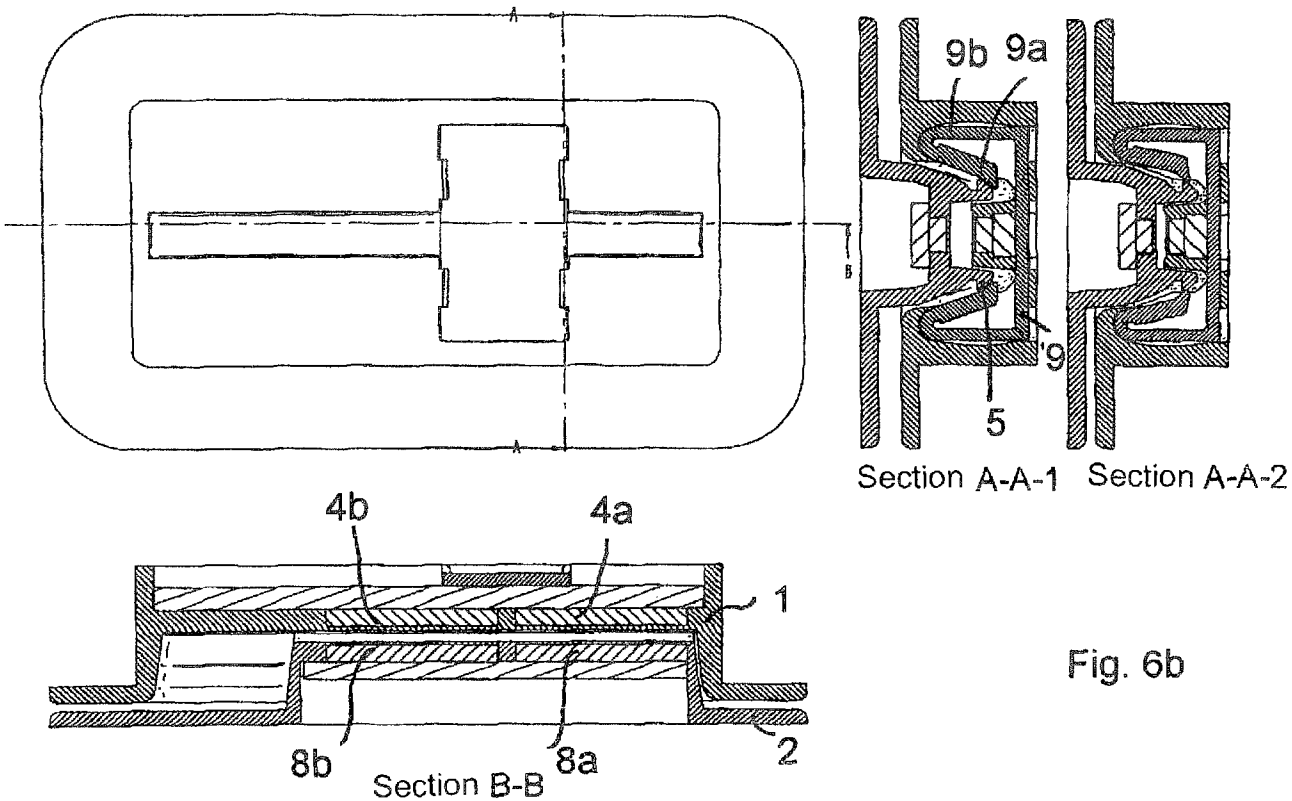

FIG. 6*b* shows two cross-sectional views A-A which illustrate how the two connecting modules interlock. In the cross-sectional view A-A-1, the spring locking element 9 rests on the locking piece 5. This corresponds to the operating phase in FIG. 1*b*. In the cross-sectional view A-A-2, the spring locking element 9 is already bent backward, which corresponds to the operating phase in FIG. 1*c*.

The position of the magnets and armature made of ferromagnetic material can be seen in the longitudinal section B-B. It is clear to a skilled artisan that the armature 8 can also be magnets. The position of the magnets and the armature is to be determined by the skilled artisan such that in the depicted cross-sectional view B-B the two connecting modules attract one another, i.e., either two attracting magnets or a magnet and an armature must be placed in opposition. If for example attracting armature magnets 8*a* and 8*b* are located opposite the magnets 4*a* and 4*b*, then the magnets 4 and the armature magnets 8 are poled with opposite polarity. When the magnets 4 and the armature magnets 8 are displaced relative to one another, then two magnetic poles with the same polarity face one another, causing repulsion, which will be described in relation to separation of the connecting modules.

Figure 6C:
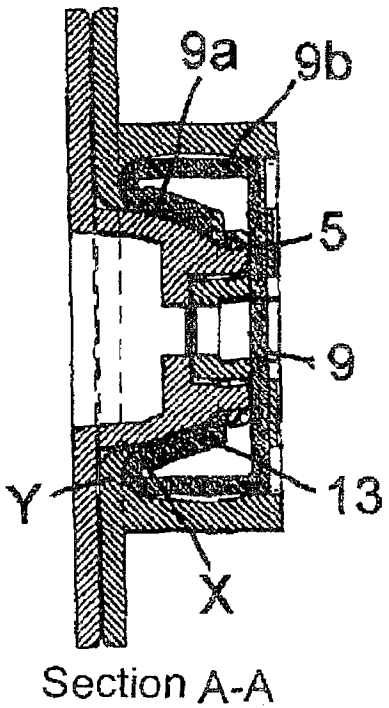
Figure 6C:
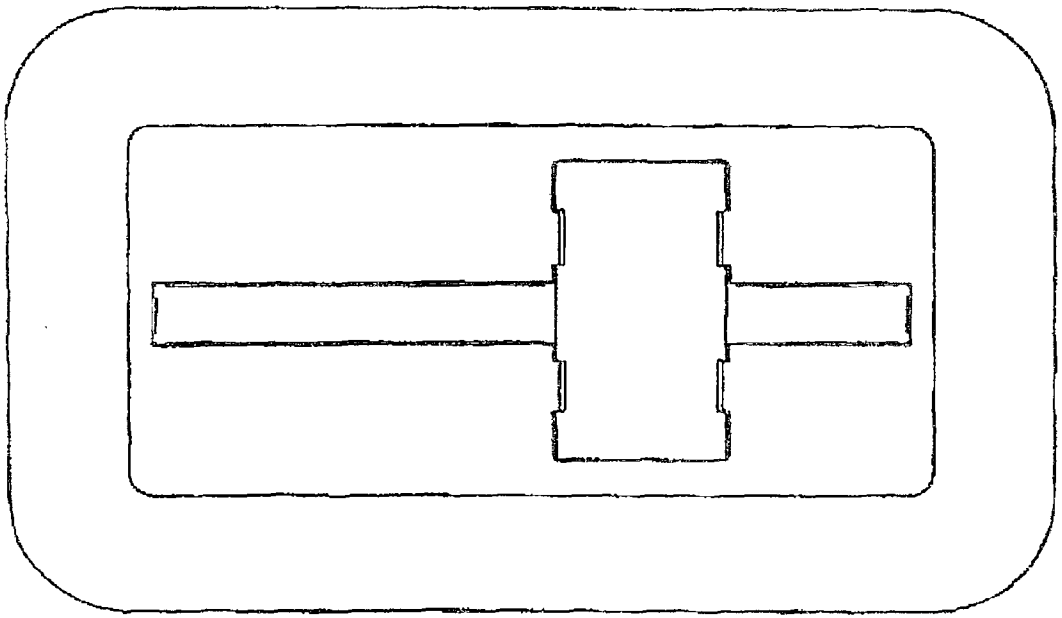
Figure 6C:
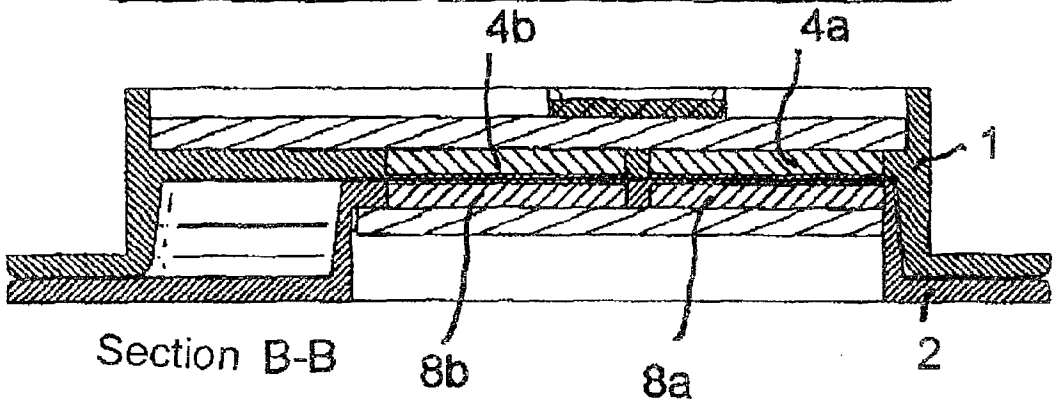

FIG. 6*c* shows the same diagram as FIG. 6*b*, however it can be seen from the cross-sectional view A-A that the spring locking element 9 is interlocked with the locking piece 5. The connection is therefore closed. It should be mentioned that the spring locking element 9 is supported over the entire area of the support area 13 and that the connecting structure is almost completely loaded under compression, which results in a very high stability of the connecting structure.

Figure 6D:
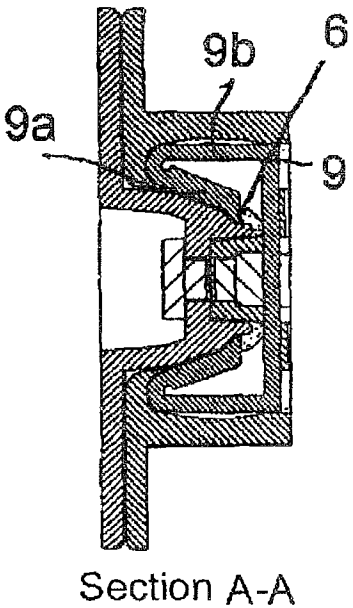
Figure 6D:
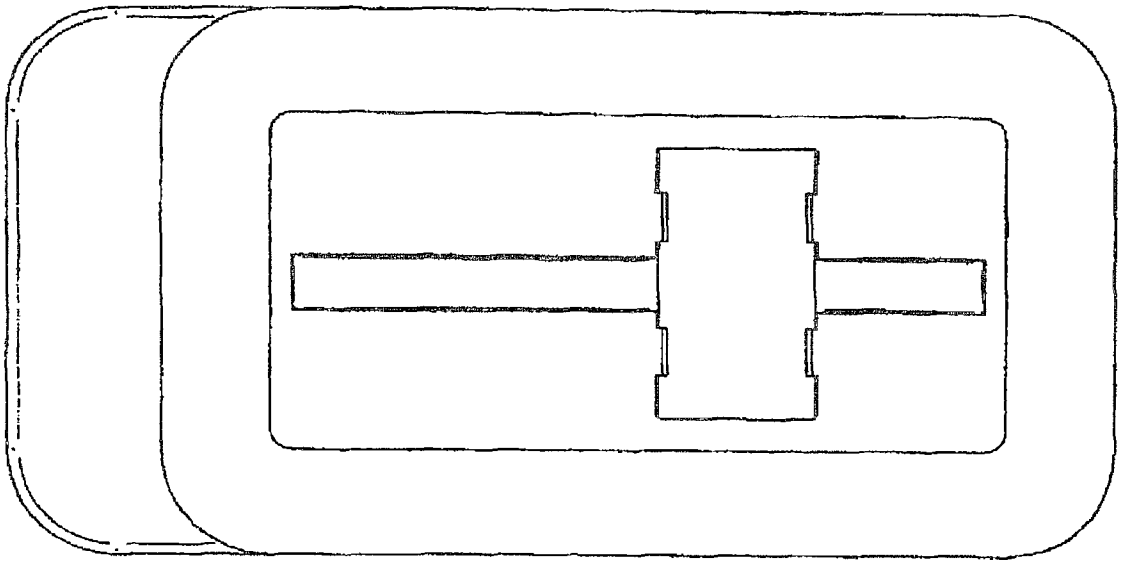
Figure 6D:
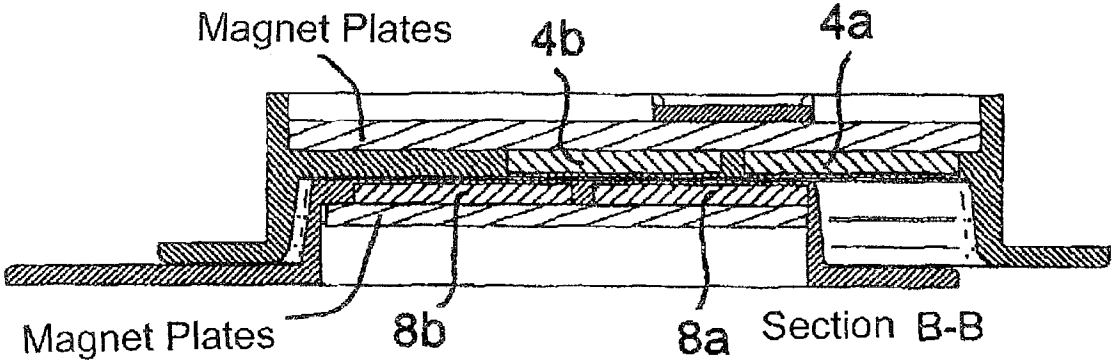

FIG. 6*d* shows the opening phase where the connecting module 2 is displaced to the left. The spring locking element 9 is located in the gap 6 and is therefore no longer in engagement. The magnet-armature structure 4/8 was displaced at the same time through the displacement of the module 2. FIG. 6*d* shows that magnet guide plates are arranged behind the magnets. These are used in this example to improve the effectiveness of the magnetic force through short-circuiting the magnetic field lines exiting in the rear and also protecting the content of the bag, for example credit cards, against undesirable magnetic fields.

Figure 7A:
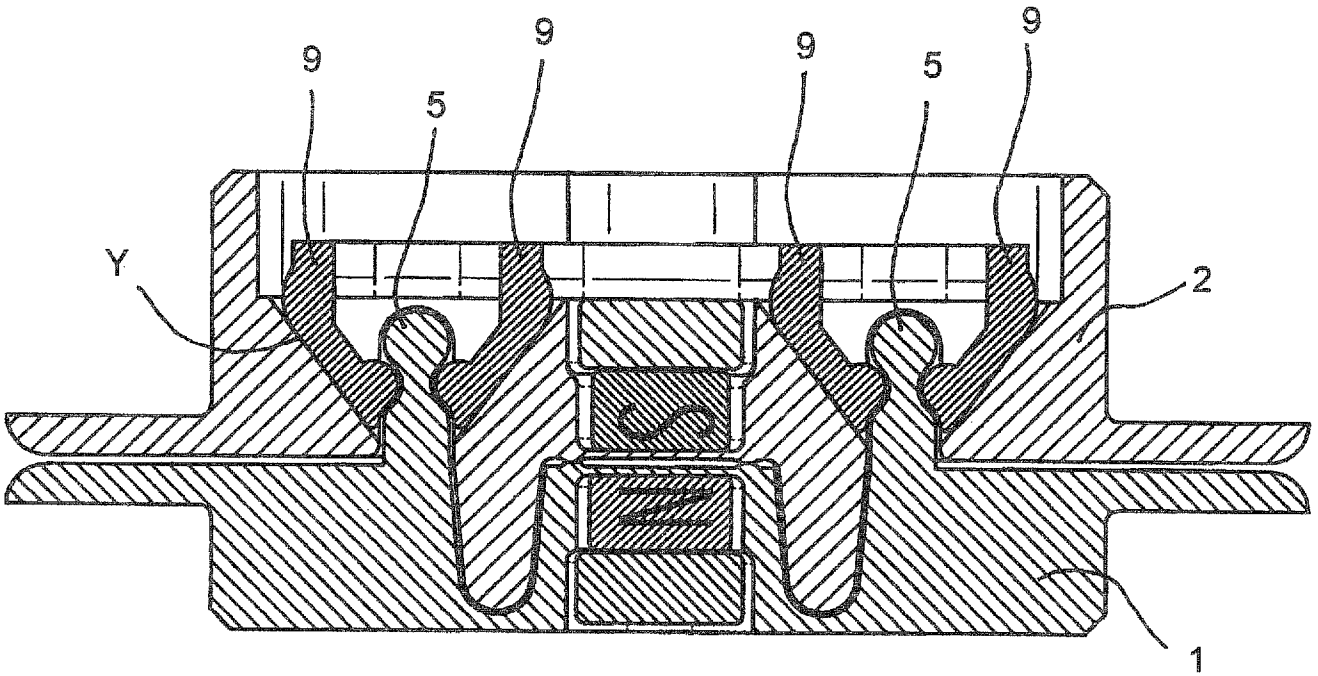
FIG. 7 shows the invention in another special exemplary embodiment.
Figure 7B:
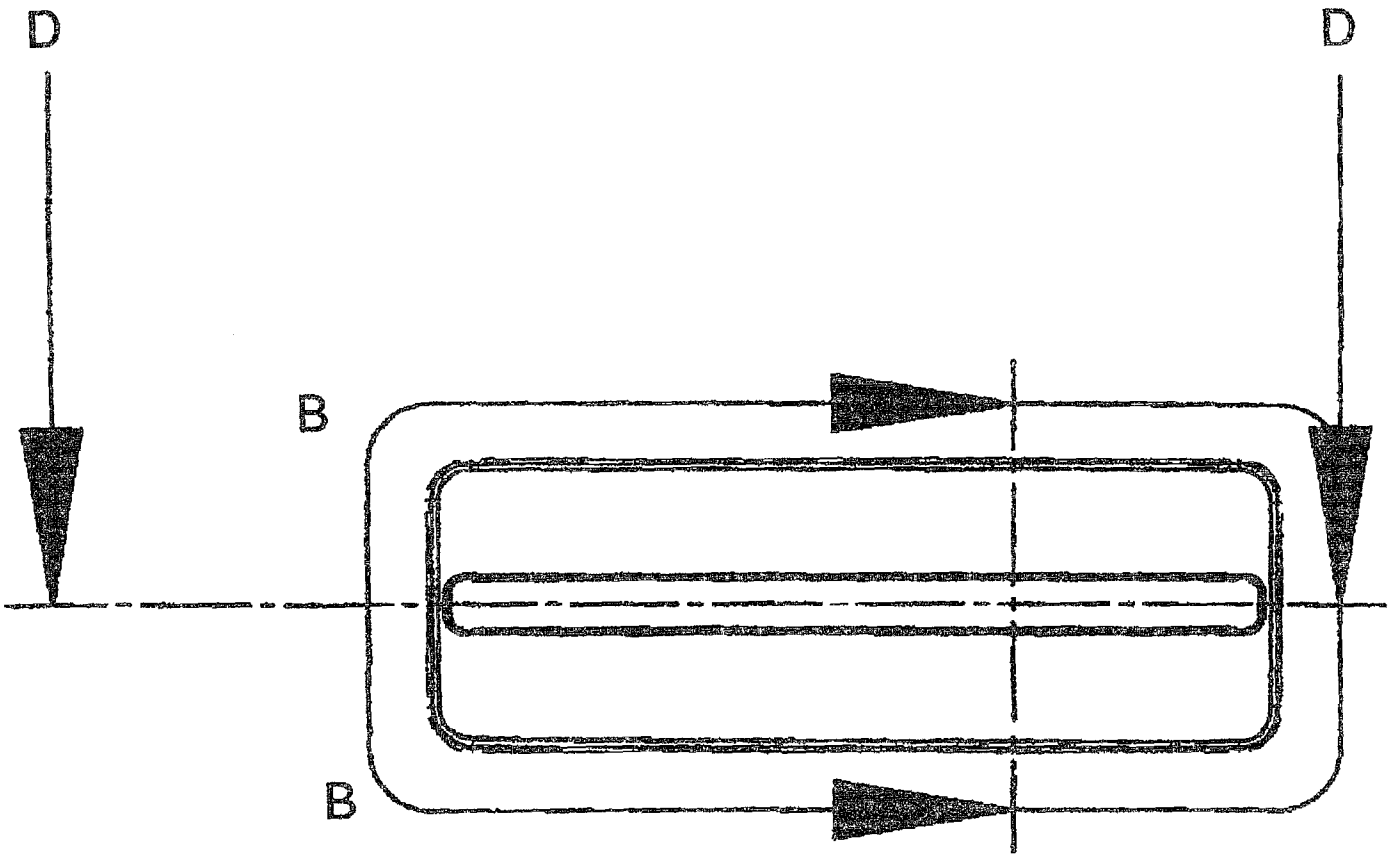

FIG. 7 also shows a closure for bags or school backpacks or similar applications. This closure is also opened by a linear displacement. Unlike the embodiment of FIG. 6, the locking elements which effect the formfitting closure are formed as so-called clamping closure, the function of which will be described below:

The locking piece 5 with a gap 6 is arranged in the connecting module 1, as described in more detail with reference to the following Figures. Connecting module 2 includes the spring locking element 9. FIG. 7*a* shows a cross-sectional view in a plane B-B, the orientation of which is shown in FIG. 7*b*. The locking pieces 5 are rounded beads of webs. The likewise rounded locking elements of the spring locking elements 9*a* are located below in formfittingly mating recesses. The spring locking elements 9 rest on inclined surfaces Y on the connecting module 2. Under load and with a suitable geometry of the inclined surface Y, the locking elements 9*a* and the locking pieces 5, a clamping formfitting connection is attained which become stronger under load.

Figure 7C:
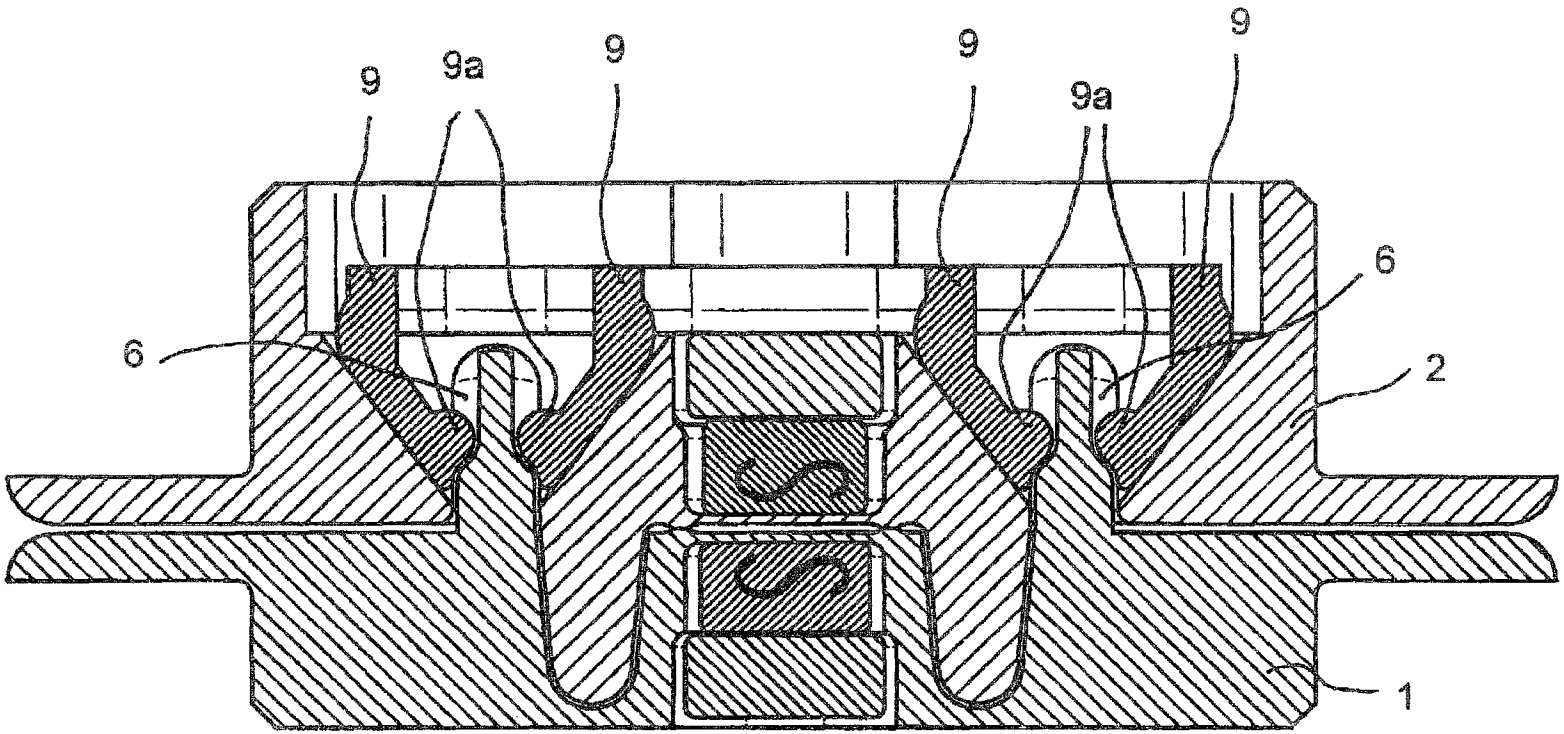

FIG. 7*c* shows the closure in a cross-sectional view in the plane B-B following displacement of the connecting module 1. The spring connecting element 9 is located in the gap 6 and is therefore no longer in engagement. At the same time, the displacement of the module 2 causes displacement of the magnet-armature structure 4/8.

Figure 7D:
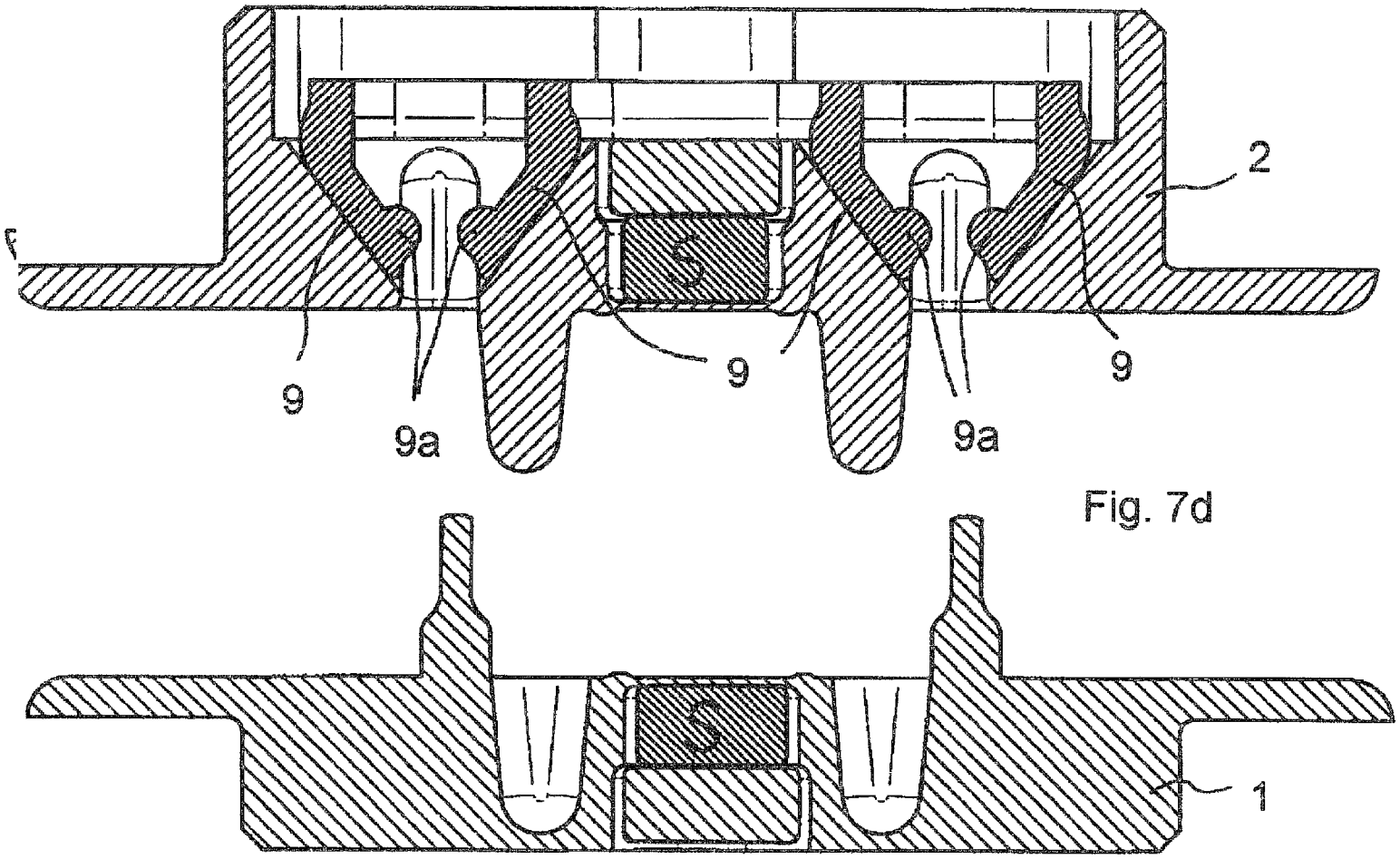
Figure 7E:
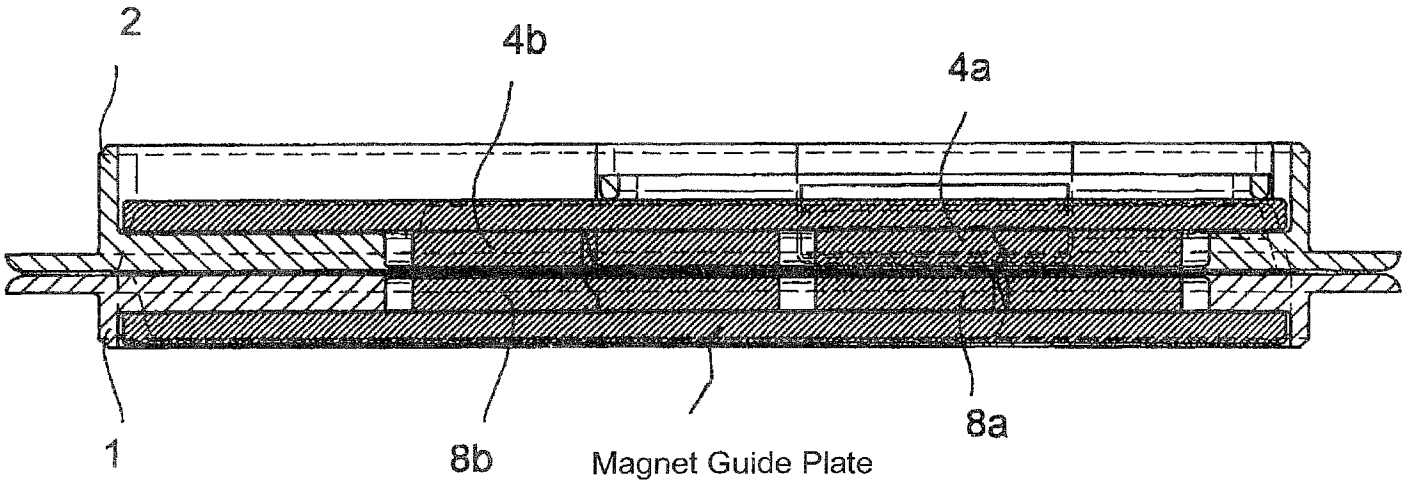
Figure 7F:
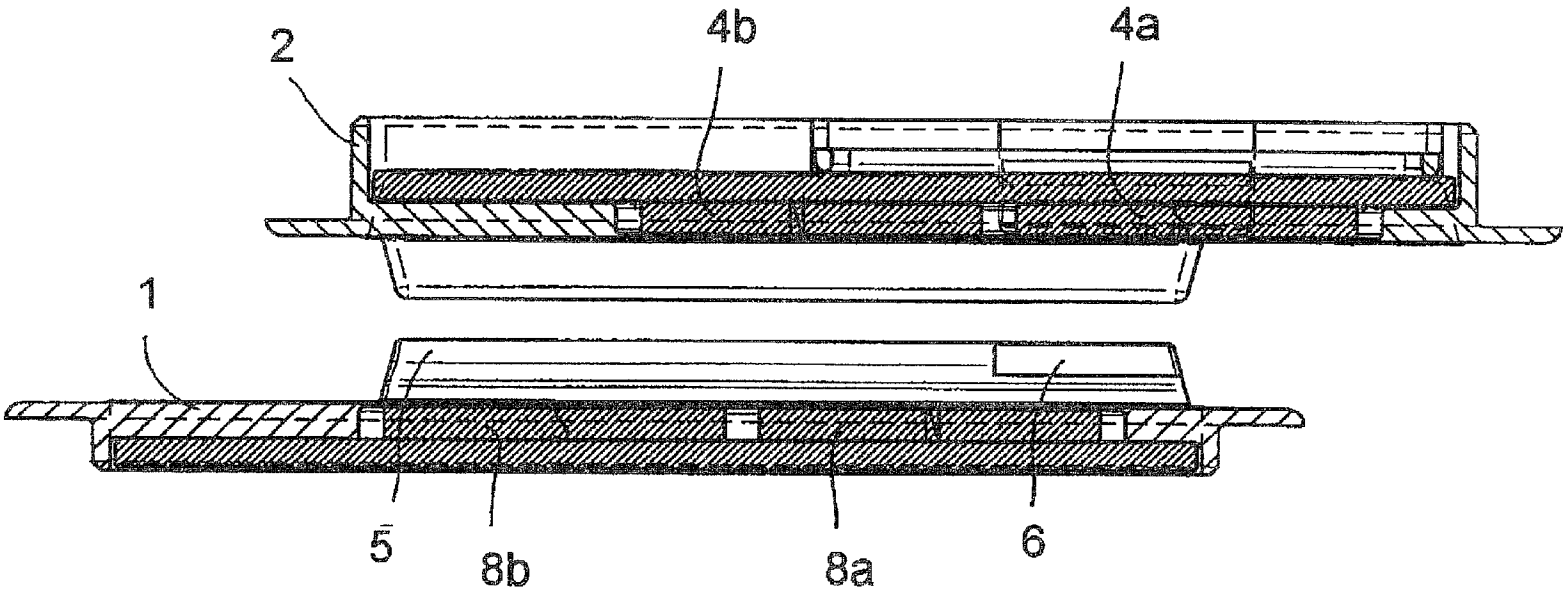

FIG. 7*d* shows the closure after being opened. FIG. 7*e* shows a cross-sectional view in the plane D-D, which also show the position and polarity of the magnet-armature structure. In this embodiment, 4*a*, 8*a* and 4*a*, 4*b* are two pairs of magnets which mutually attract one another in the closed position, which in the displacement shown in FIG. 7*f* are positioned opposite one another and partially repel each other, thereby supporting opening of the closure.

Figure 7G:
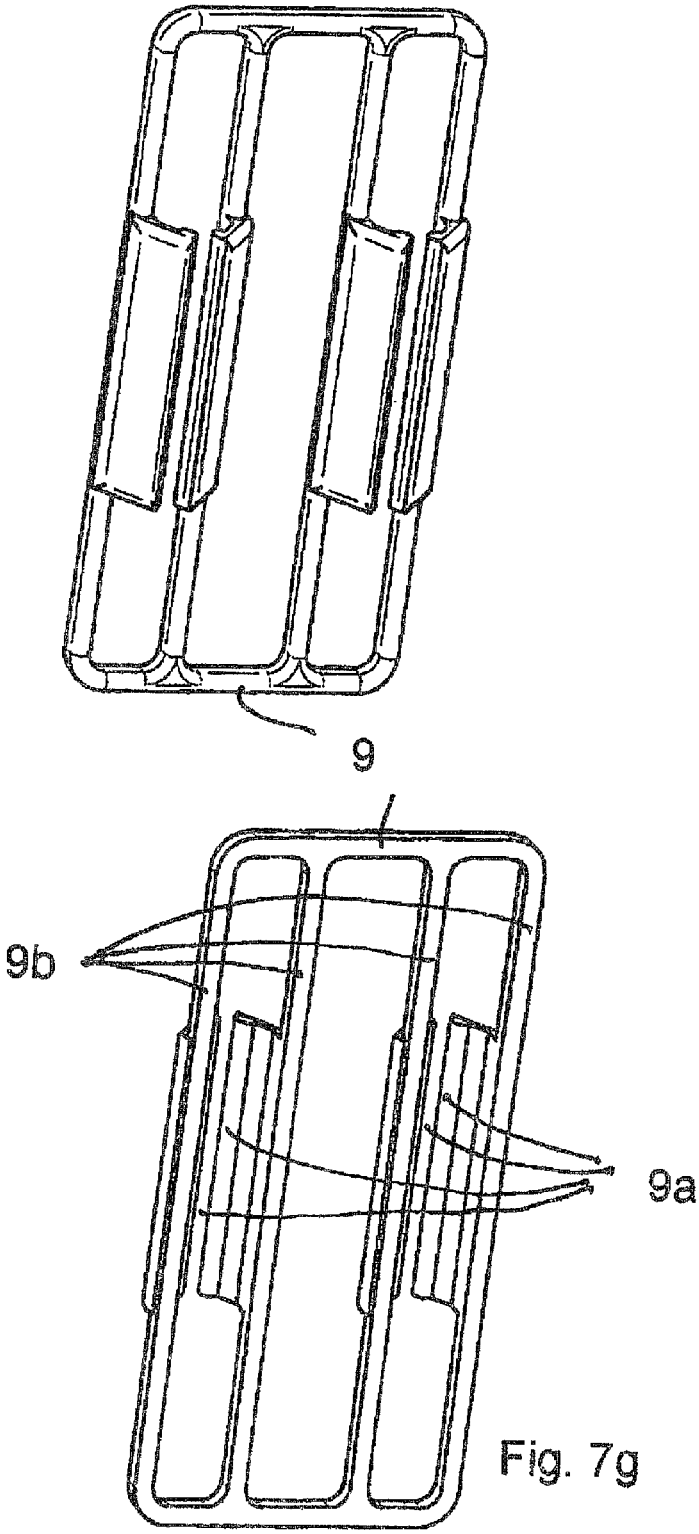
Figure 7H:
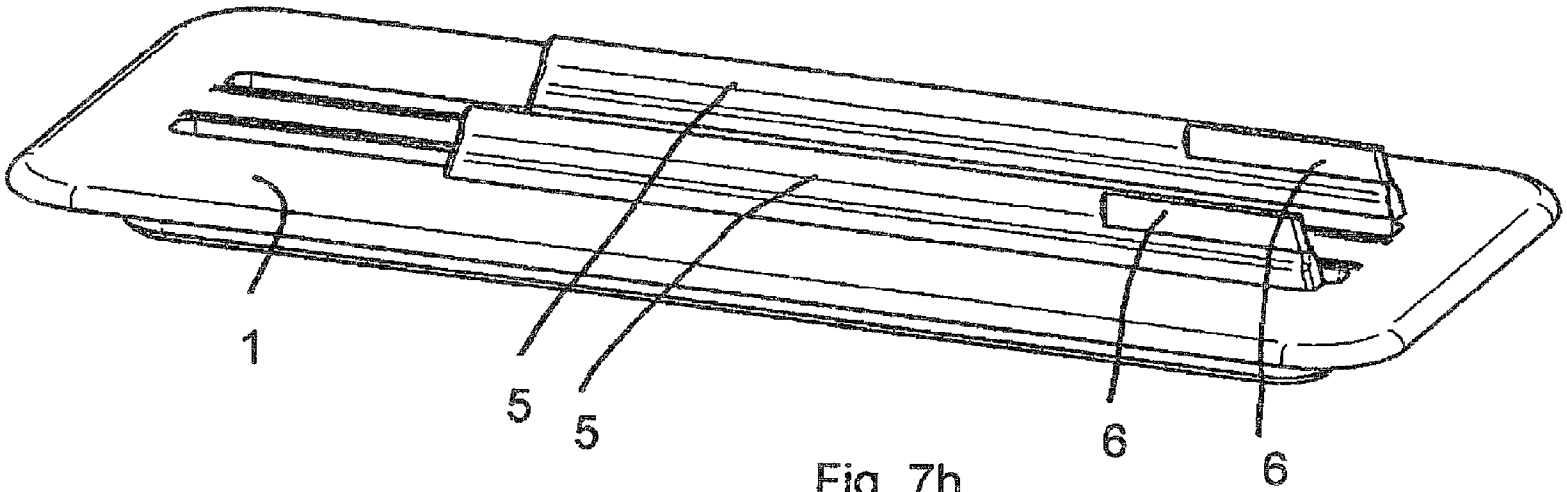
Figure 7I:
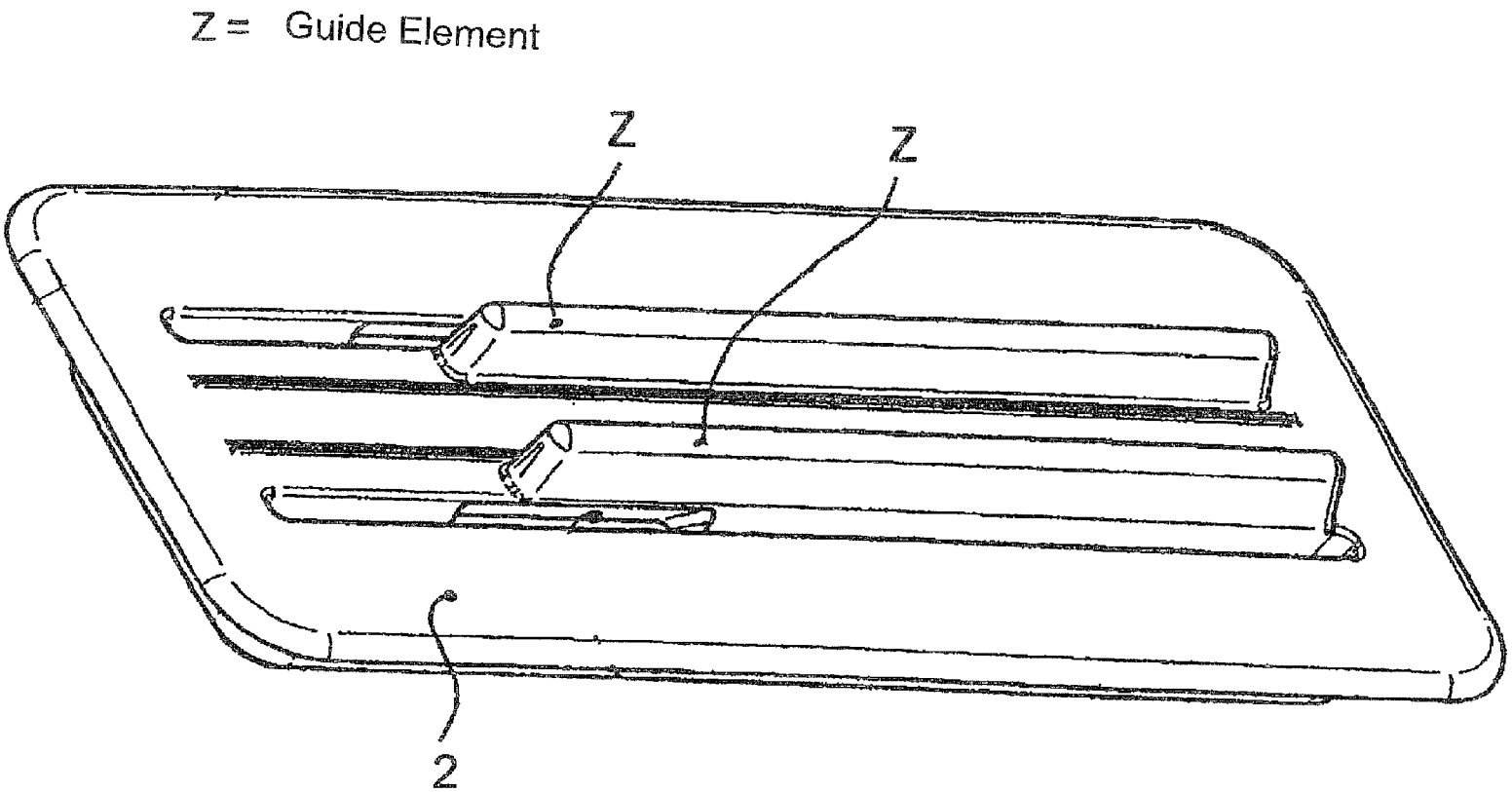
Figure 7K:
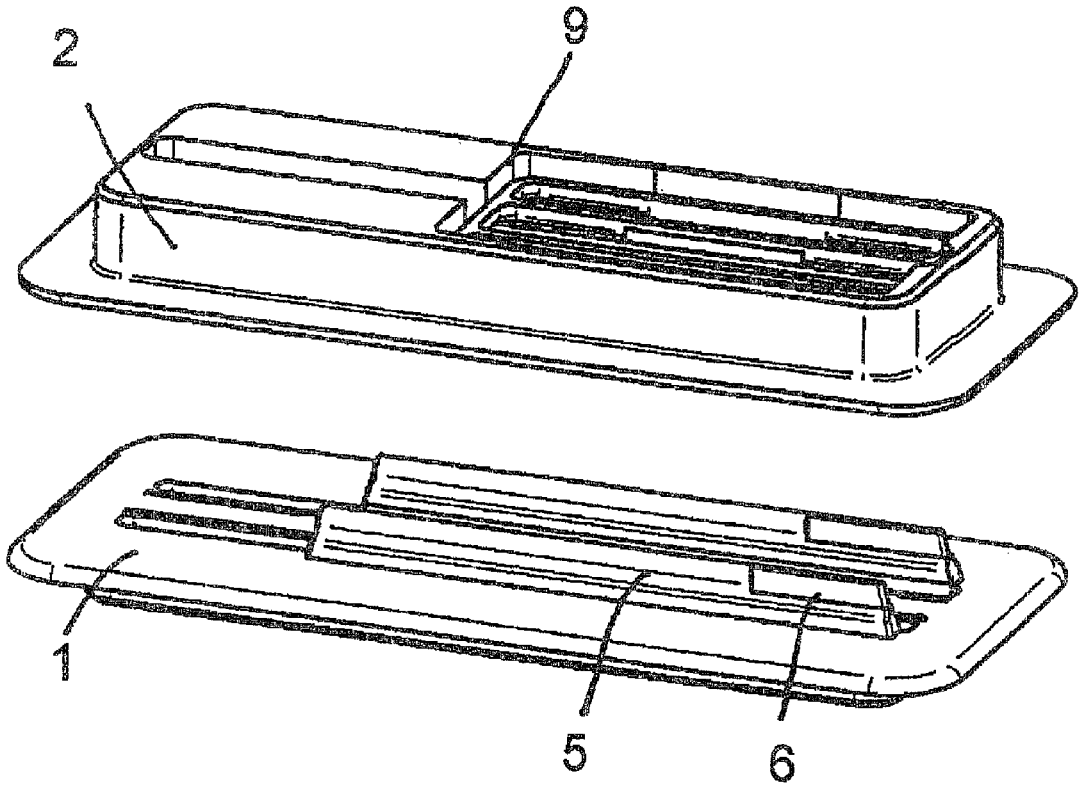

In this embodiment, magnet guide plates are also provided which are used to better exploit the magnetic force by short-circuiting the magnetic force lines exiting at the rear and to shield the content of the bag from the magnets or armatures 4, 8, for example so as not to damage credit cards. FIG. 7*g* shows the spring locking element in a perspective view. Four locking elements 9*a* are connected as a single piece by way of the spring segments 9*b*. FIG. 7*h* shows a connecting module 1 with the locking pieces 5 arranged on the webs and the gaps 6. FIG. 7*i* shows a connecting module 2 with the recesses for the spring locking element 9. FIG. 7*k* shows a connecting module 1 and 2 with the locking member 9 in a perspective view.

FIG. 8 likewise shows a closure for bags or school backpacks or similar applications. In this closure, the two connecting modules 1 and 2 are not displaced linearly towards one another, but are instead rotated concentrically relative to one another. This rotation is performed with an actuating device that can be moved by hand. The mutually rotatable magnet-armature structure can be rotated from an attracting position into an opening position. Depending if a magnet is moved into opposition with a ferromagnetic armature or with a magnet poled with the opposite polarity, the attractive force is either only weakened or a repulsive force is produced which pushes the connecting modules apart.

Figure 8B:
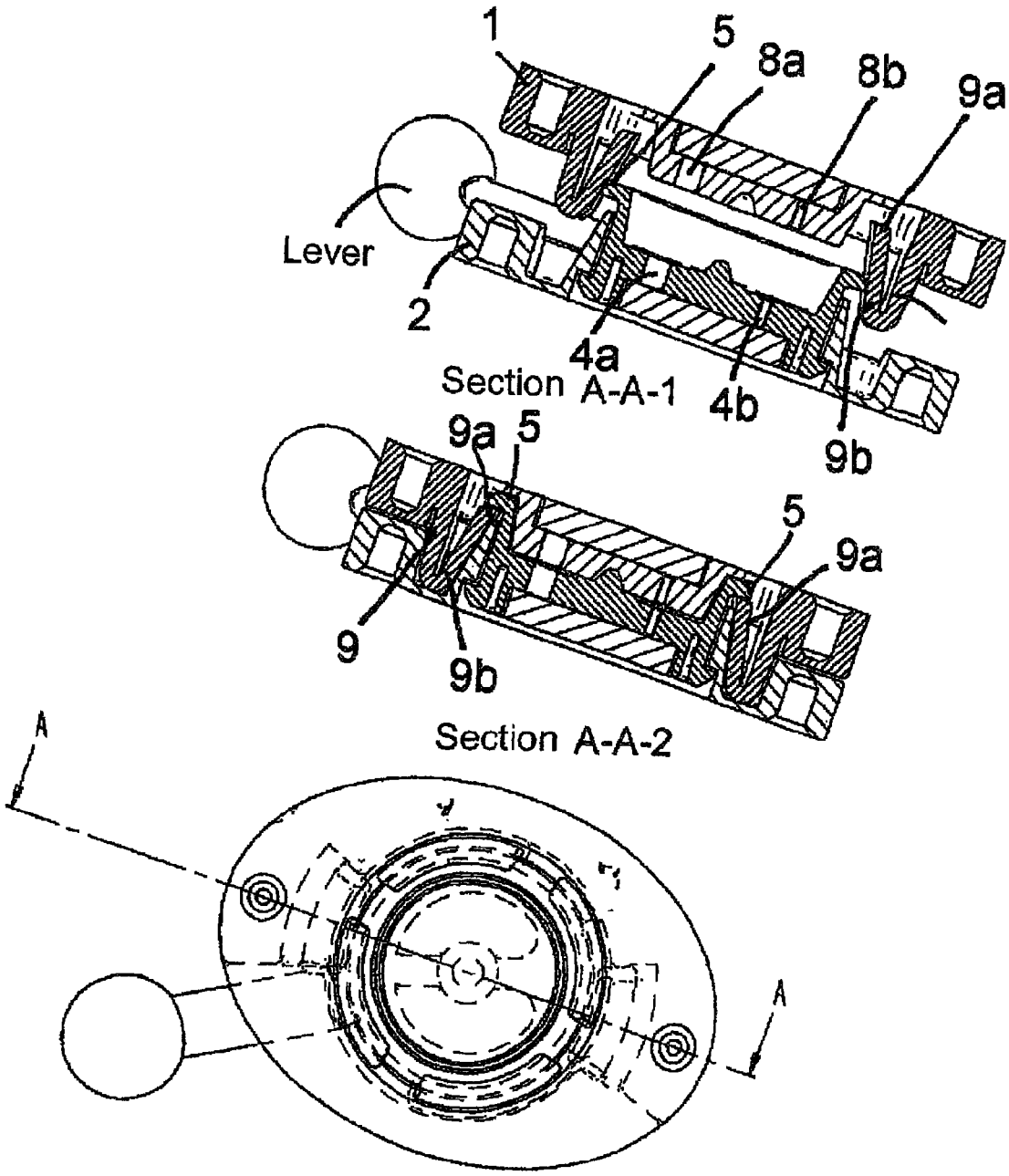
FIG. 8 shows the invention in another special exemplary embodiment.
Figure 8C:
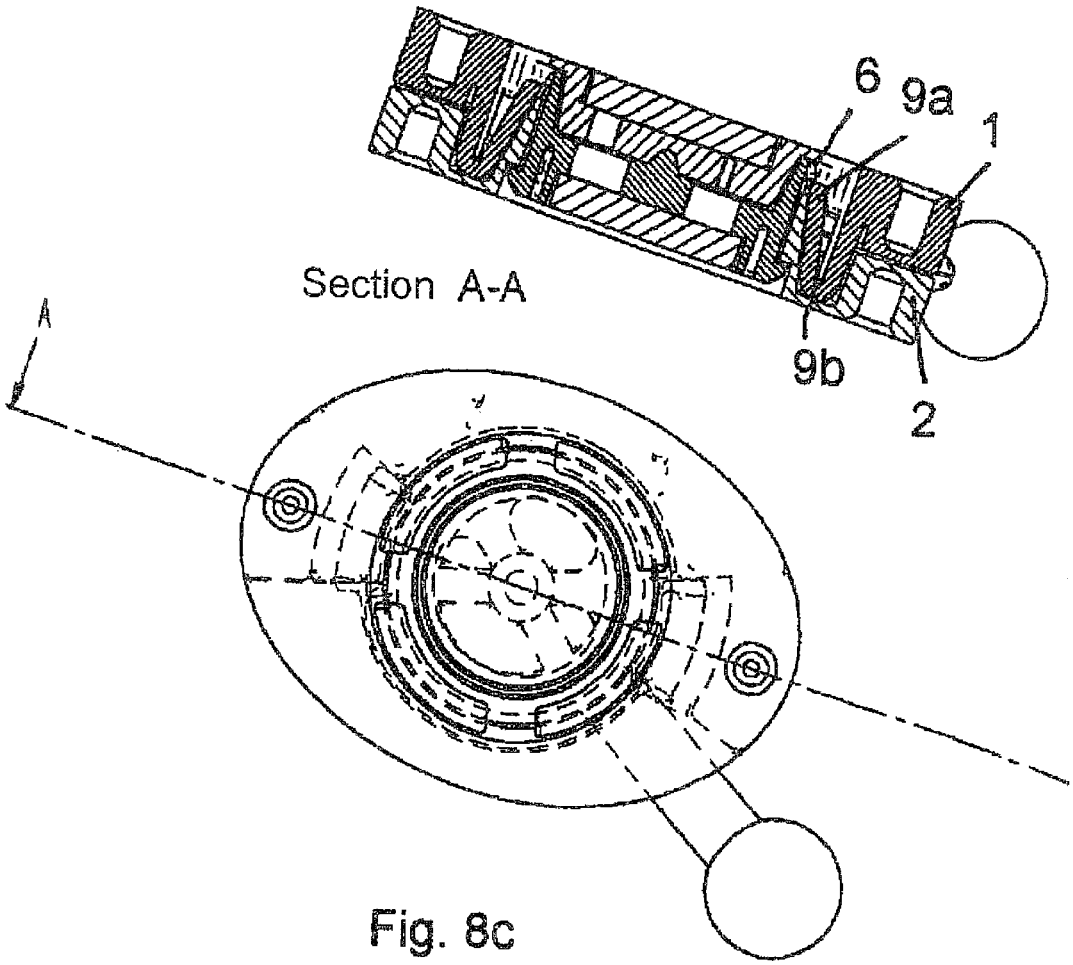
Figure 9A:
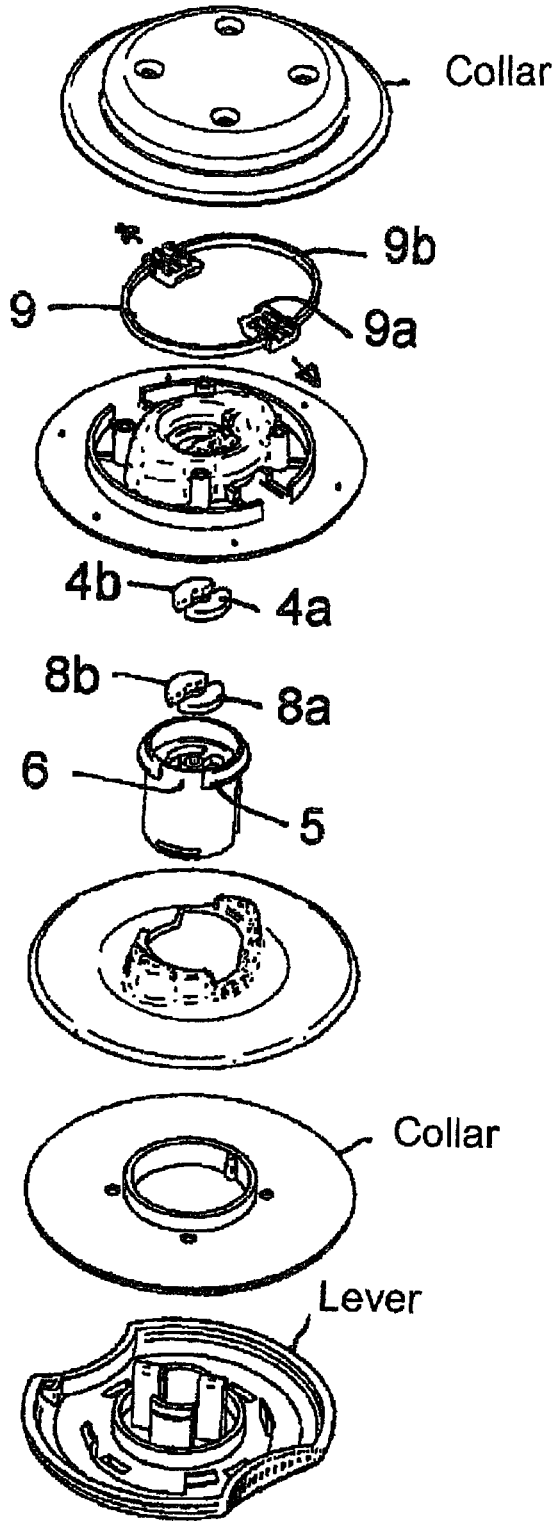
FIG. 9 shows the invention in another special exemplary embodiment.
Figure 9B:
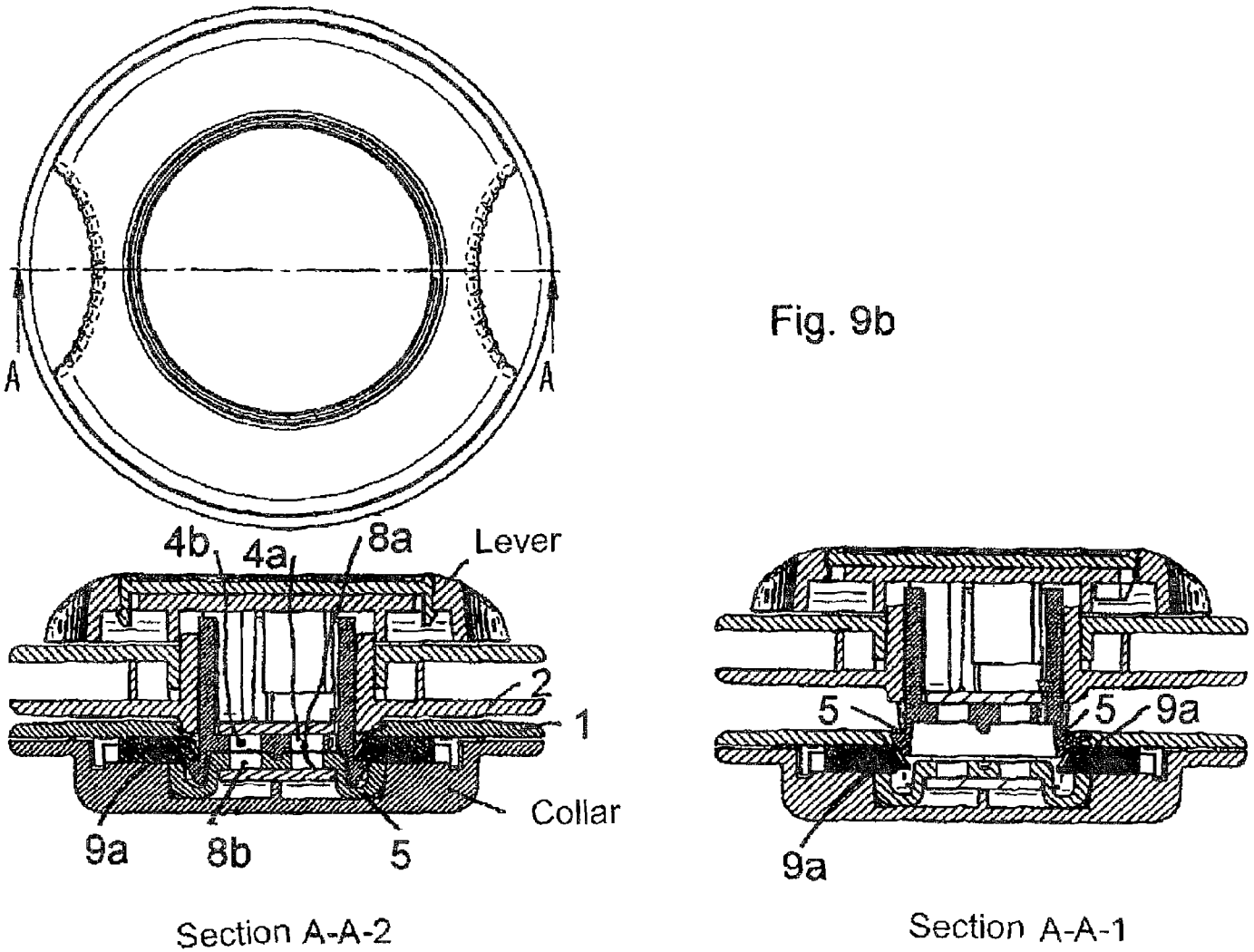
Figure 9C:
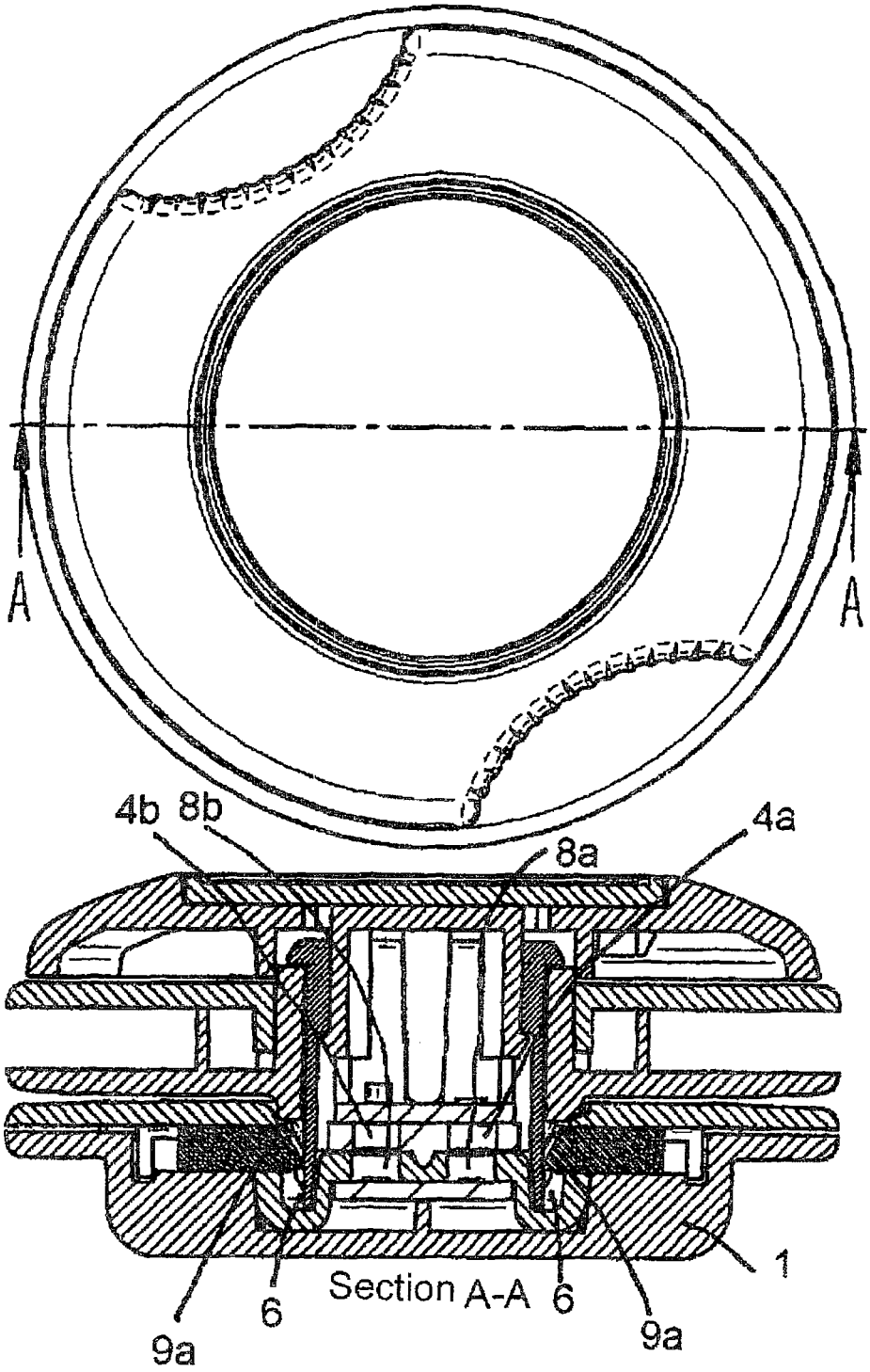
Figure 9D:
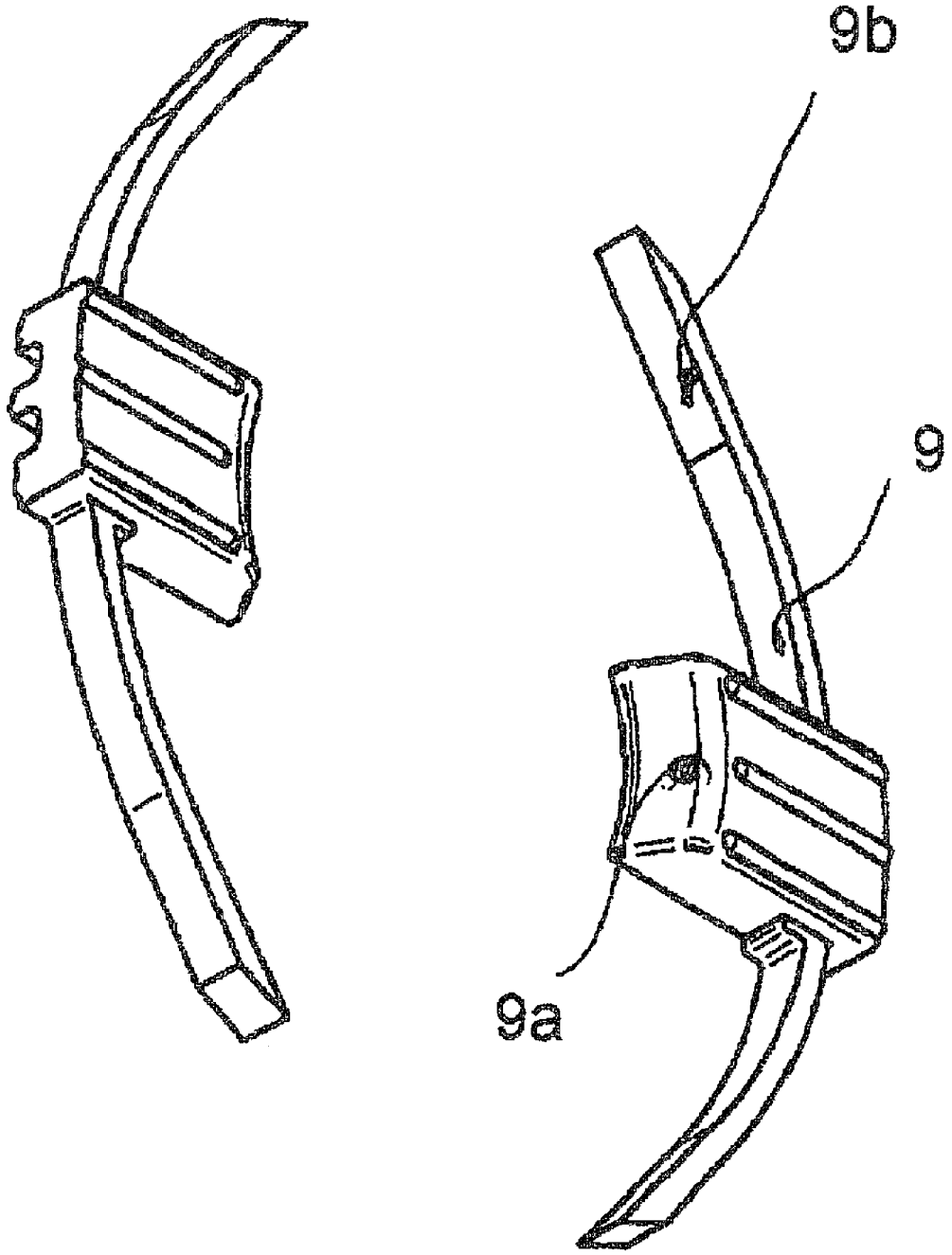
Figure 9E:
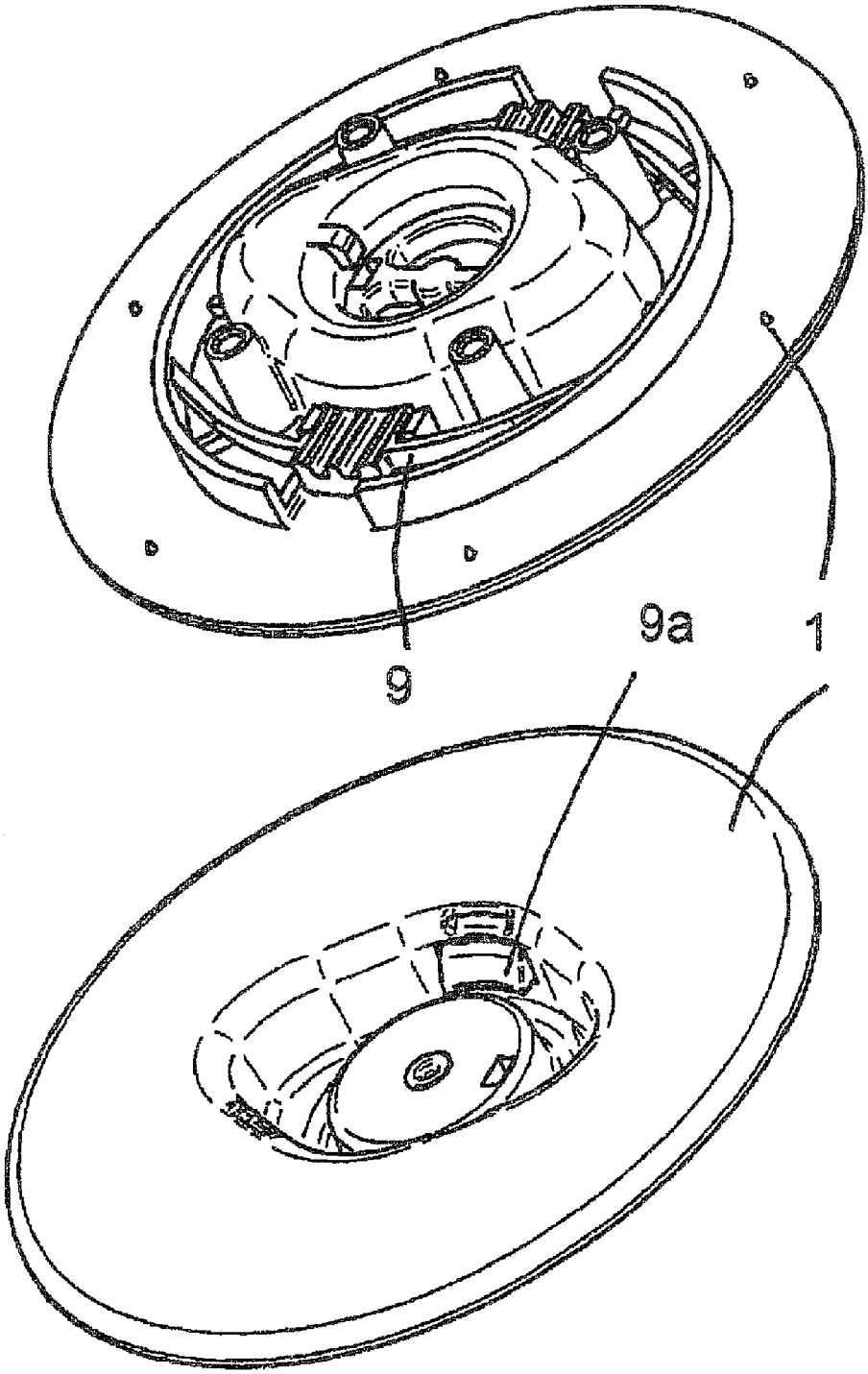
Figure 9F:
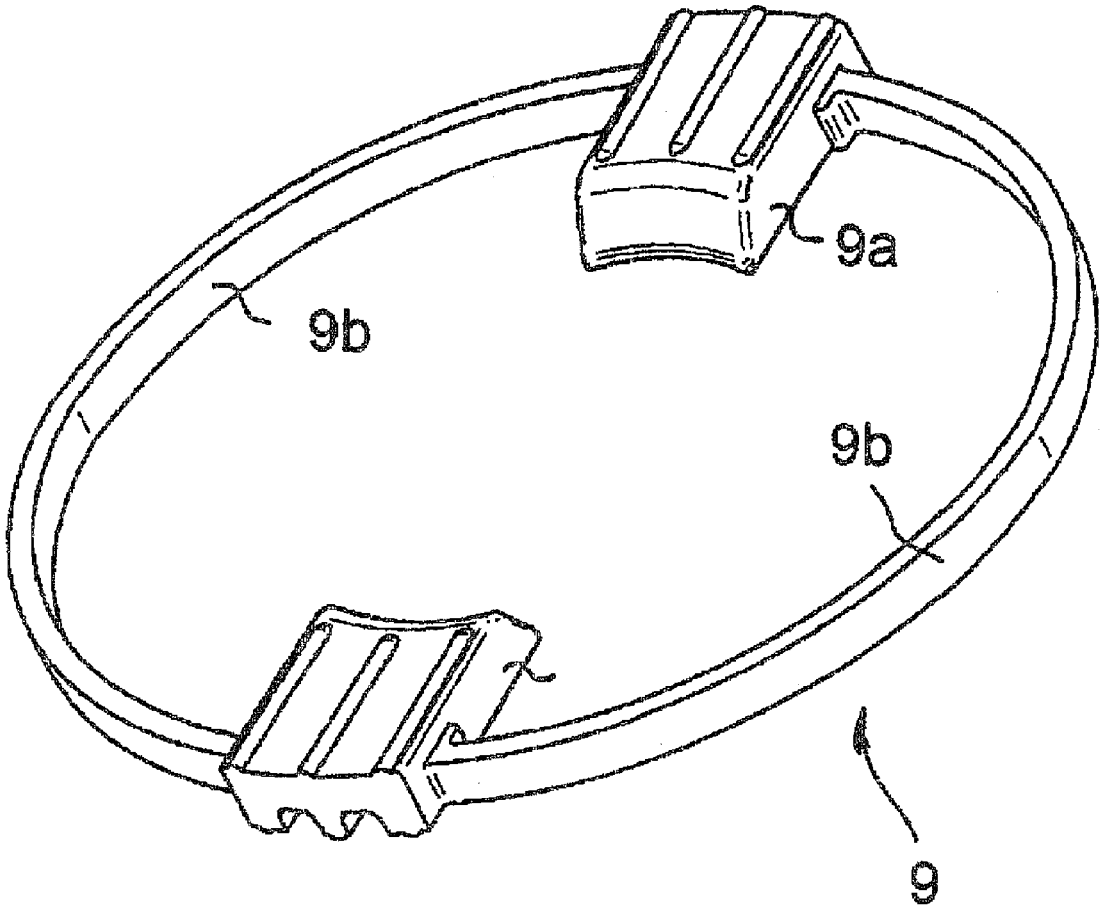
Figure 10A:
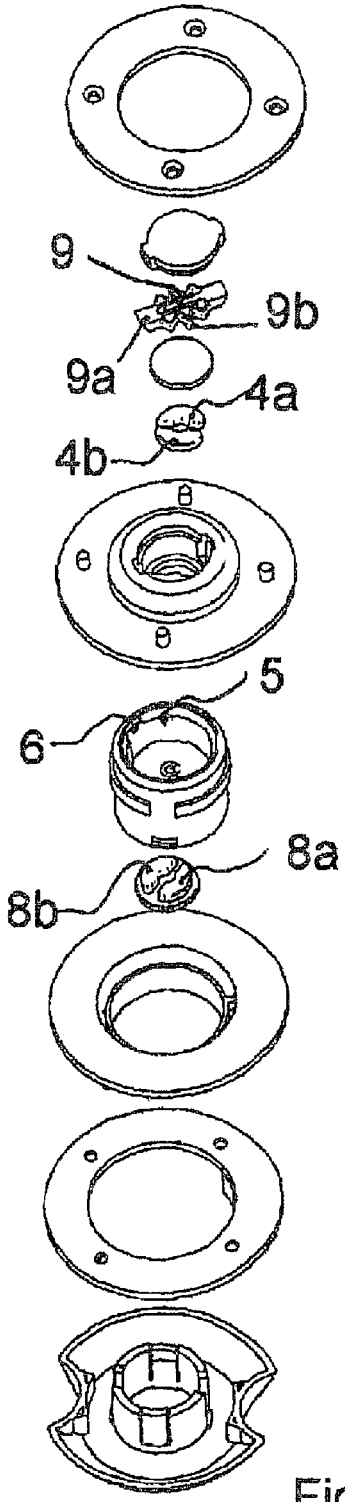
FIG. 10 shows the invention in another special exemplary embodiment.
Figure 10B:
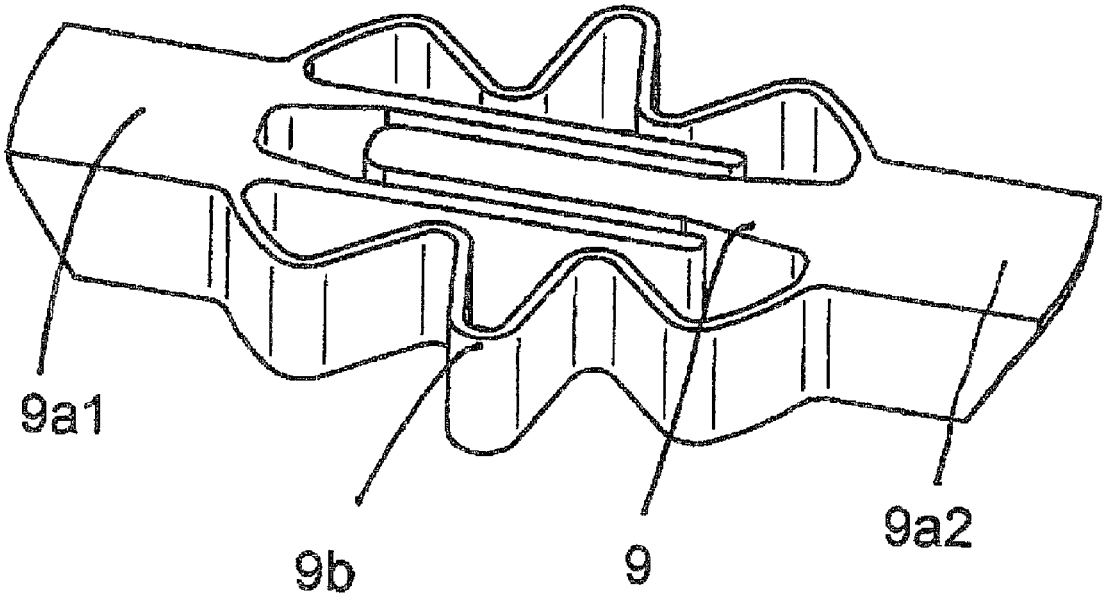
Figure 10C:
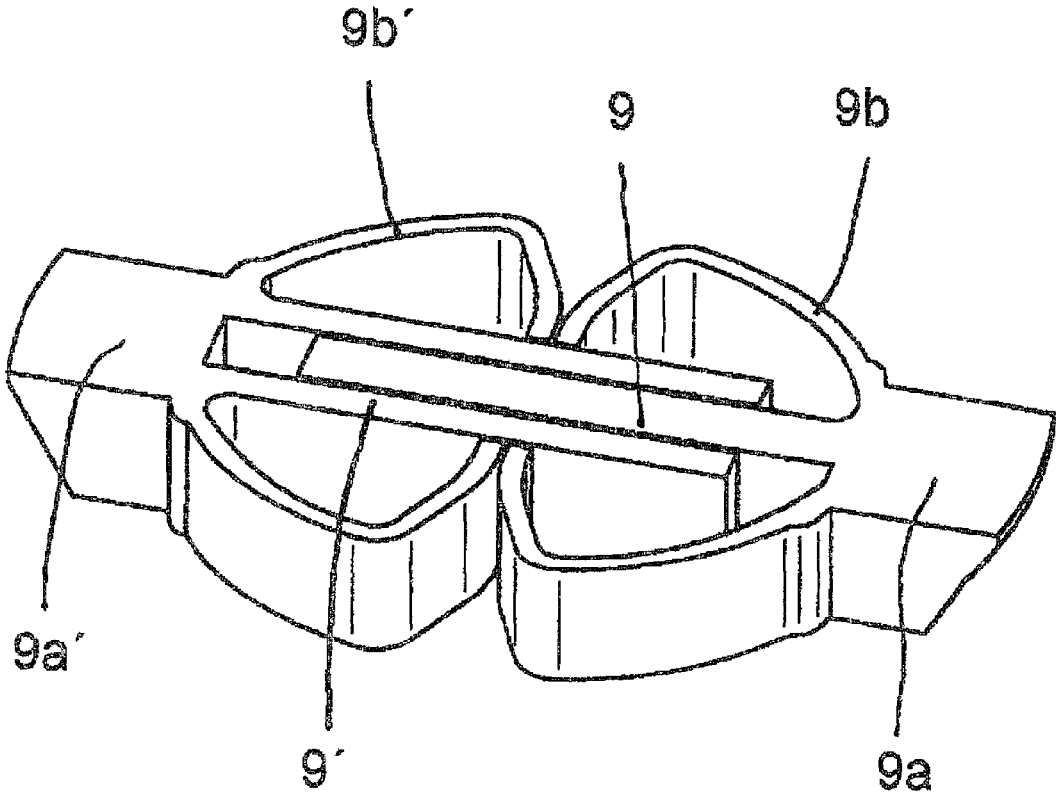
Figure 10D:
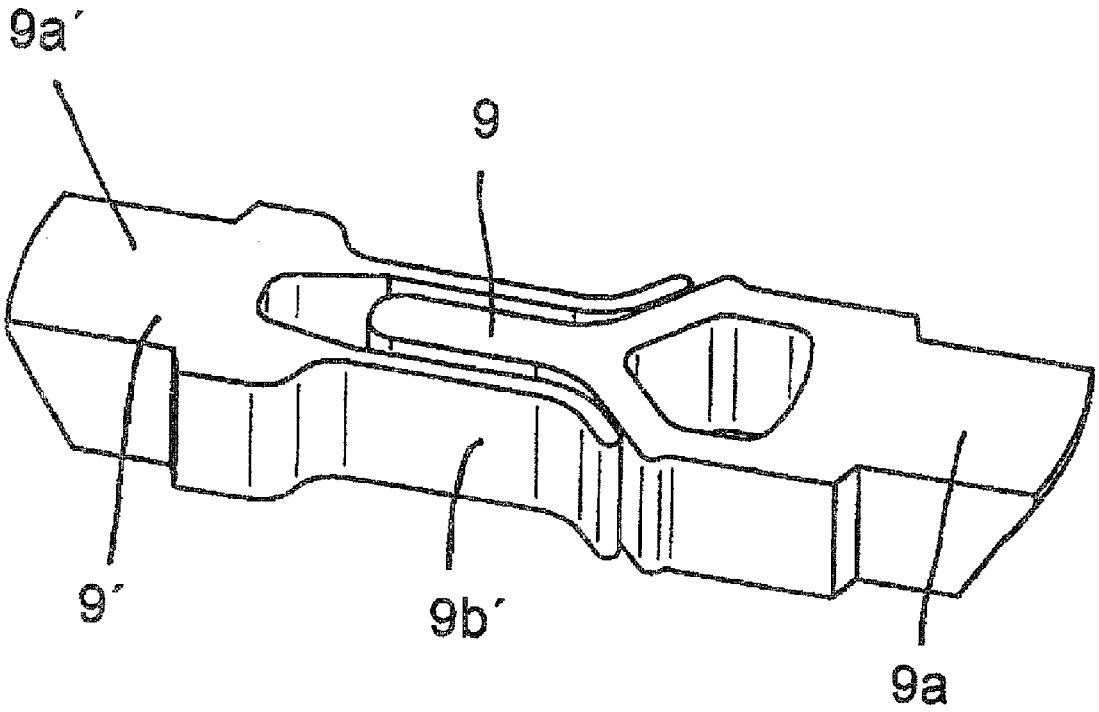
Figure 10E:
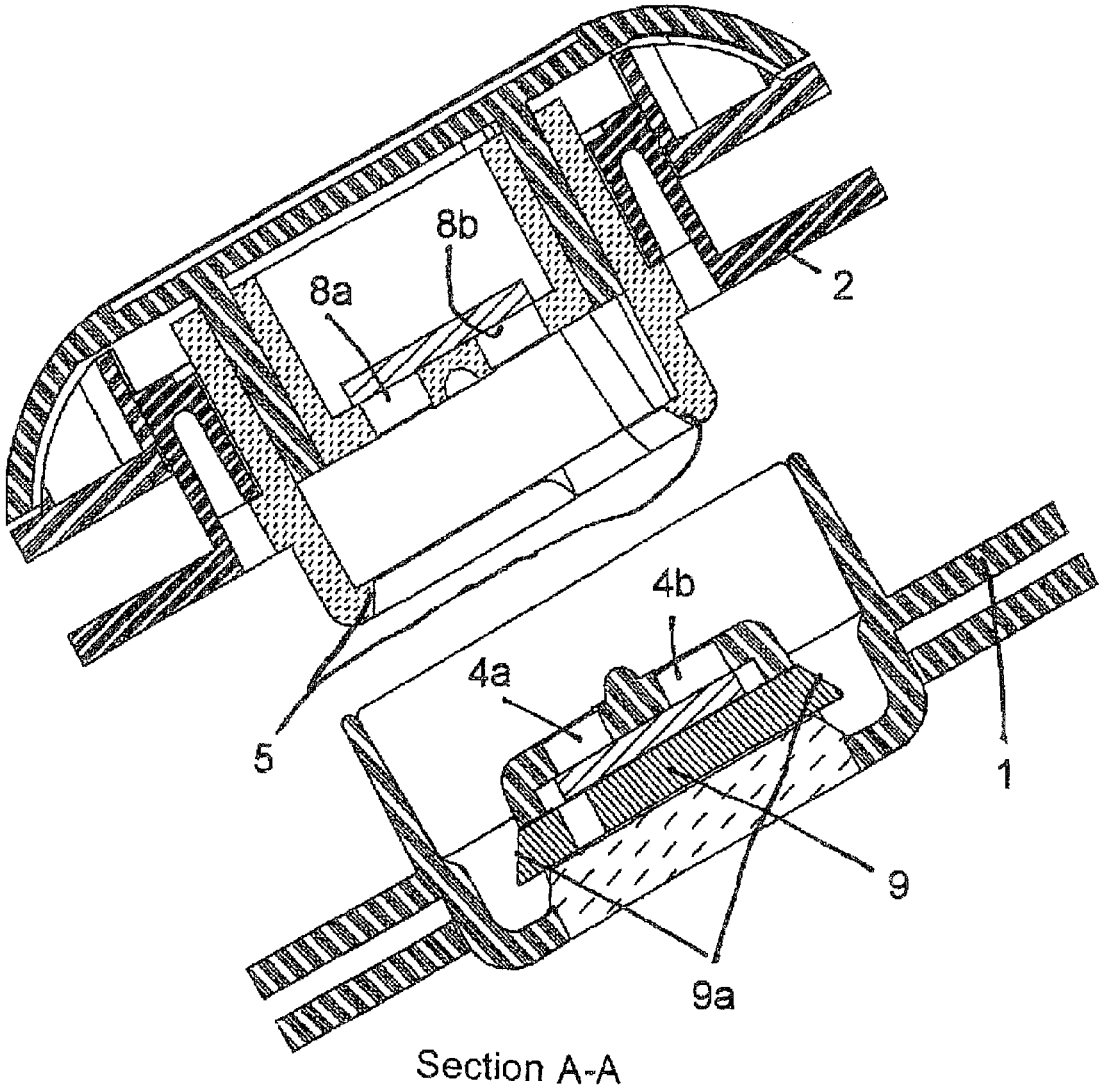
Figure 10F:
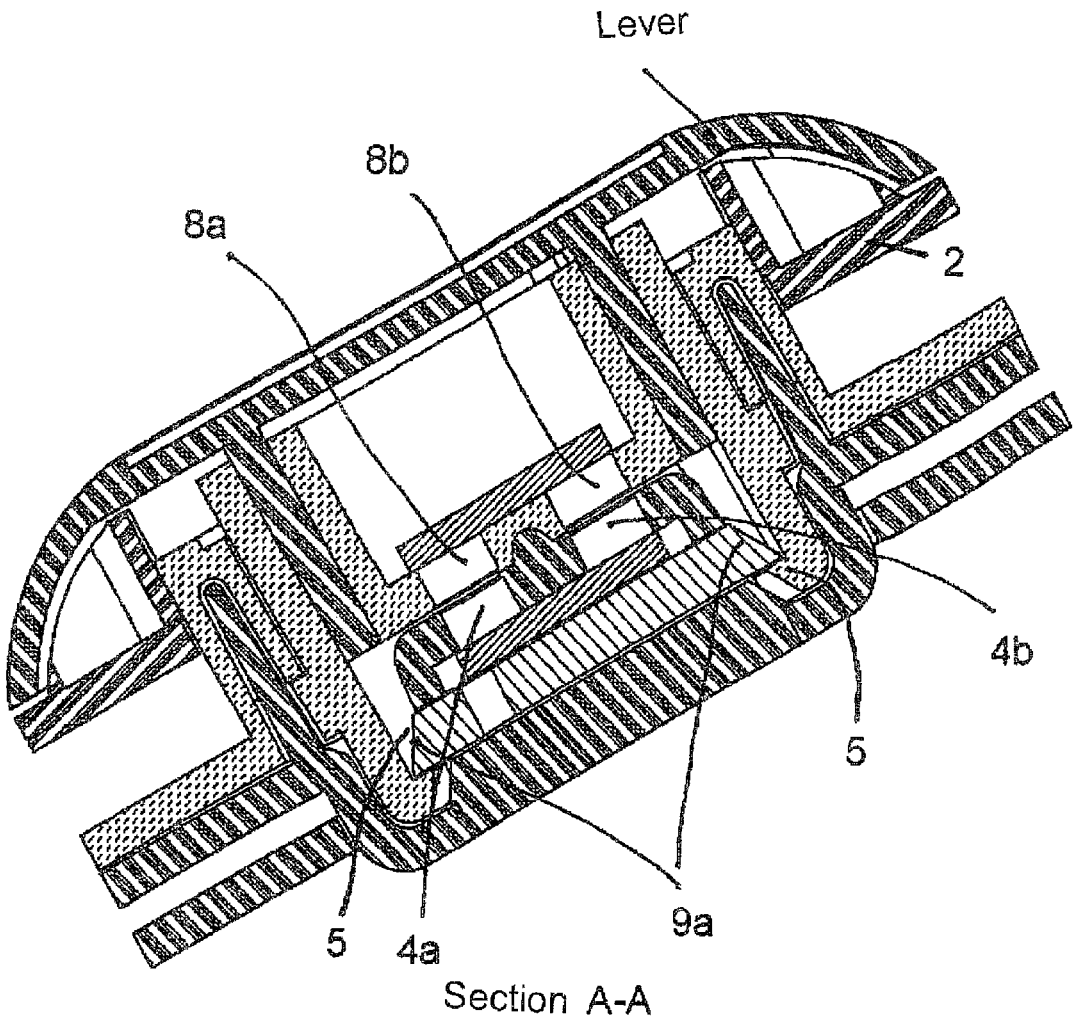
Figure 10G:
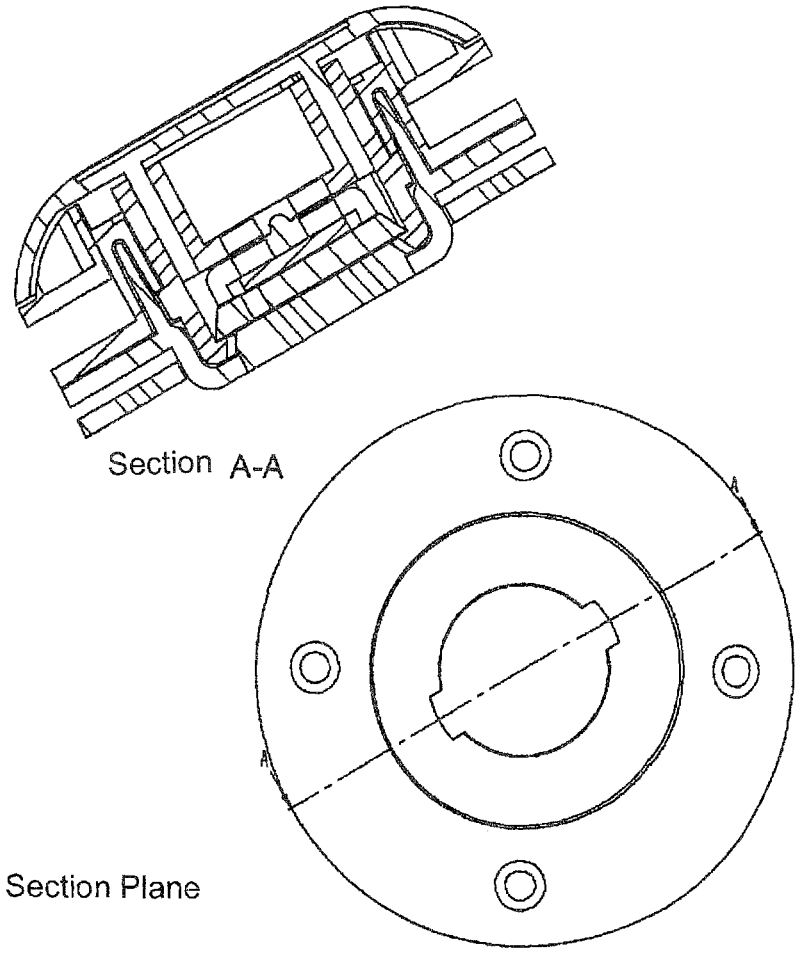
Figure 10H:
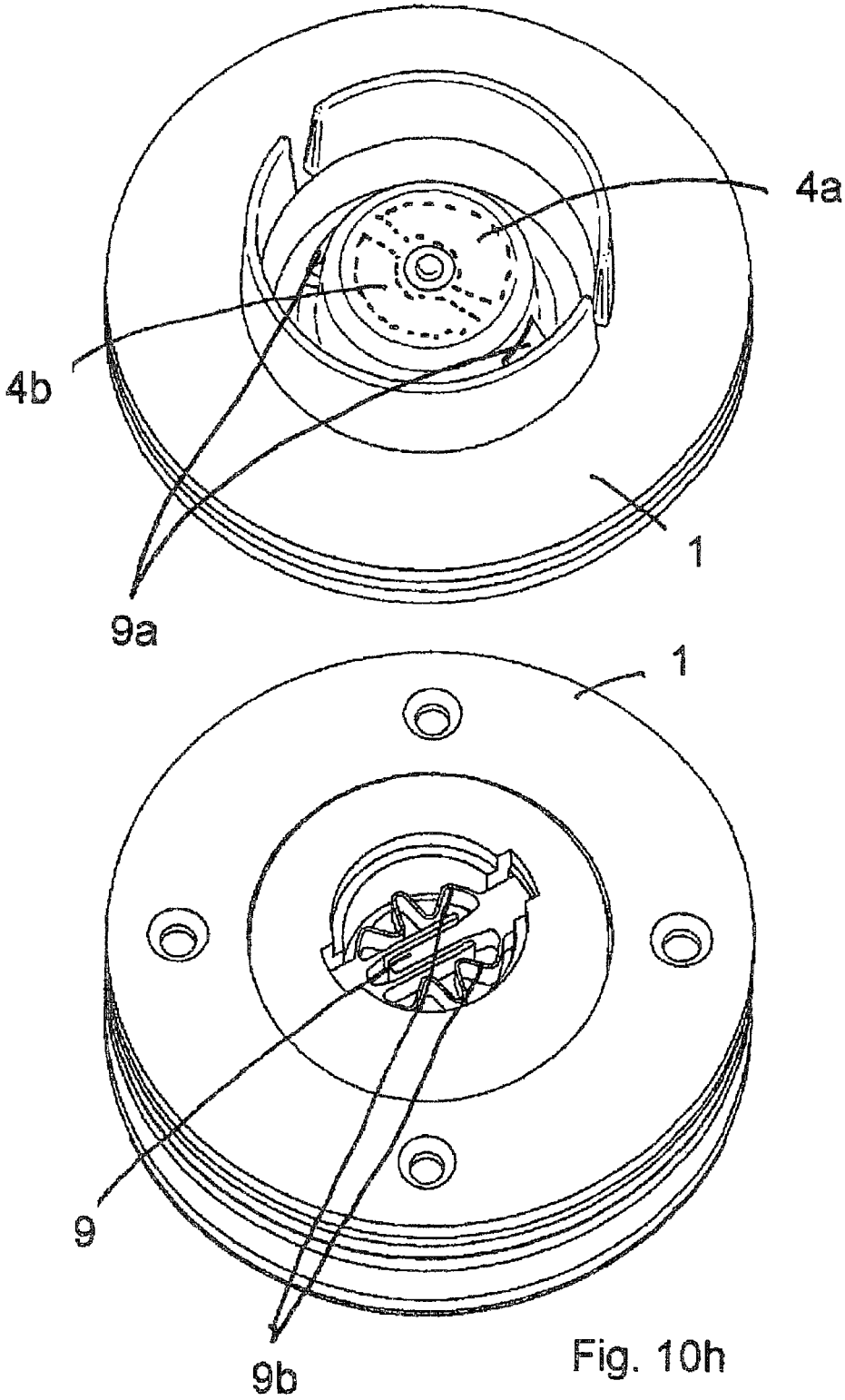
Figure 10I:
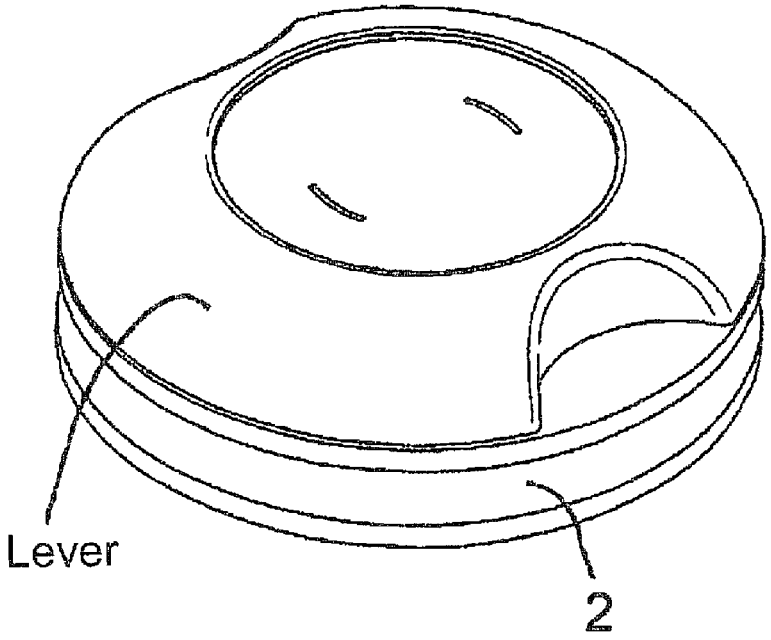
Figure 10I:
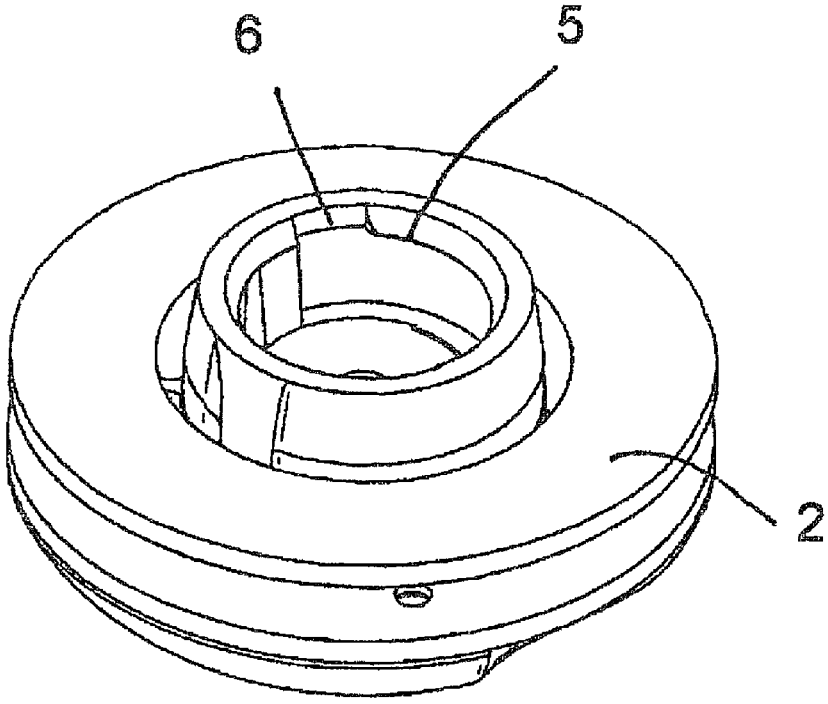

FIG. 8*a* shows the round locking piece 5 with the gap 6 and the actuating device 5*a*1. Also provided are two spring locking elements 9*a*, 9*b*. The effect of the interlock can be seen in FIG. 8*b*. The cross-section A-A-1 shows the spring locking element 9*a*, 9*b* resting against the locking piece 5. The cross-section A-A-2 shows how the magnetic force overcomes the spring force of the spring locking element, so that the magnet and armature are in close proximity and the spring locking element 9*a*, 9*b* is interlocked with the locking piece 5. Unlocking can be seen in FIG. 8*c*. The cross-section A-A shows that the spring locking element 9*a*, 9*b* is no longer interlocked with the locking piece 5, but is located in the gap 6 of the circular locking piece. The formfitting connection is thereby released. This position was obtained by pivoting the actuating device. At the same time, the magnet and the armature were rotated with respect to one another, so that the magnetic holding force was weakened. If two opposing repelling magnets are provided, the closure springs open.

FIG. 9 shows a closure designed for a school backpack with a particularly soft haptic. The mechanical construction is only in part similar to the preceding embodiment. In this embodiment, too, the magnet is rotated relative to the armature for opening. FIG. 9*a* shows the individual components in an exploded view. Unlike in the preceding embodiment, a novel spring locking element 9 is used. This spring locking element 9 is annular, wherein the ring forms the spring section 9*b*. Two opposing locking elements 9*a*1 and 9*a*2 are connected with the ring, i.e., the spring locking element 9 is formed as a single piece. The locking elements 9*a*1 and 9*a*2 each have a bevel 9*c* which is identical to the bevel 9*c* of FIG. 1. FIG. 9*b* shows in a cross-sectional view A-A-1 the two opposing closure halves in an unlocked state. As can be seen, that the locking piece 5 does not yet contact the bevel 9*c*. The closure halves are again pulled together by the magnetic force, whereby the closure piece 5 pushes the locking elements 9*a*1 and 9*a*2 apart via the bevels, so that the closure snaps together, as shown in the cross-sectional view A-A-2. This structure has the particular feature that the spring section 9*b* is a very soft spring. Accordingly, no large magnetic force is required for locking. When the closure is pulled in the direction of the arrow, the locking elements 9*a*1 and 9*a*2 are subjected only to shear forces. When the locking elements are sufficiently thick, a closure that is easy to close and can withstand large loads is produced. FIG. 9*c* shows in the cross-sectional view A-A the unlocked state, where the locking elements 9*a*1 and 9*a*2 are located in the respective gap. This position was attained by pivoting the actuating device. At the same time, the magnet and the armature where rotated relative to one another, thereby weakening the magnetic holding force. With two opposing repellent magnets, the closure springs open. FIG. 9*d* shows a modification of the annular spring locking element 9. The same soft bending characteristic of the annular spring can also be obtained with two semicircular individual springs illustrated in FIG. 9. The installation of the springs is shown in FIG. 9*e*. In comparison, FIG. 9*f* shows a single annular spring locking element and the FIG. 9*g* the installed annular spring locking element.

FIG. 10 shows a modified closure to FIG. 9, which can also used for a school backpack. FIG. 10*a* shows the individual components in an exploded view. Unlike in the preceding embodiment, a novel spring locking element is used. FIG. 10*b* show a perspective view of a first embodiment. Two locking elements of the spring locking element are connected to each other by way of two corrugated leaf springs. A fork-shaped guide is formed between the leaf springs. The end sections of the locking elements are beveled. This embodiment and the following embodiment are very bending-resistant. A similar embodiment is shown in FIG. 10*c*, whereby the spring force is greater than in the embodiment of FIG. 10*b*, provided that the same spring material is used. Another similar embodiment is shown in FIG. 10*d*, wherein a fork-shaped spring is spread apart by a wedge-shaped object. FIG. 10*e* shows a cross-section of the closure and in particular the position and arrangement of the spring locking element which is arranged at the center of the closure underneath the magnet-armature system. This allows the closure to be made smaller. When the connecting modules are moved towards one another, the edges of the annular locking piece 5 press on the beveled surfaces of the locking members 9*a* of the spring locking element 9 and compress it, so that the locking piece is interlocked with the locking members, as shown in FIG. 10*f*. The locking piece is rotated with the rotary knob, so that the two gaps in the locking piece are located opposite the locking members, thereby releasing the interlock. FIG. 10*g* shows a cross-sectional view of the closure and the position of the cutting plane. FIG. 10*h* shows perspective views of the connecting module in which the spring locking element is arranged, with a top view and a view from below, wherein in the view from below the spring locking element with two corrugated springs is visible. FIG. 10*i* shows two perspective views of the connecting module in which the rotatable locking piece with the gaps 6 is arranged.

Figure 11A:
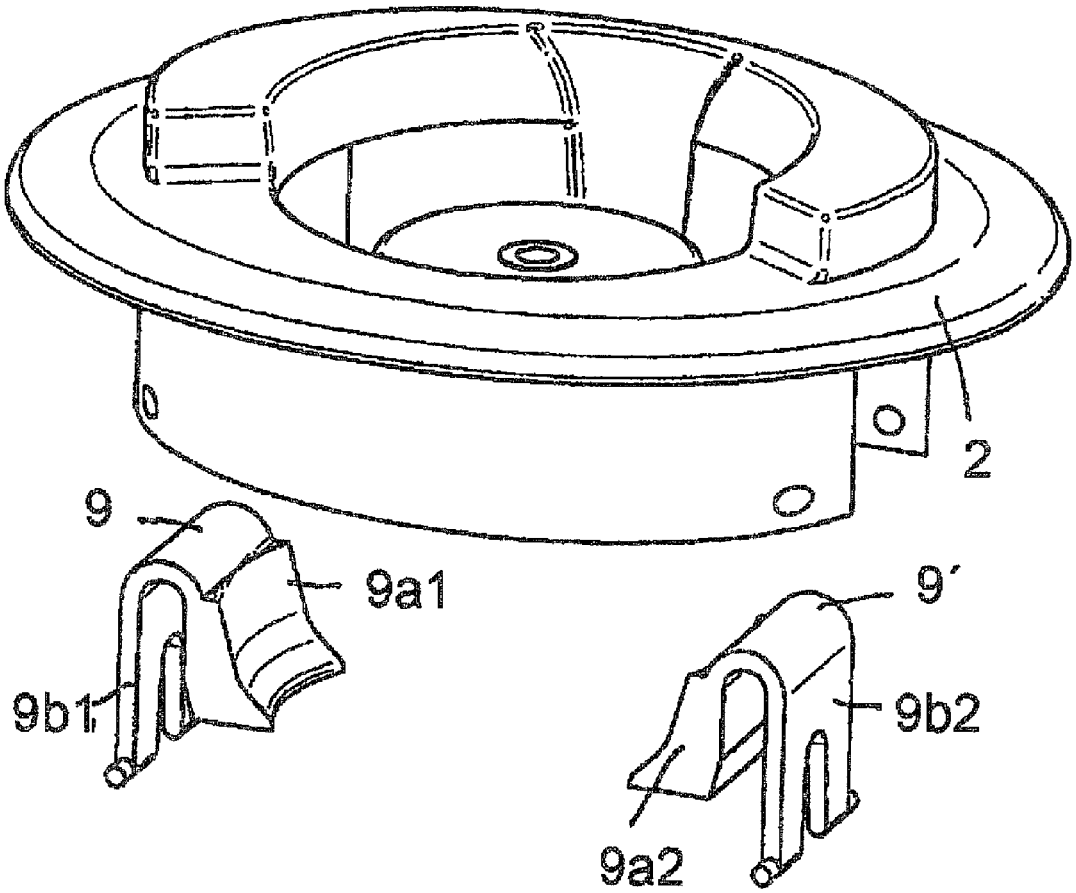
FIG. 11 shows the invention in another special exemplary embodiment.
Figure 11B:
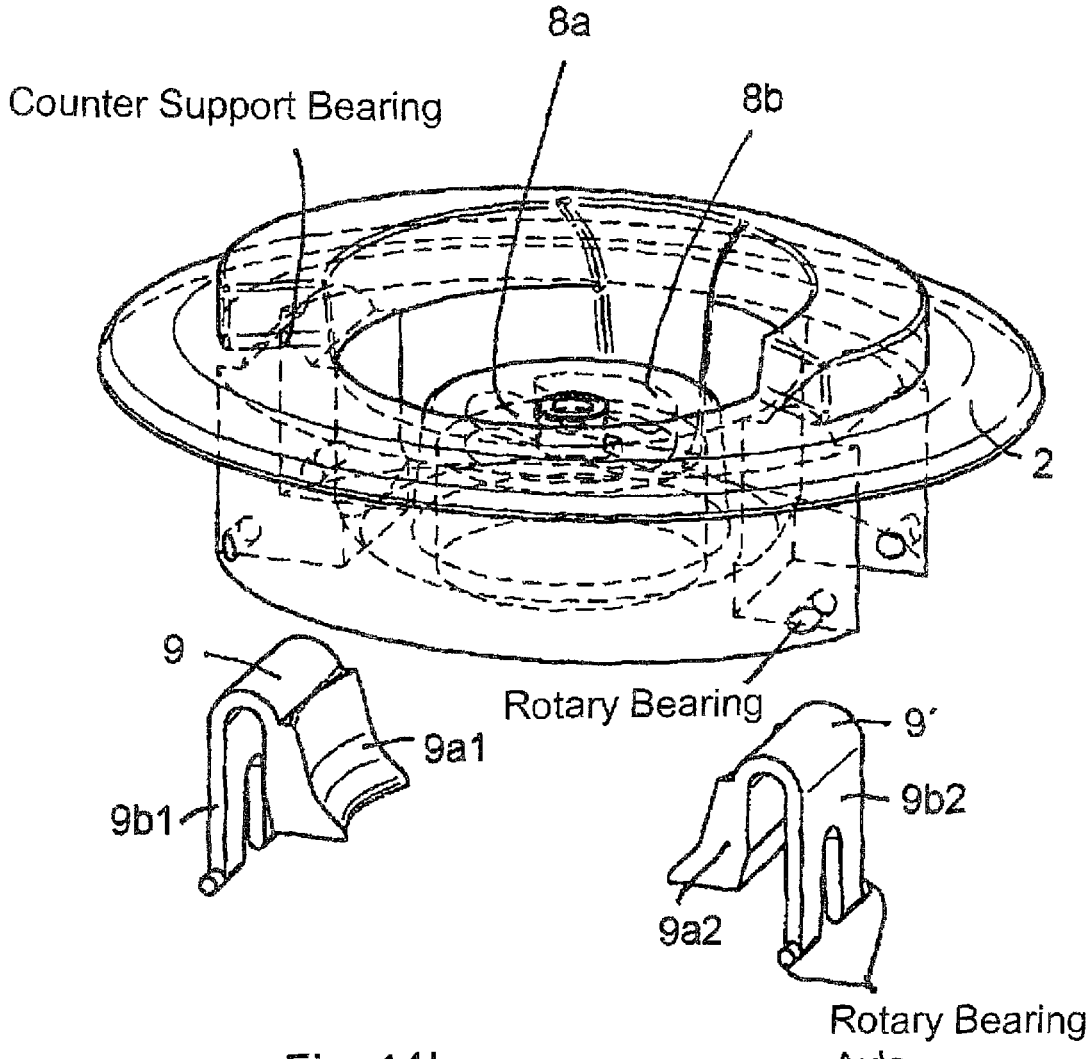
Figure 11C:
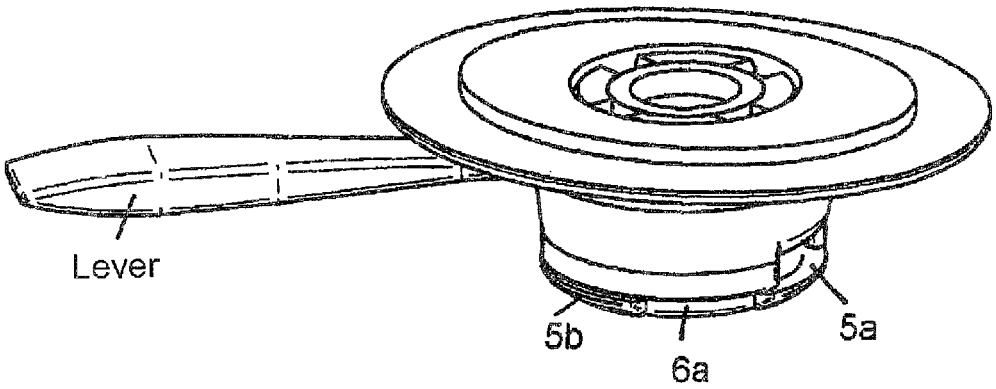
Figure 11C:
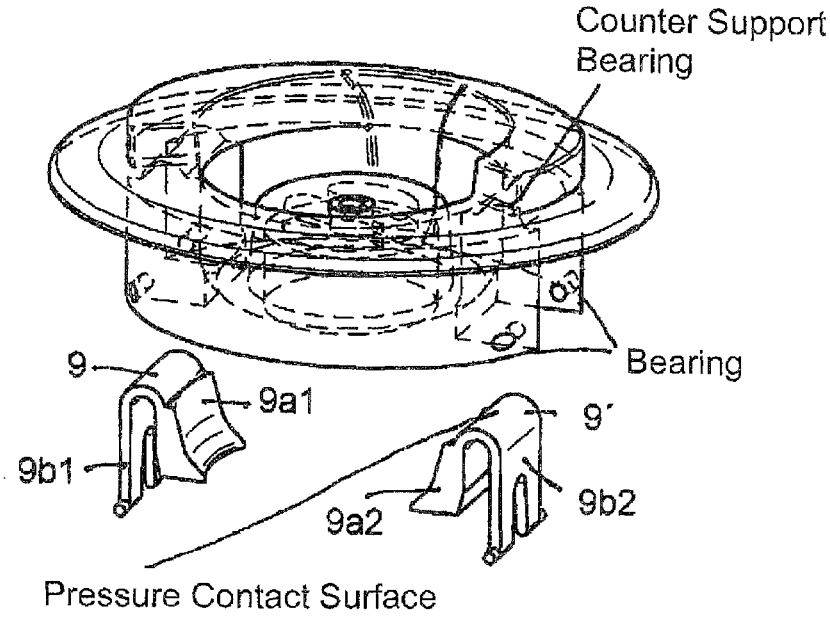
Figure 11D:
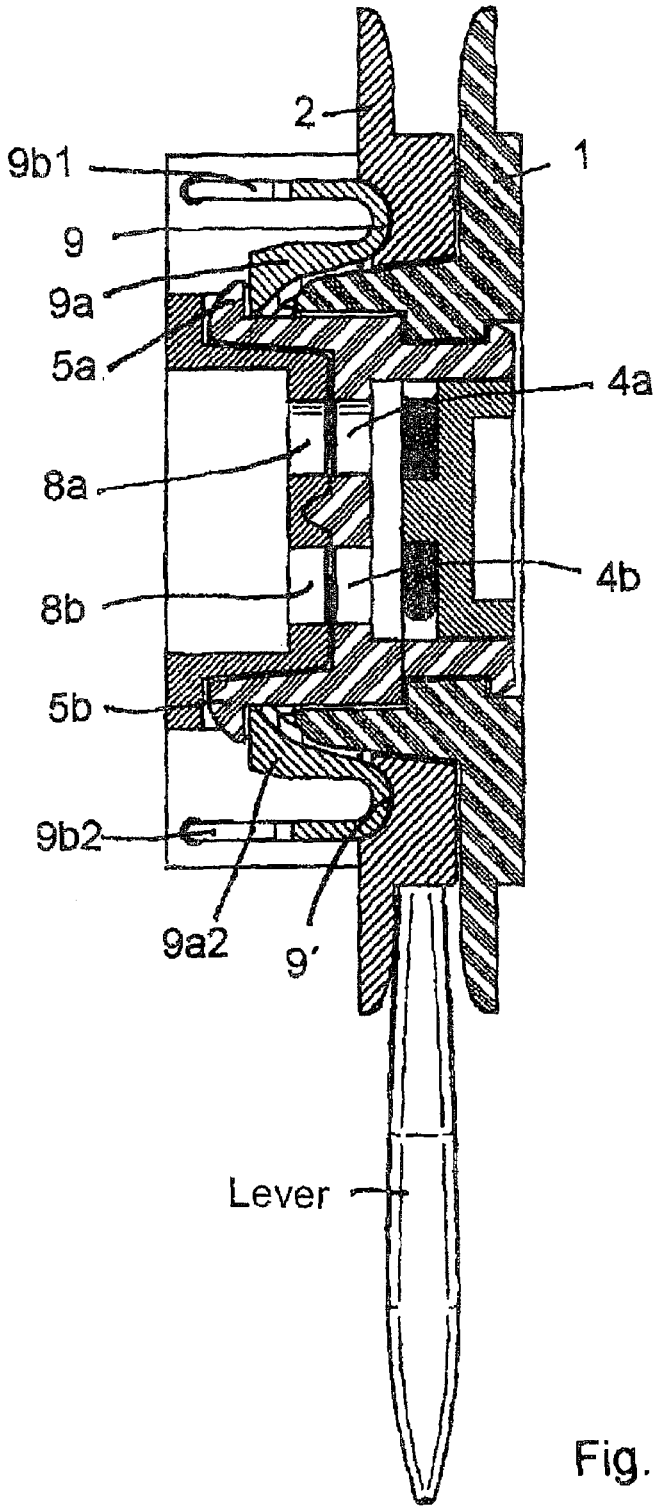
Figure 12A:
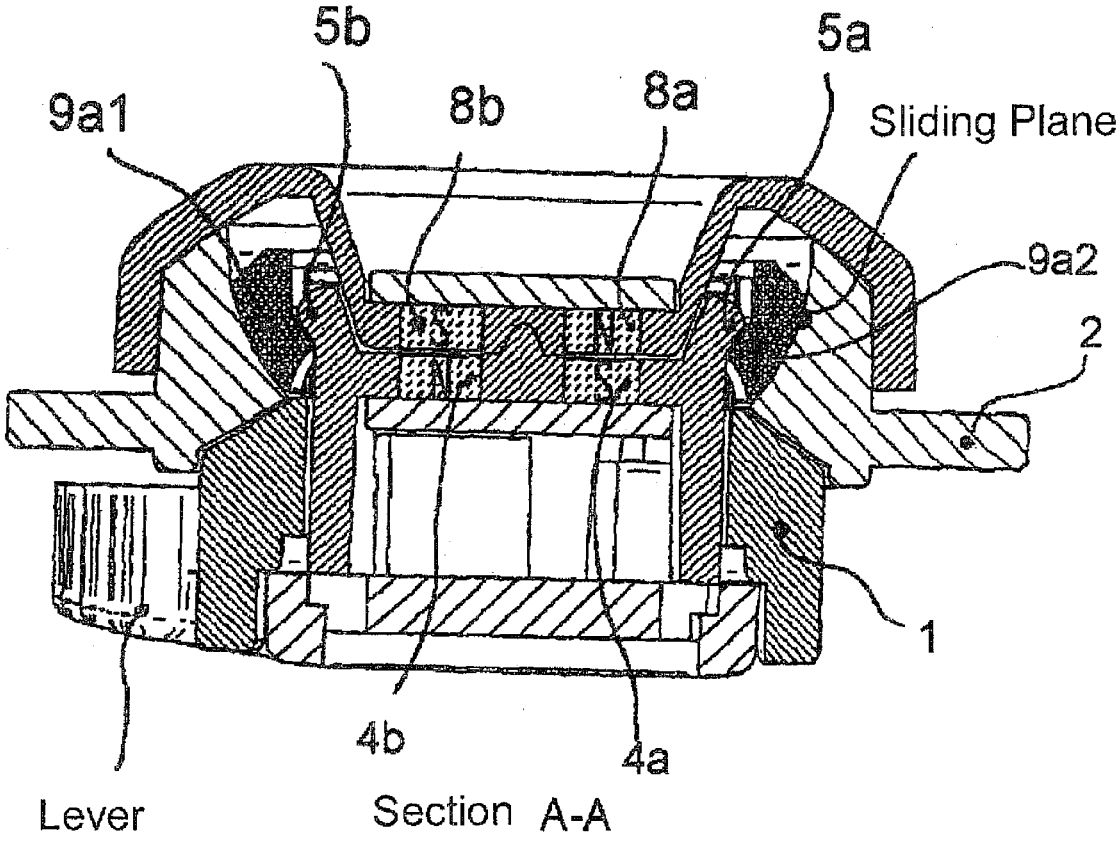
FIG. 12 shows the invention in another special exemplary embodiment.
Figure 12B:
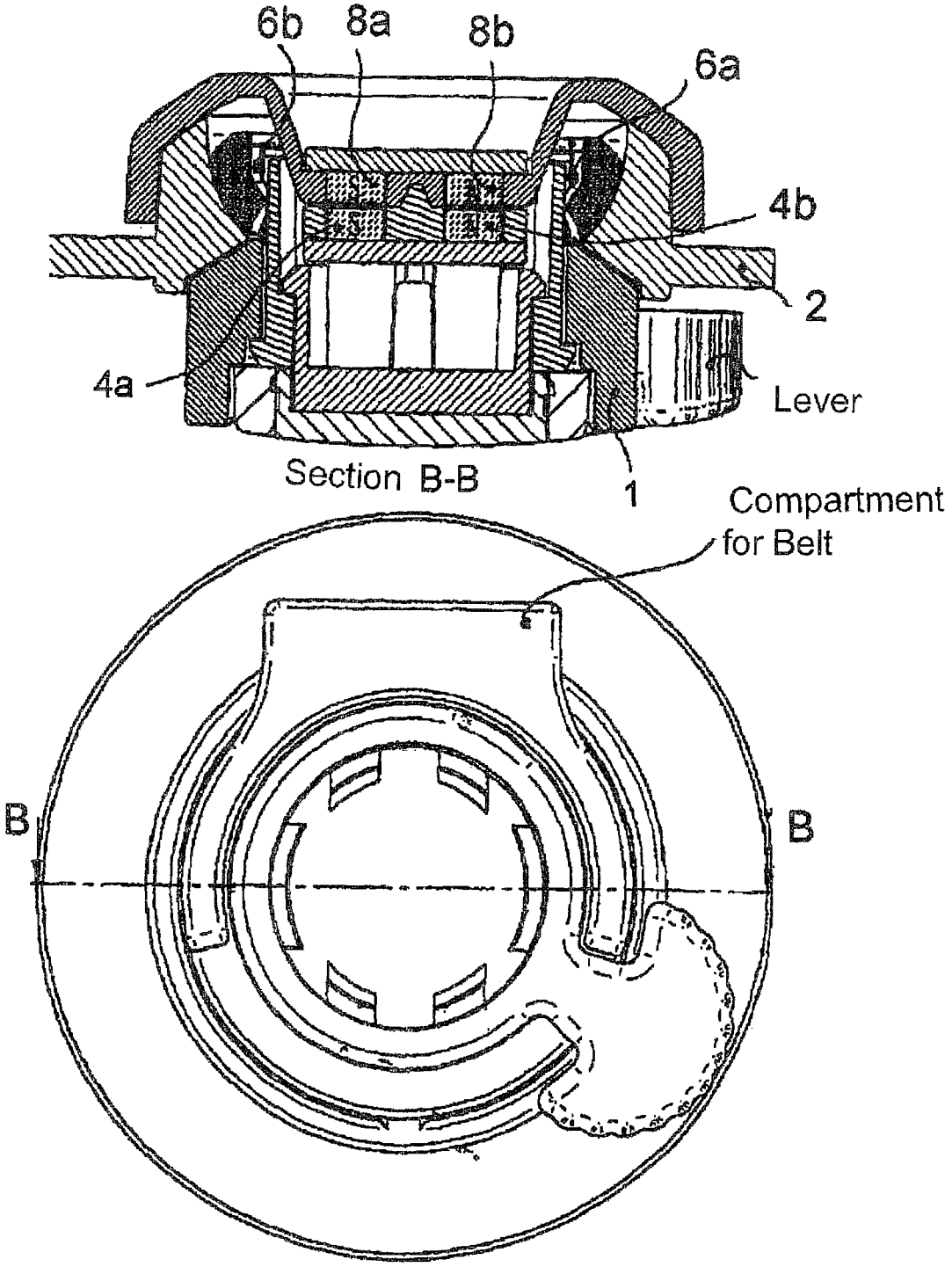
Figure 12C:
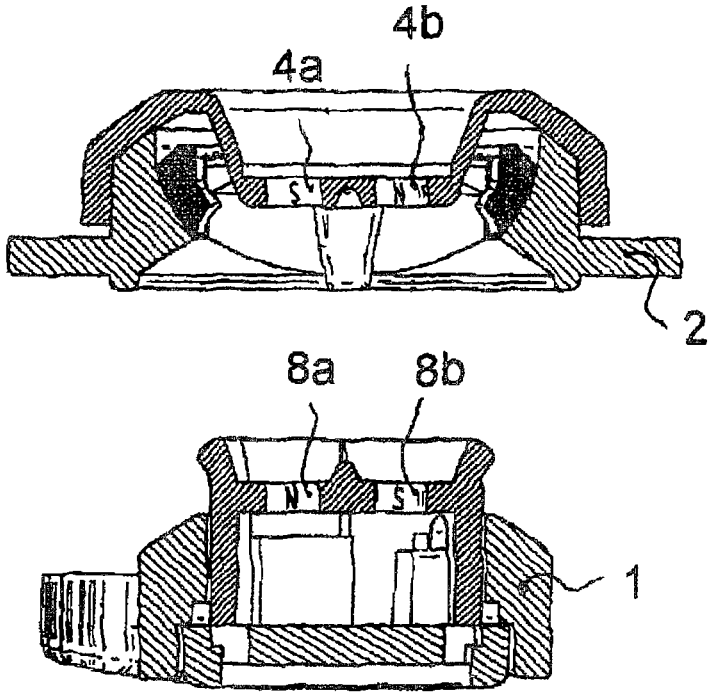
Figure 12C:
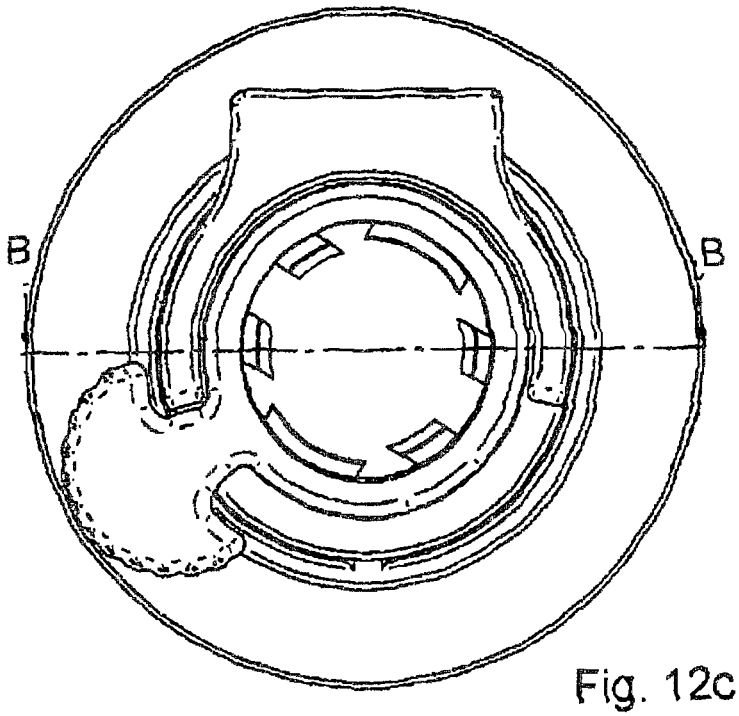
Figure 12D:
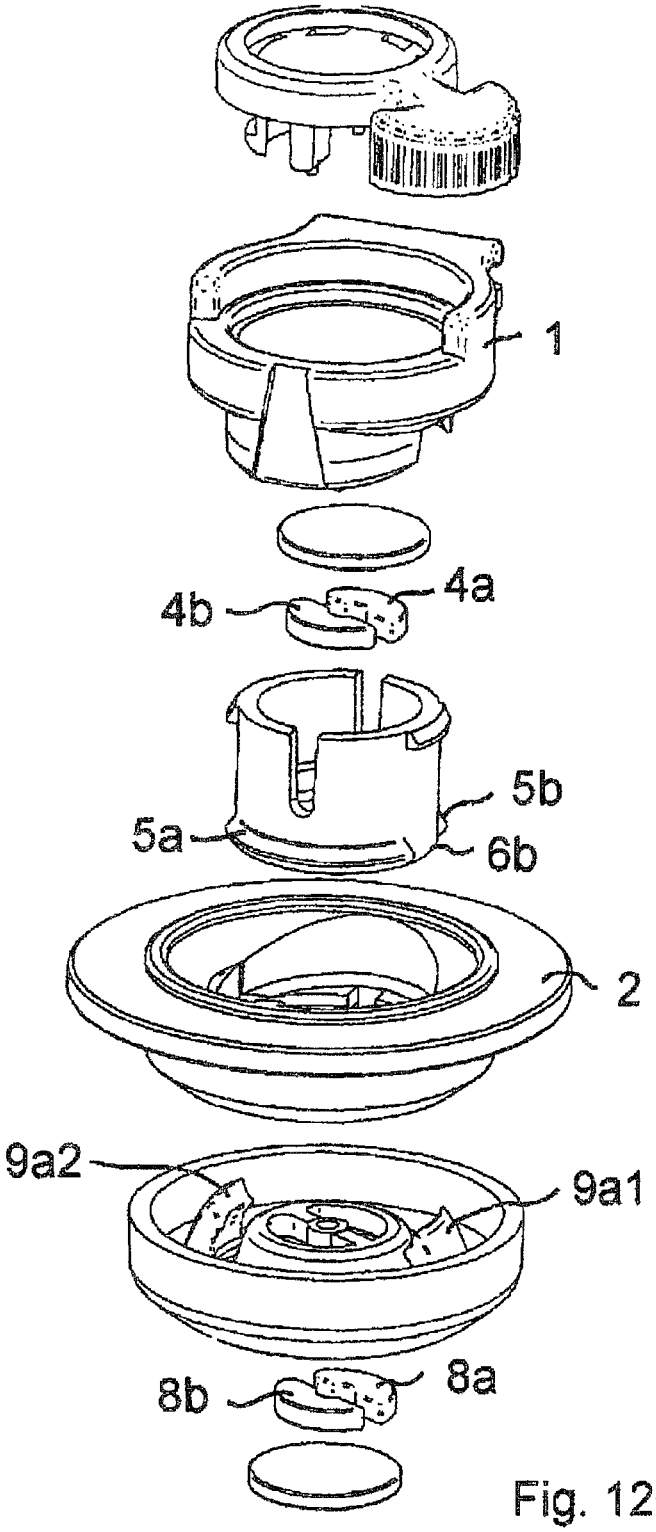
Figure 12E:
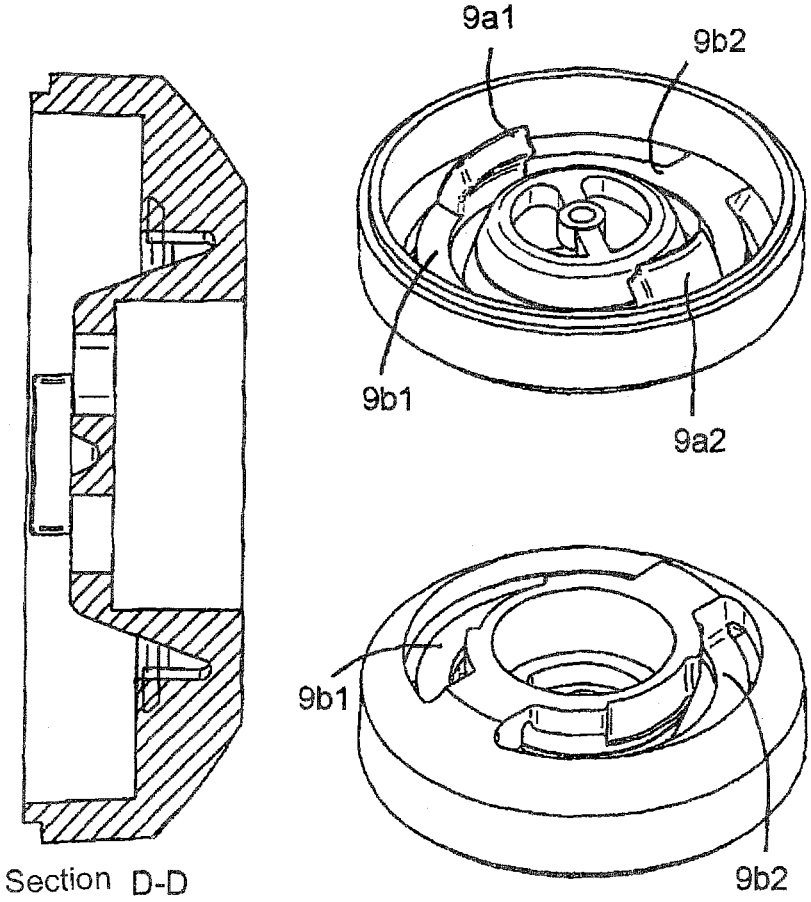
Figure 13A:
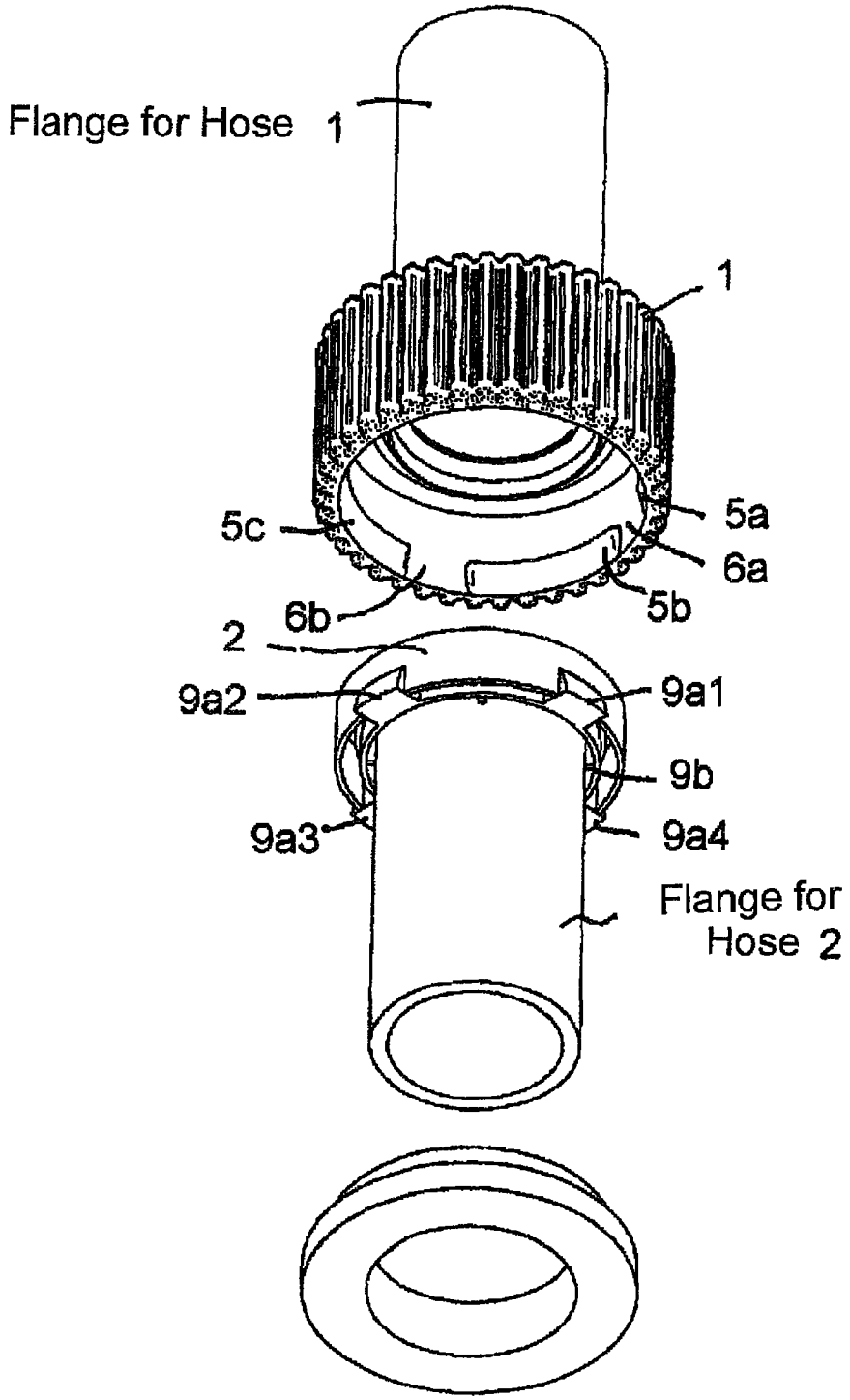
FIG. 13 shows the invention in another special exemplary embodiment.
Figure 13B:
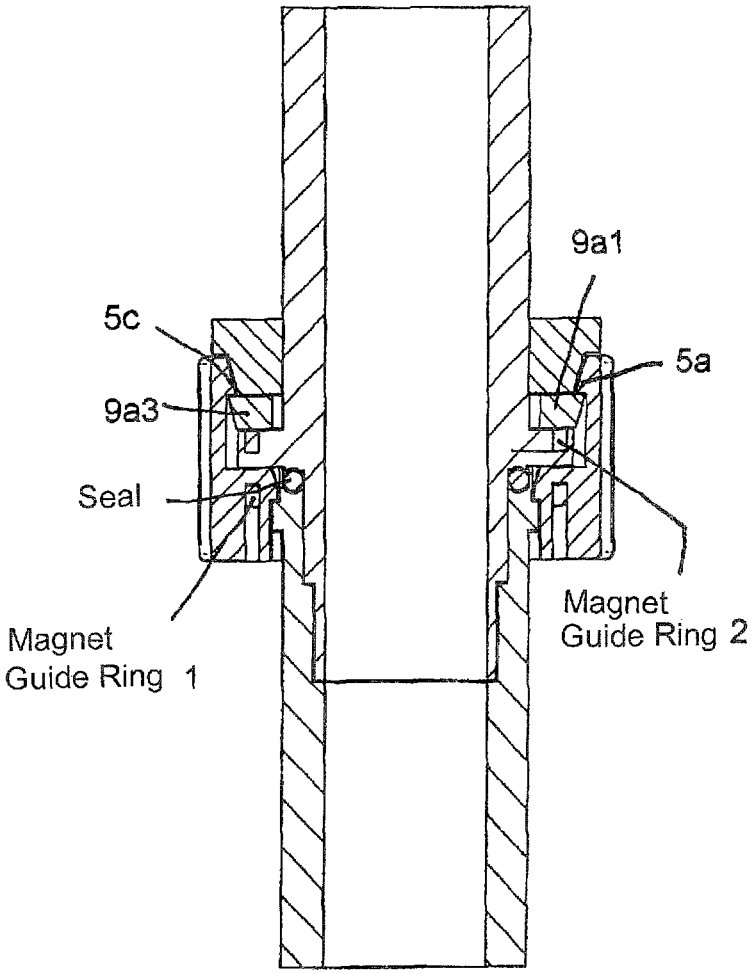
Figure 13B:
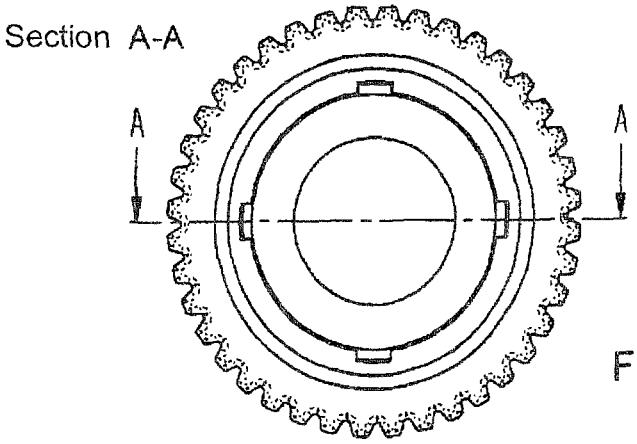
Figure 13D:
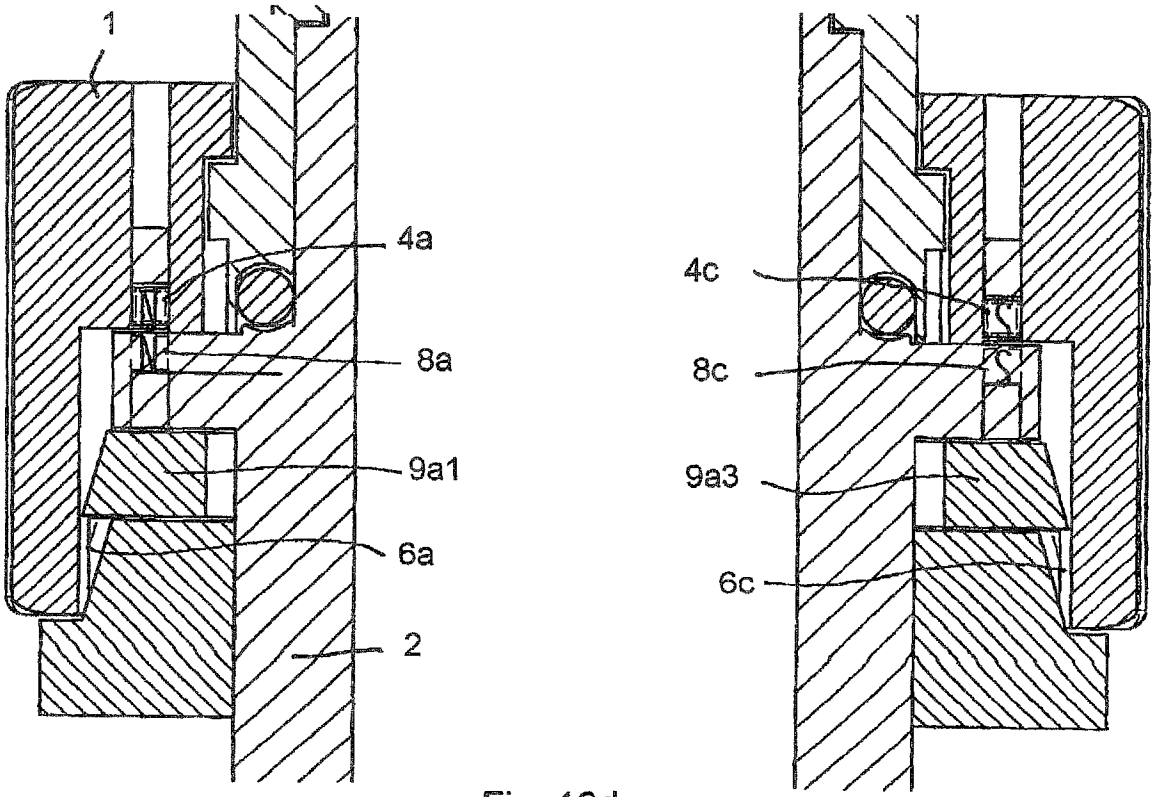
Figure 13E:
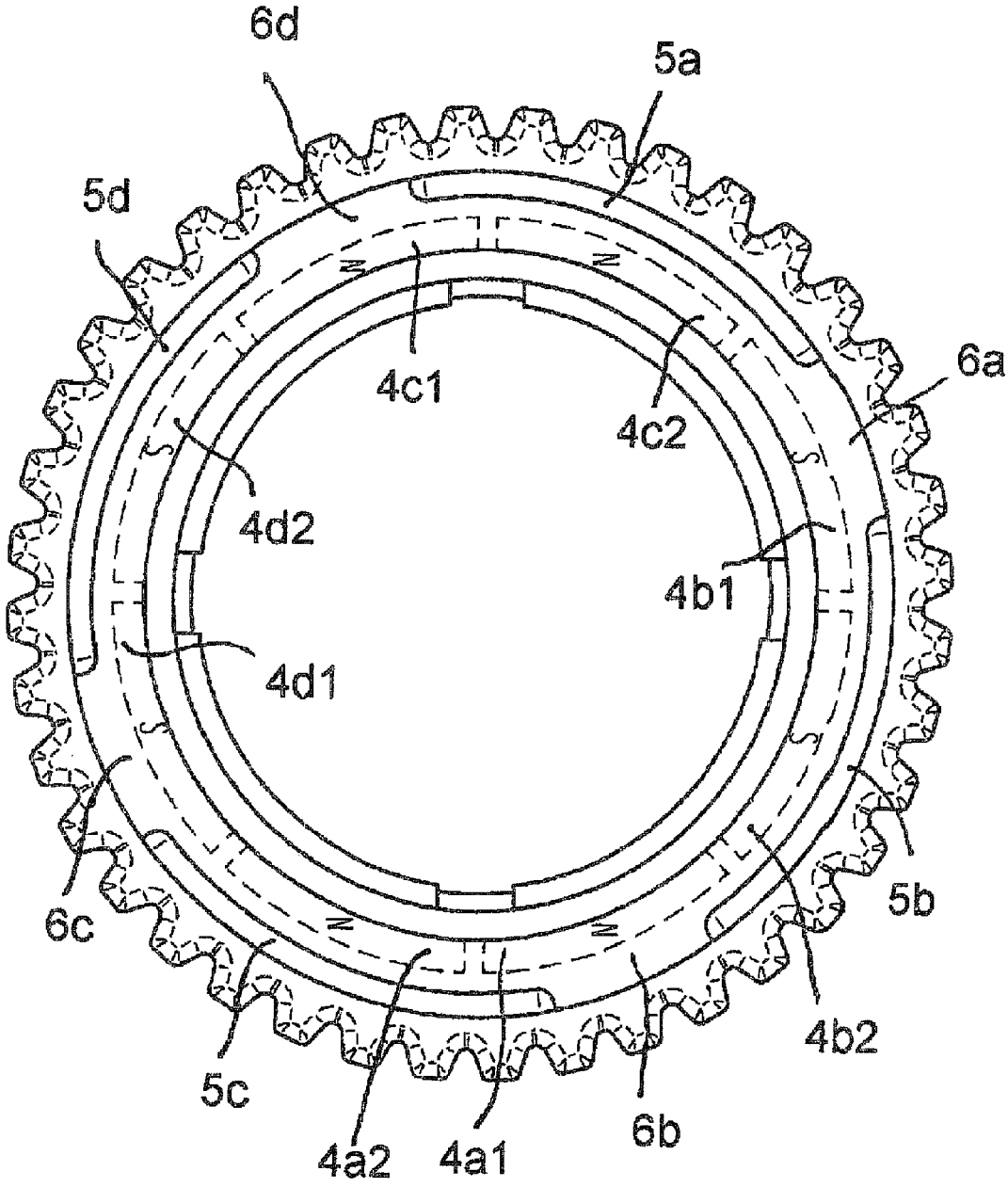
Figure 13F:
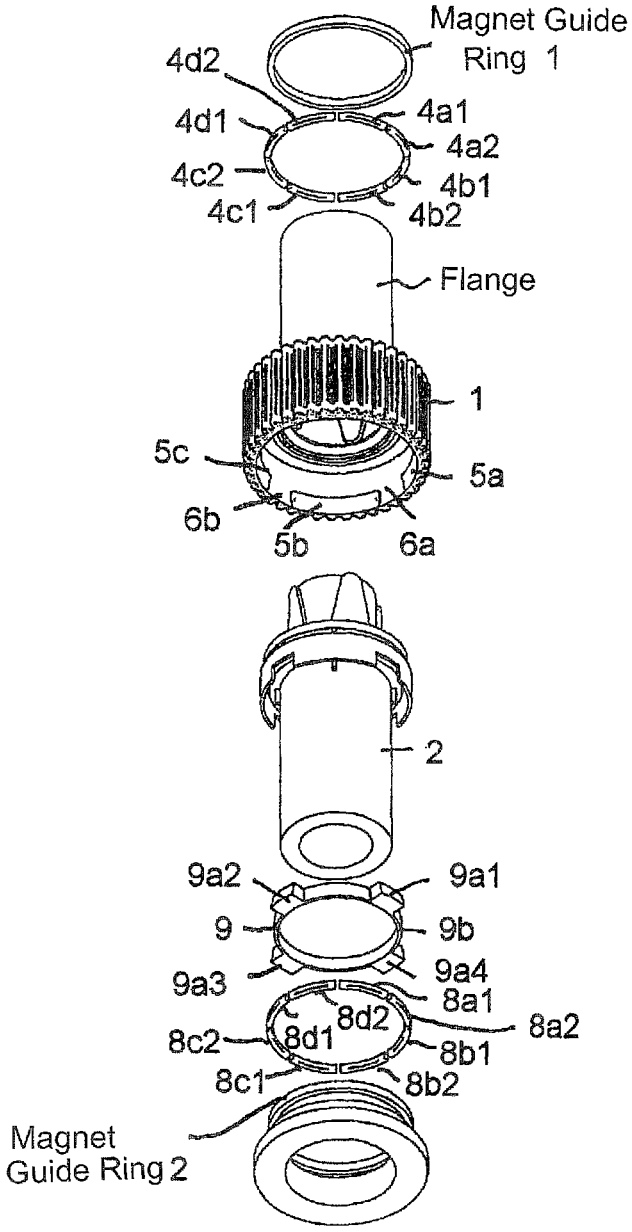
Figure 13G:
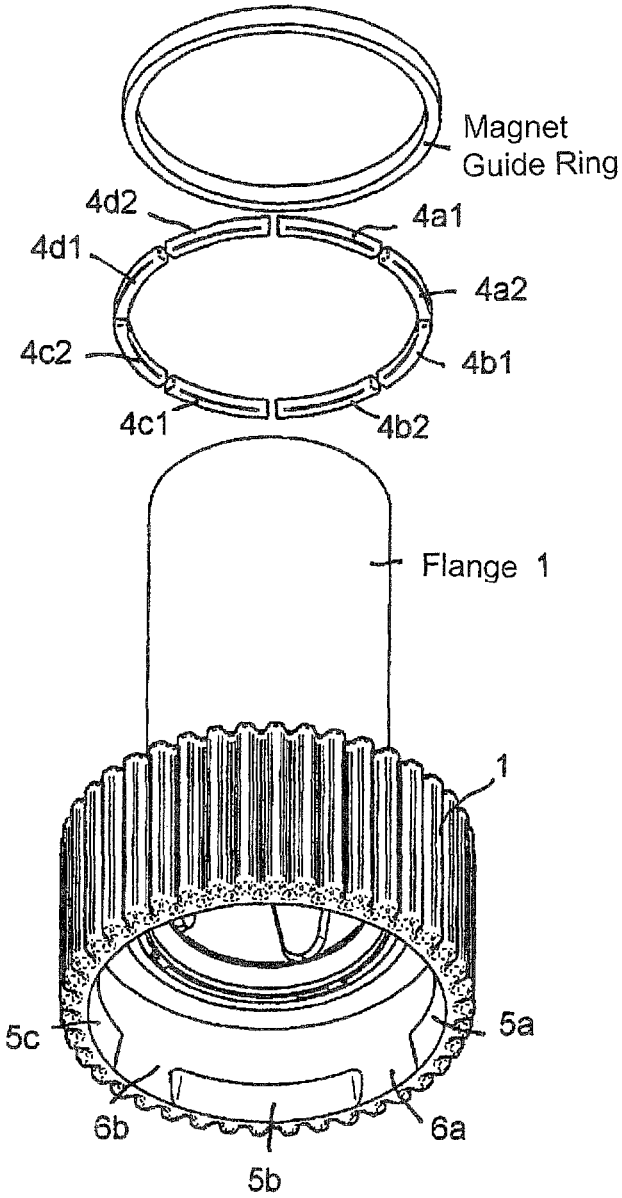
Figure 13H:
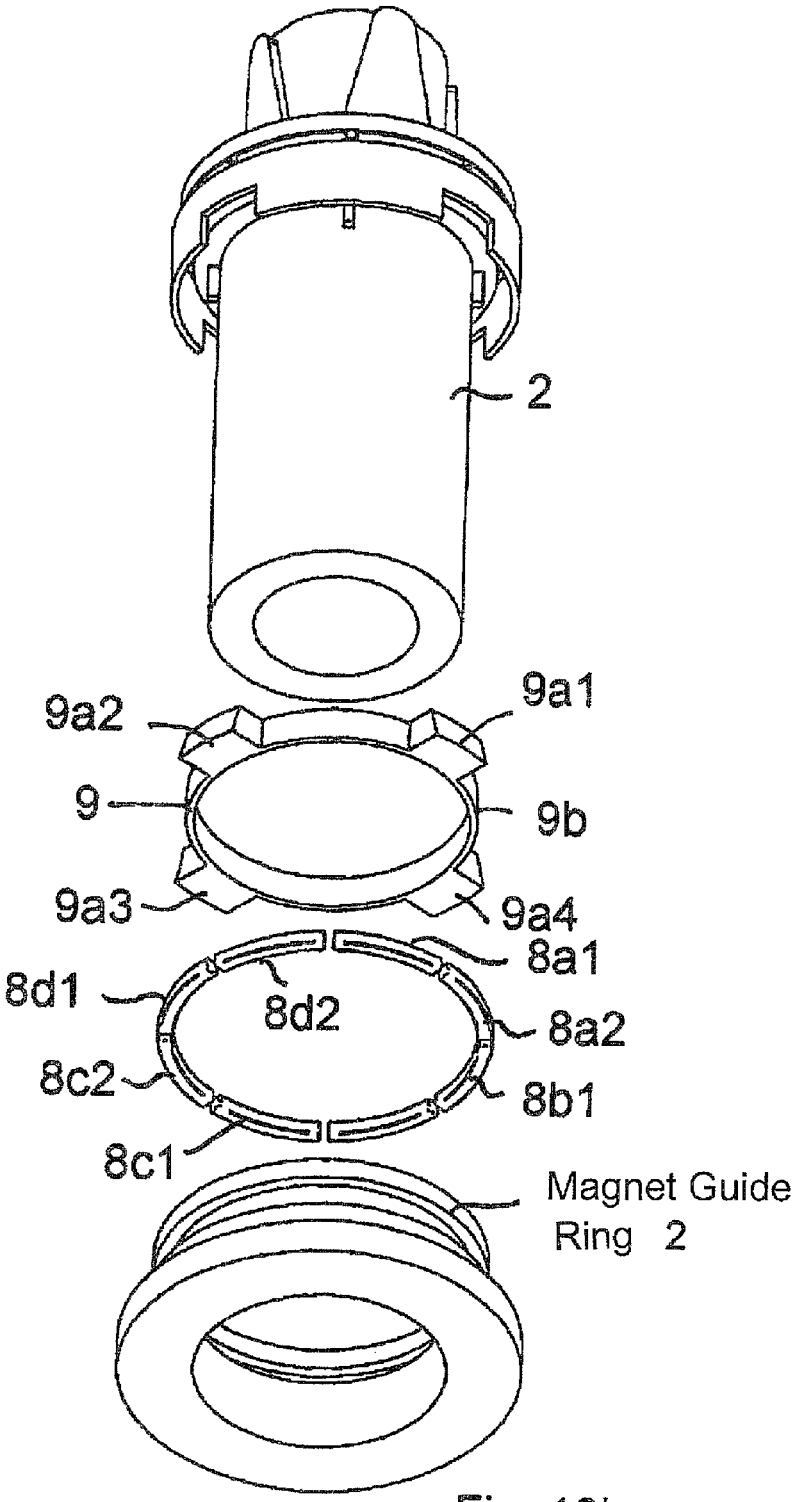

FIG. 11 shows another embodiment of the invention where the spring locking elements 9 are implemented as separate spring jaws, which are movably supported in the connecting module, as shown in FIGS. 11*a* to 11*c*. FIG. 11*d* shows the installed configuration. The locking elements are particularly stable when under compression.

FIG. 12 shows a clamping closure configured for attaching ice picks, canes and the like to backpacks or bags or for other closure applications in connection with a belt, and the like, sewn on the backpack and attached in a compartment on the connecting module 1. The clamping closure has similar to FIG. 7 a clamping, self strengthening form-fit; however, the magnet-armature structure is displaced by rotation. FIG. 12*a* shows the closed state, where the beaded locking pieces 5*a*, 5*b* are in formfitting engagement with the locking member 9. The structure and operation are illustrated in FIGS. 12*b* to 12*e*.

FIG. 13 shows a hose coupling which advantageously contracts and seals automatically due to the magnetic force. The basic structure is illustrated in FIGS. 13*a* to 13*h*.

Figure 14A:
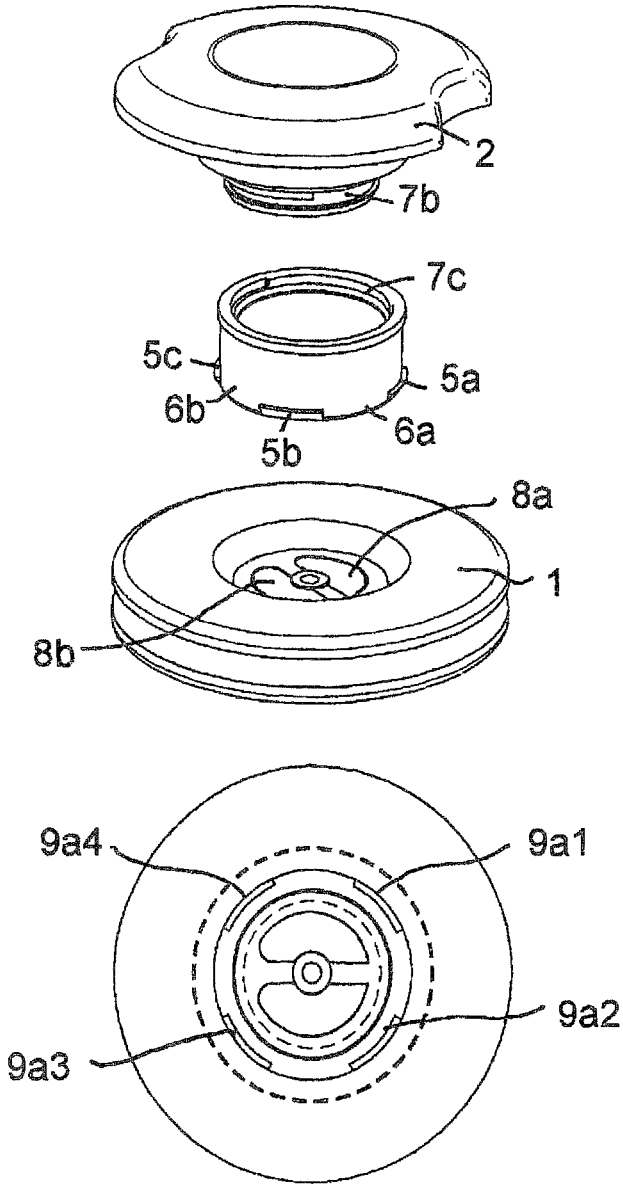
FIG. 14 shows the invention in another special exemplary embodiment.
Figure 14B:
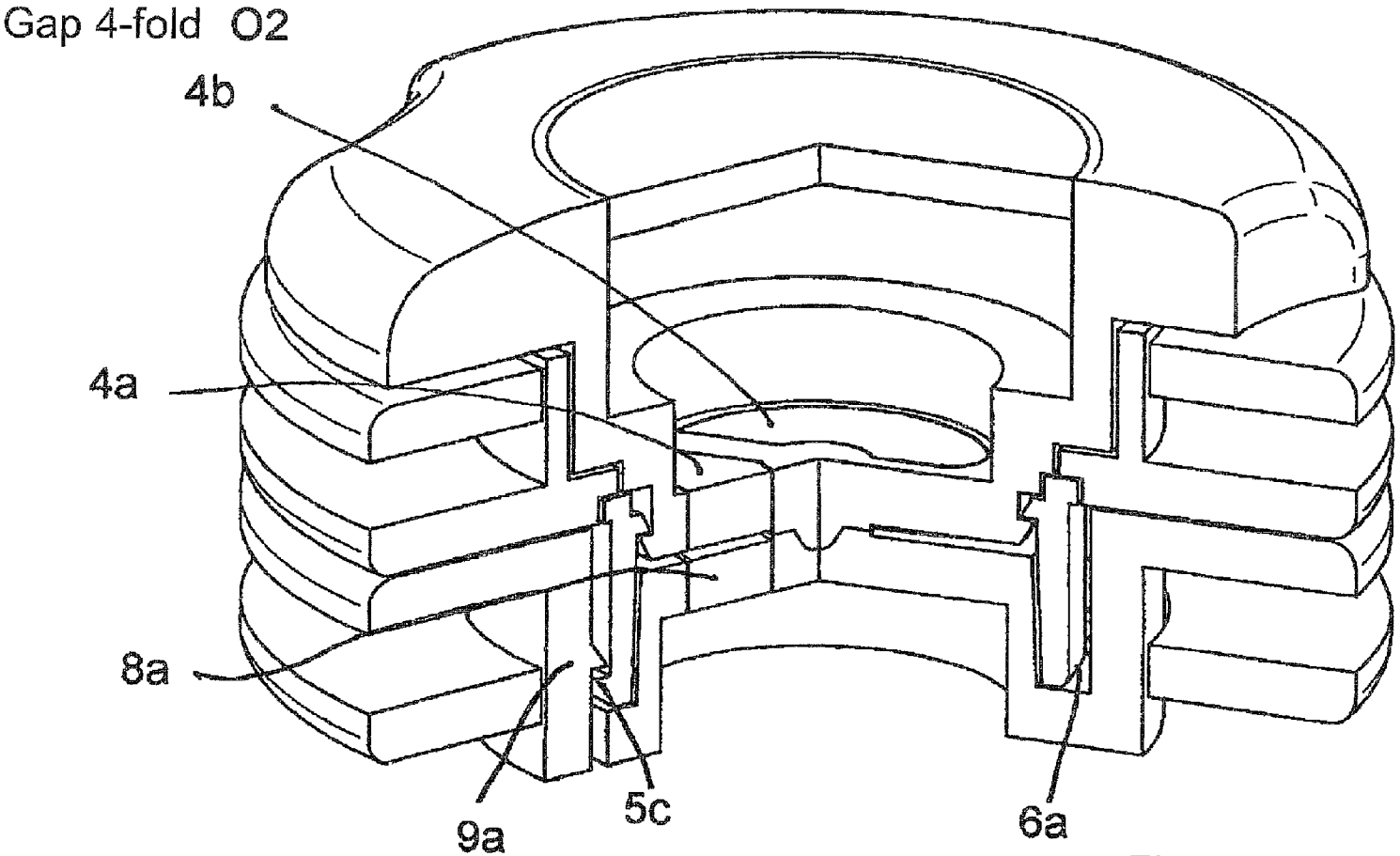
Figure 14C:
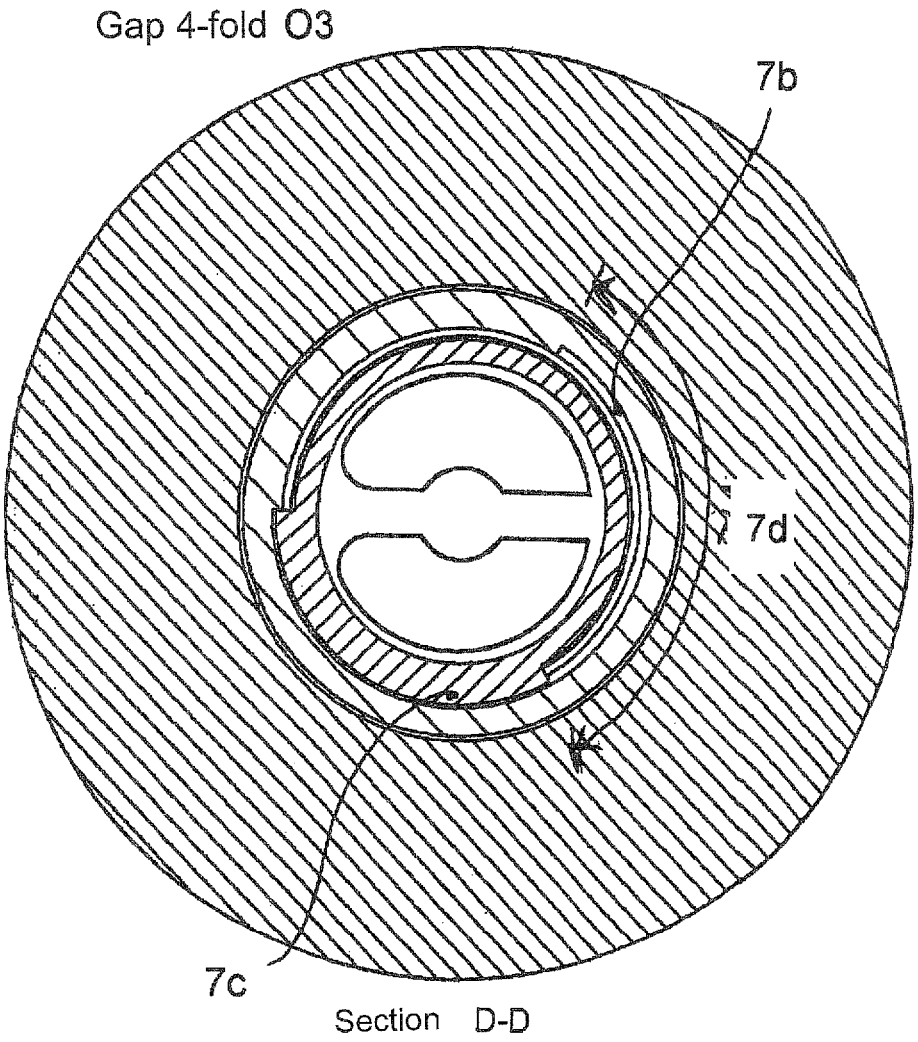
Figure 15A:
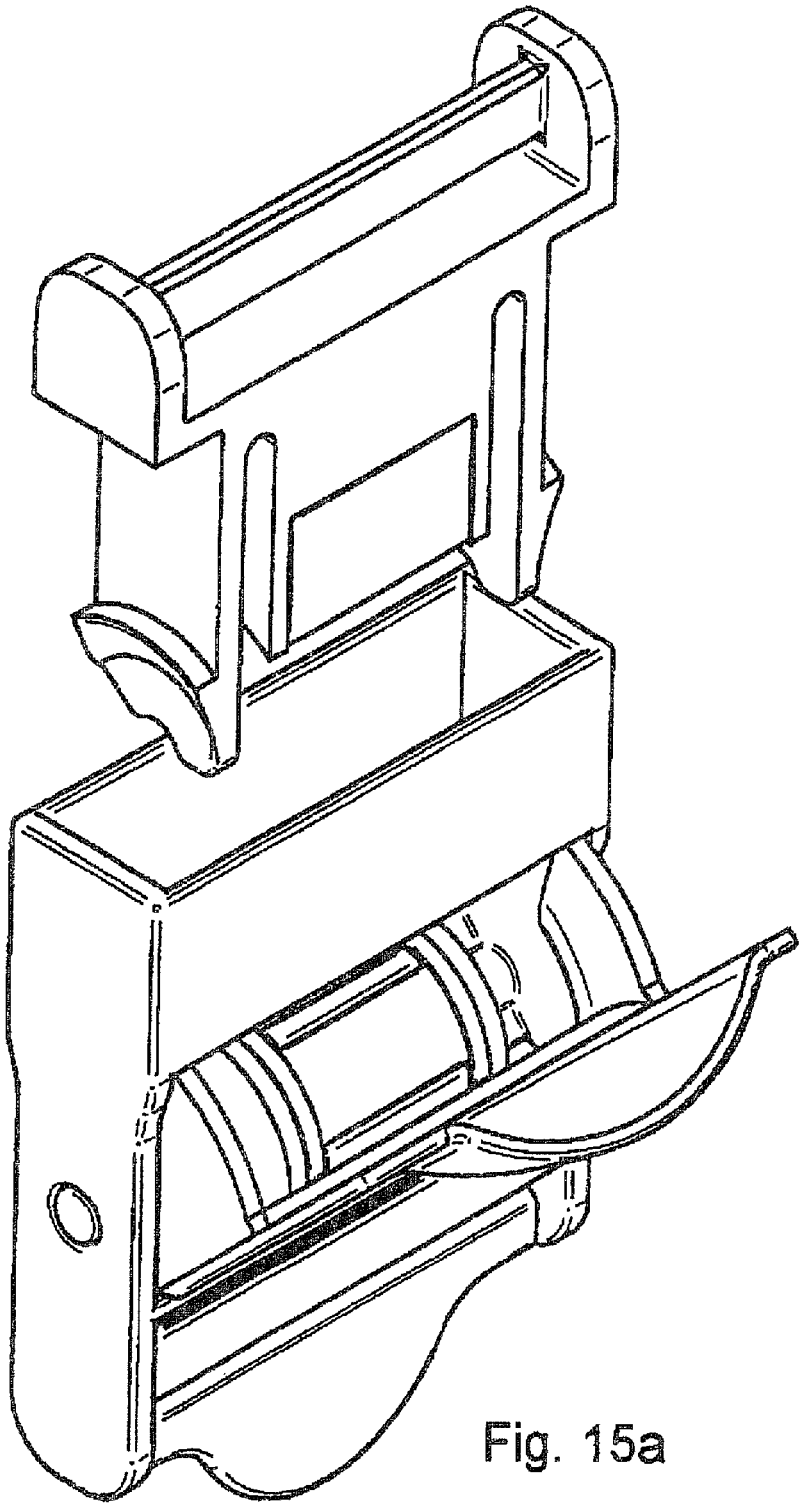
FIG. 15 shows the invention in another special exemplary embodiment.
Figure 15B:
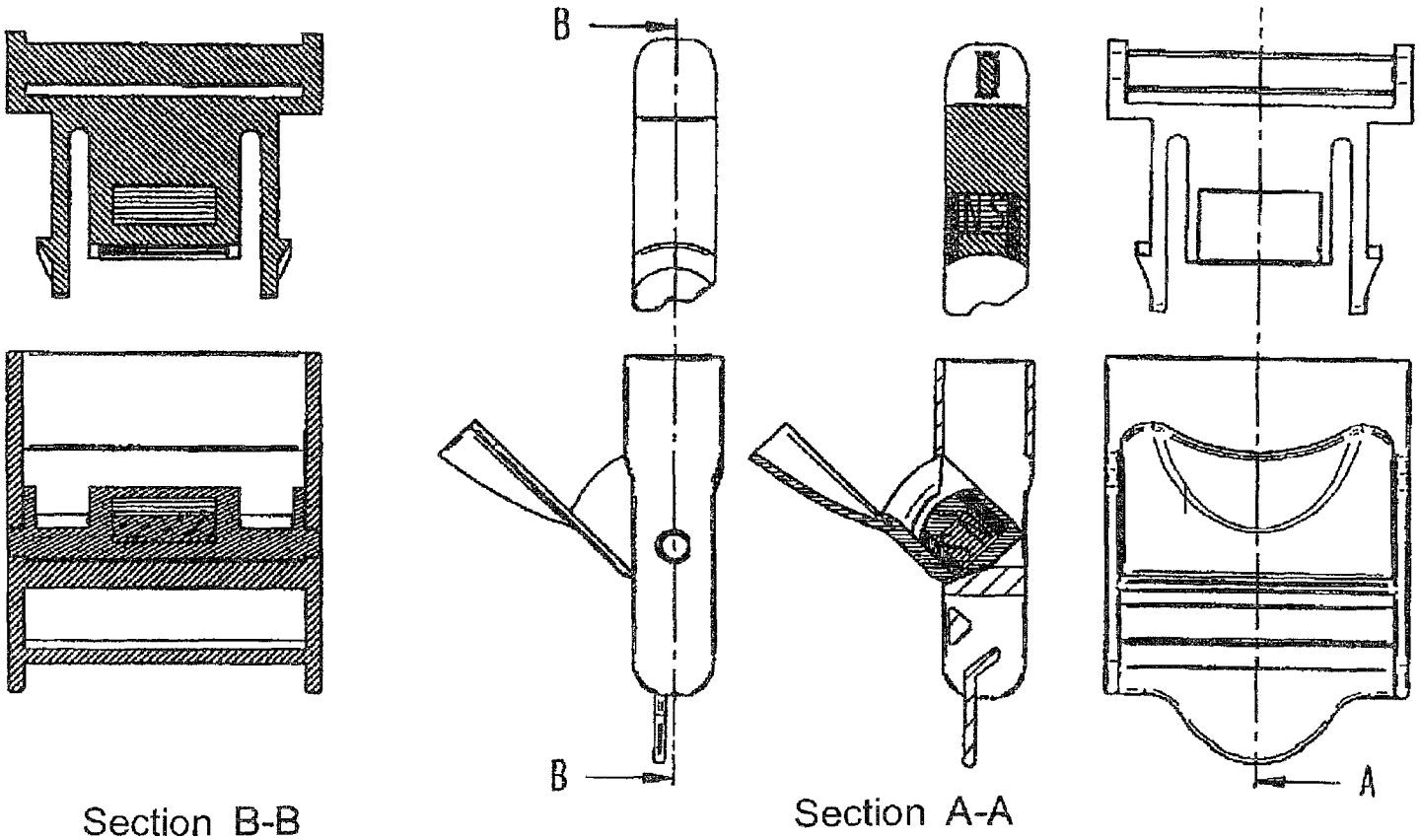
Figure 15C:
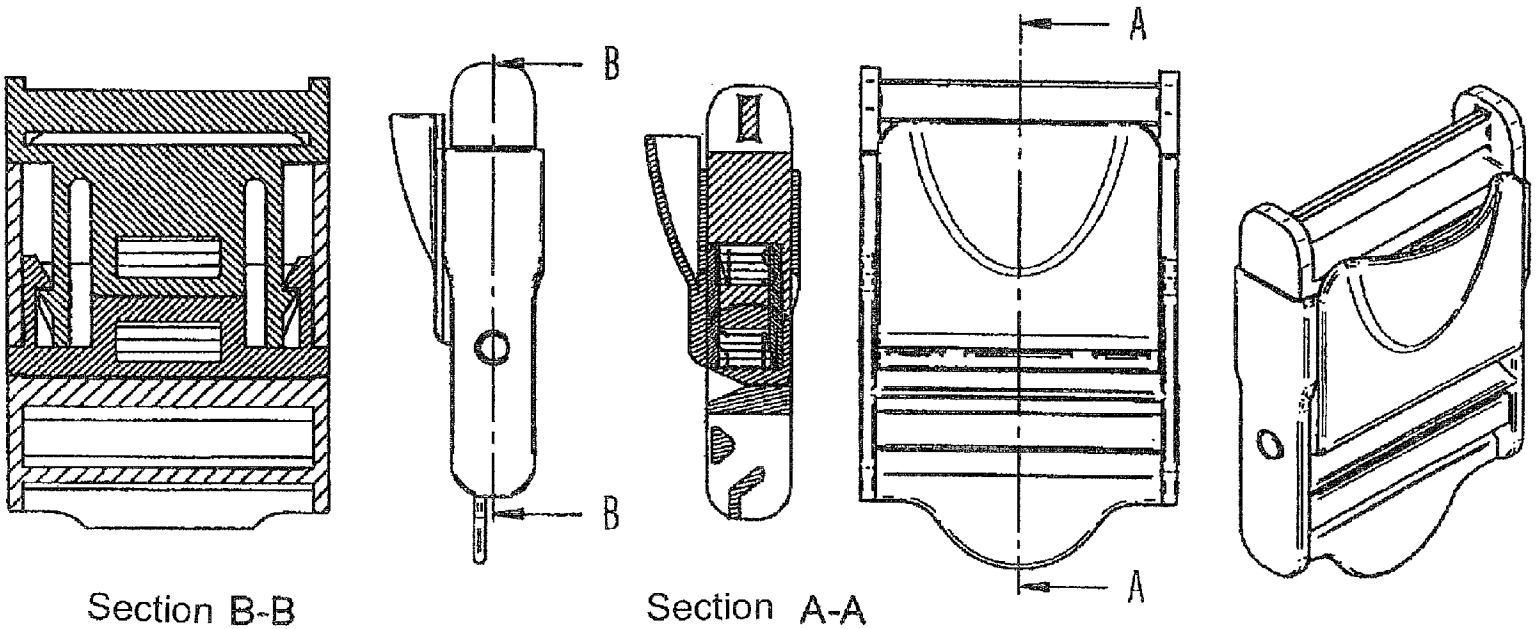
Figure 15D:
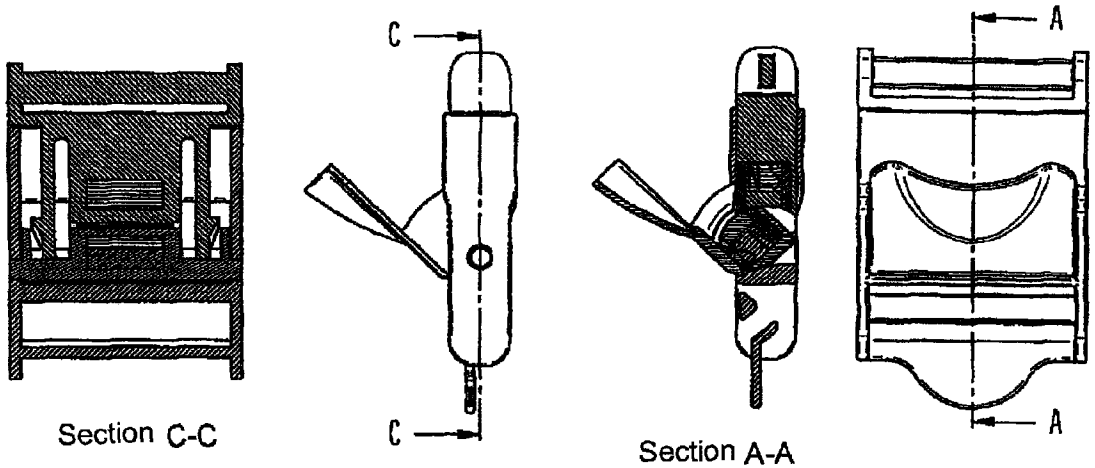
Figure 16A:
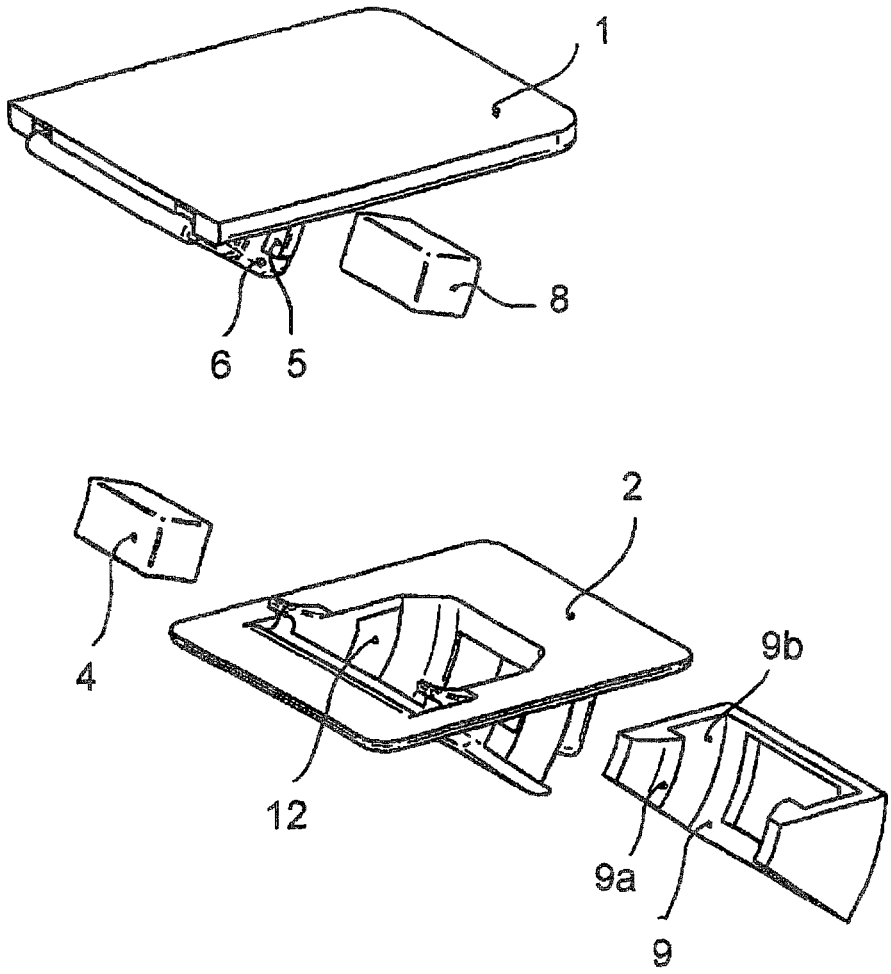
FIG. 16 shows the invention in another special exemplary embodiment.
Figure 16B:
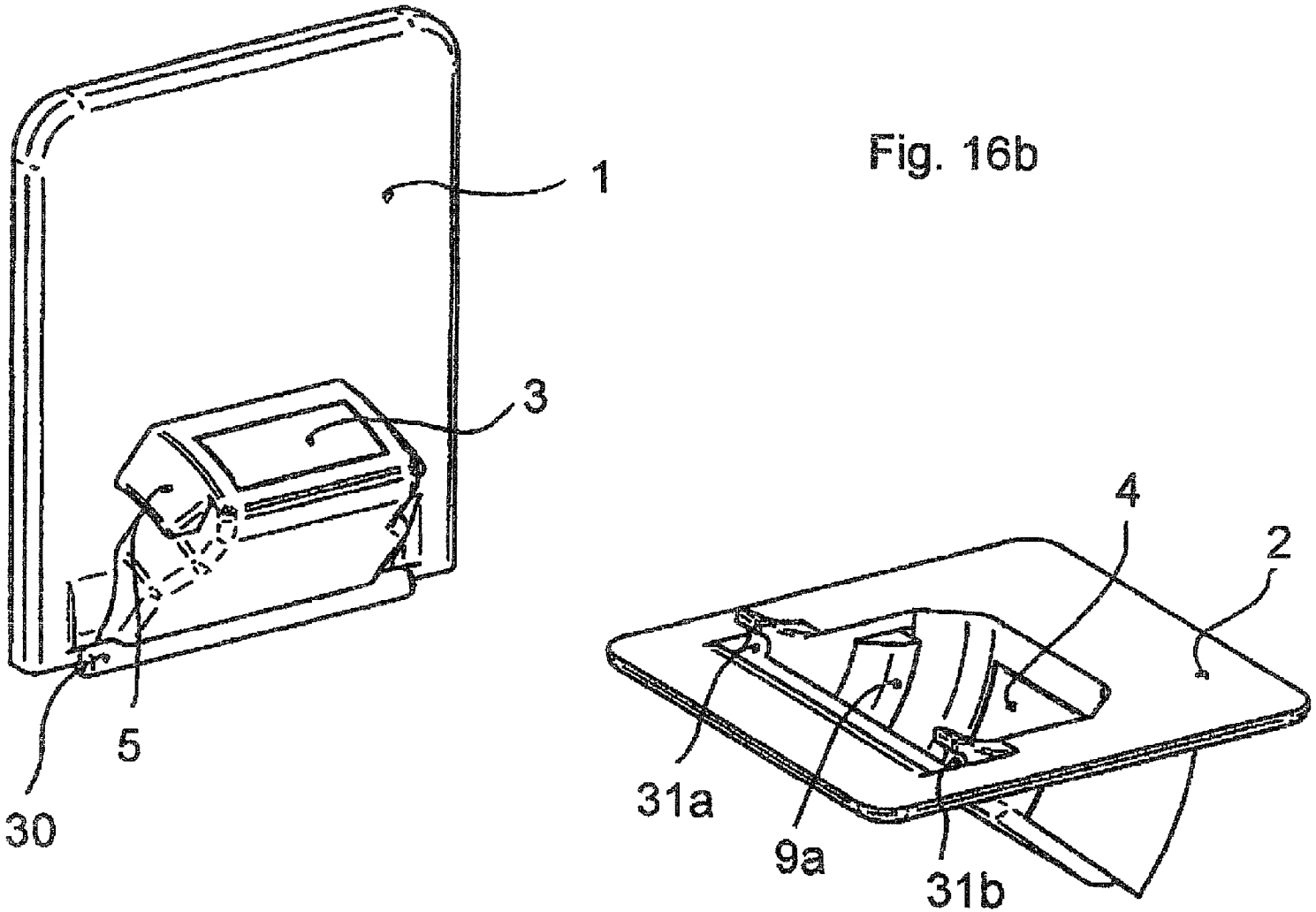
Figure 16C:
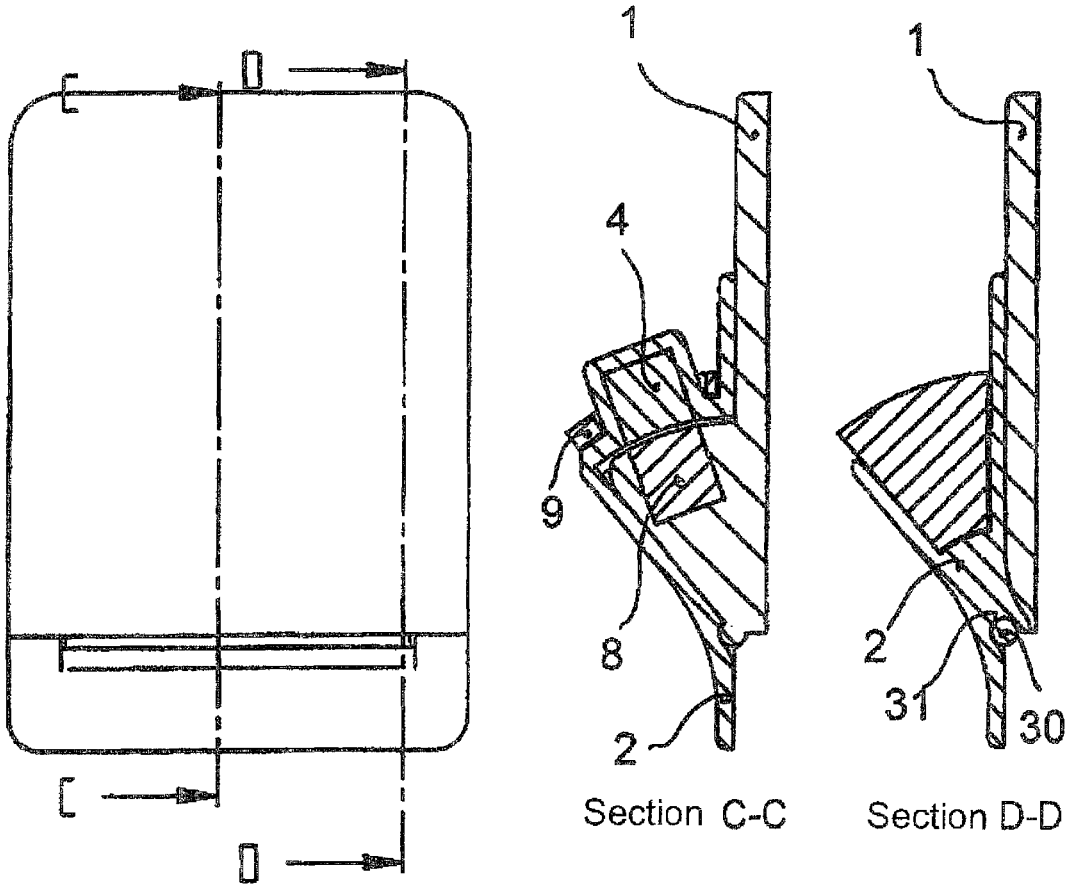
Figure 16D:
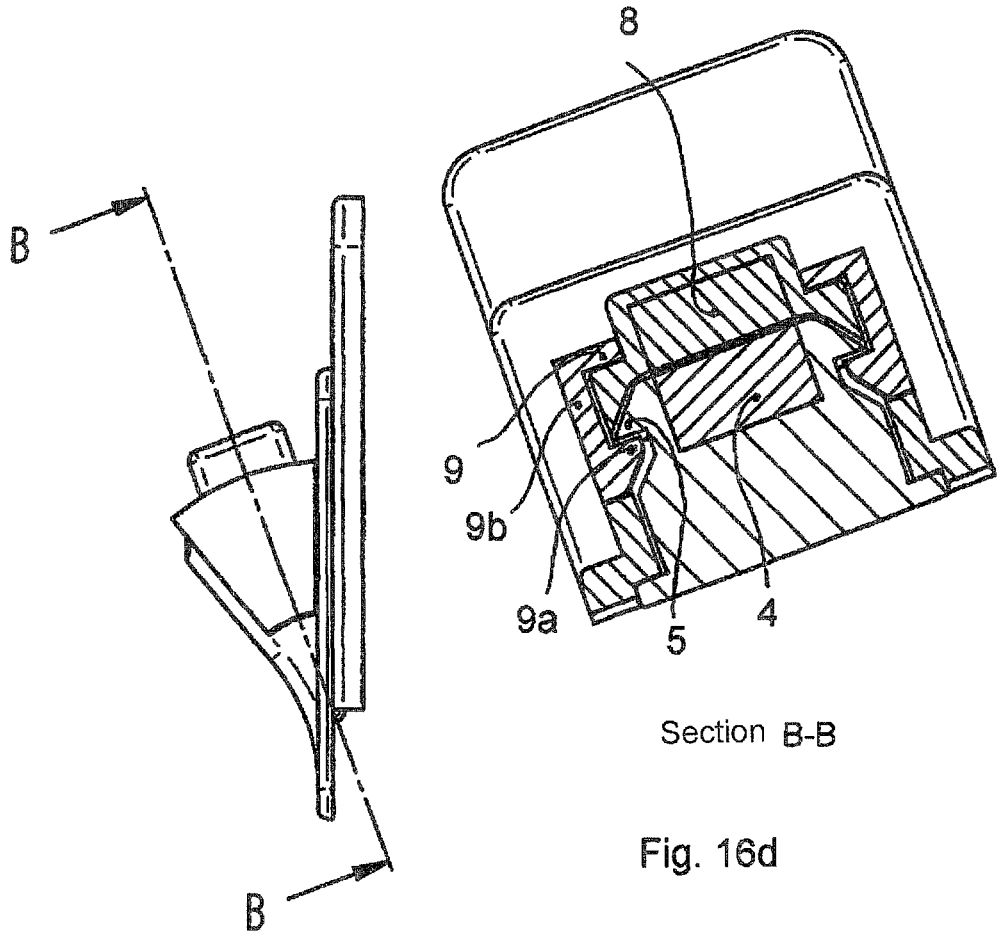
Figure 16E:
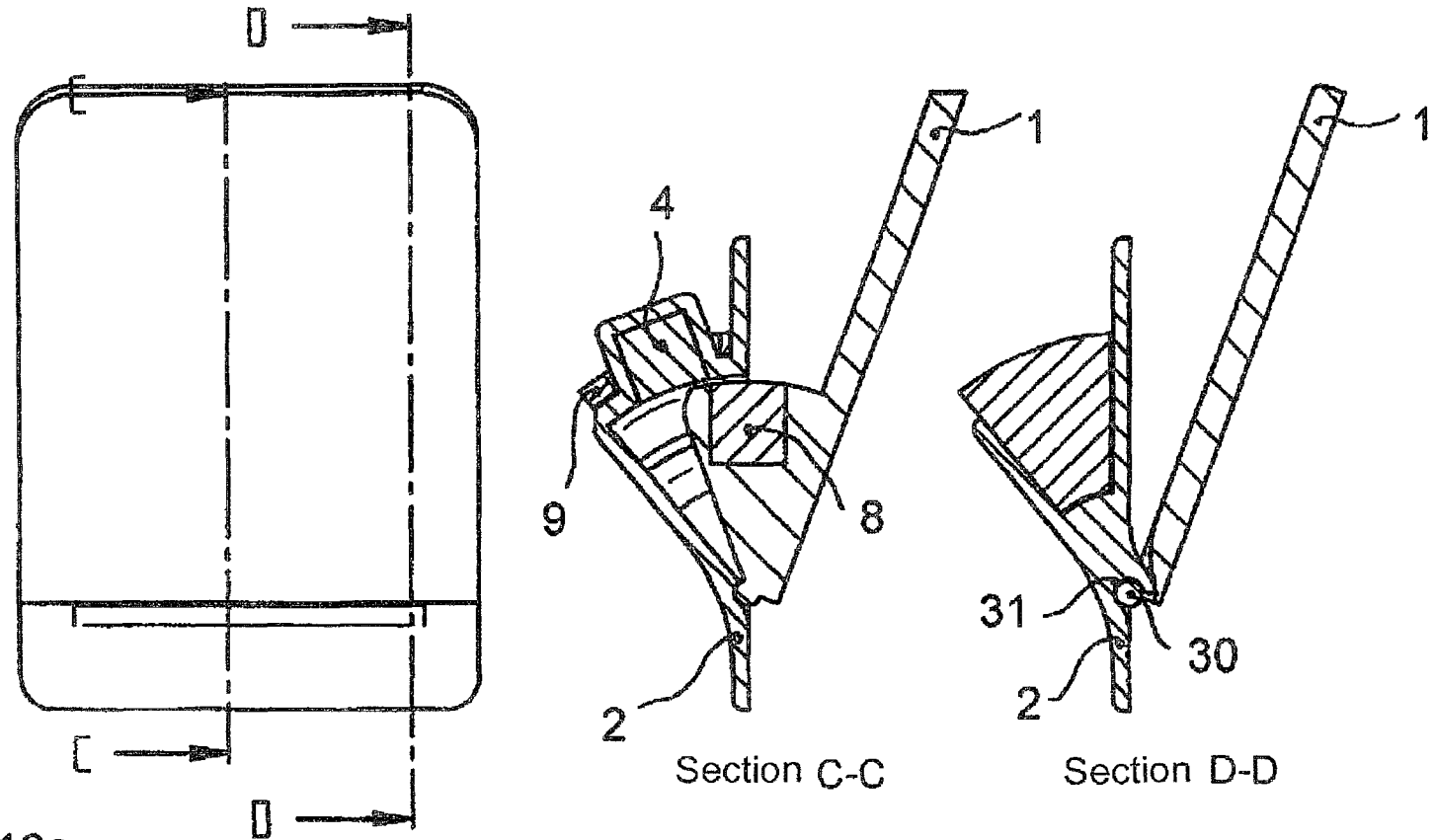
Figure 16F:
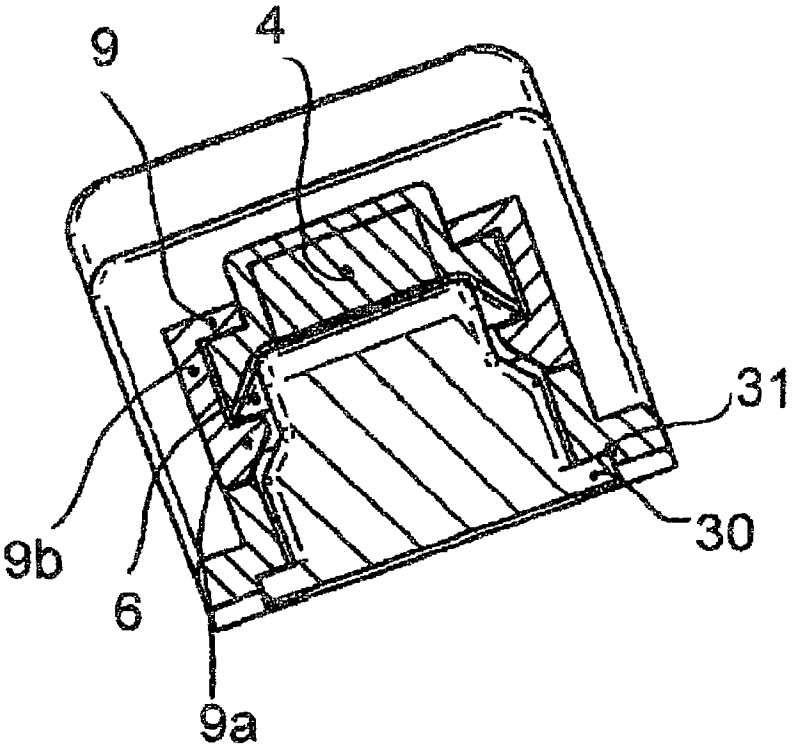
Figure 16F:
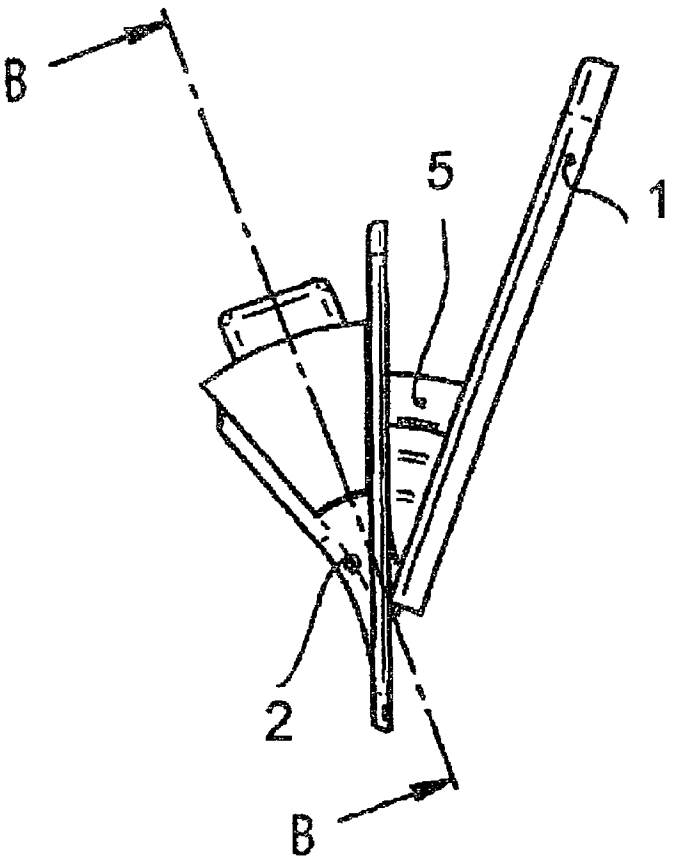
Figure 17A:
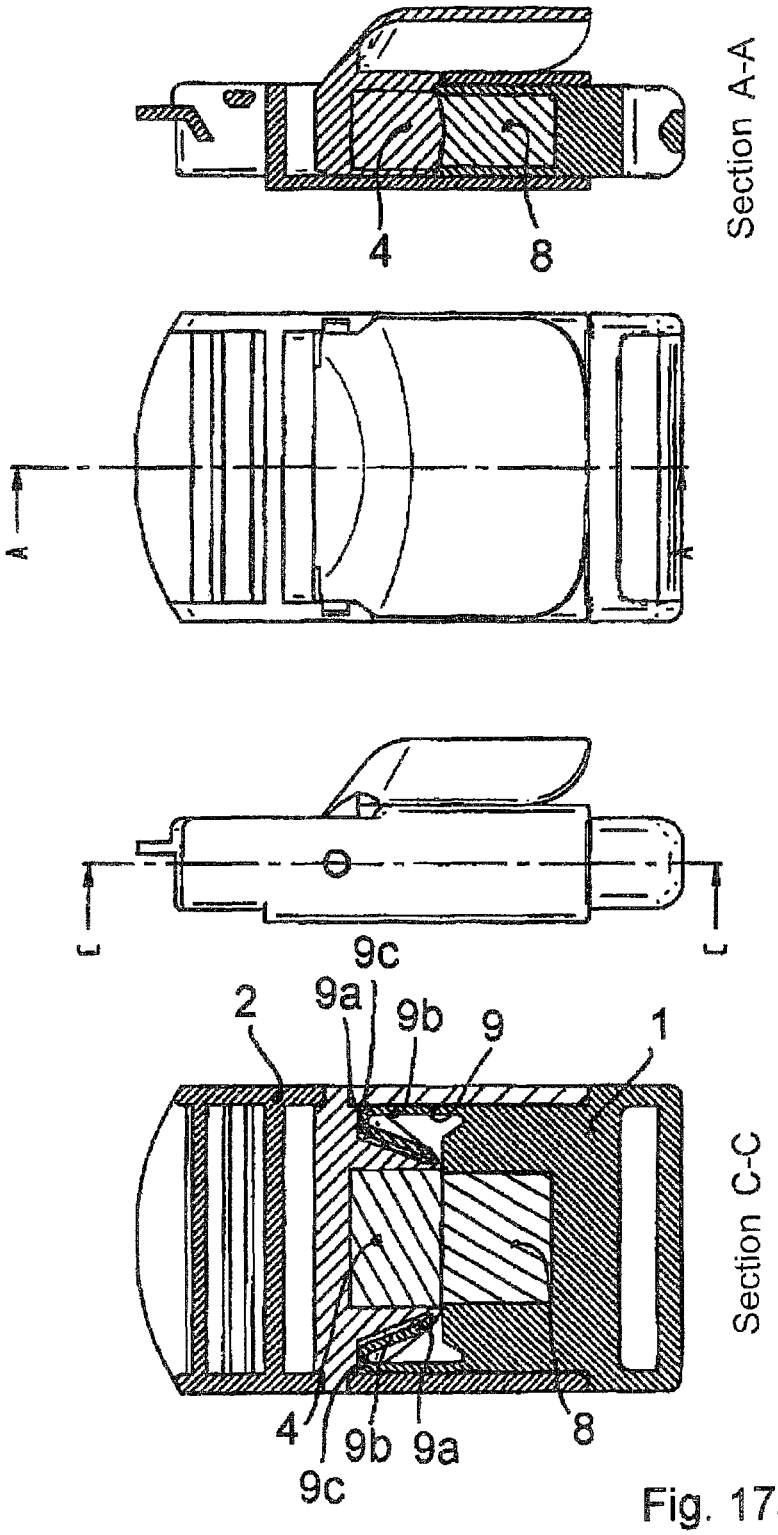
FIG. 17 shows the invention in another special exemplary embodiment.
Figure 17B:
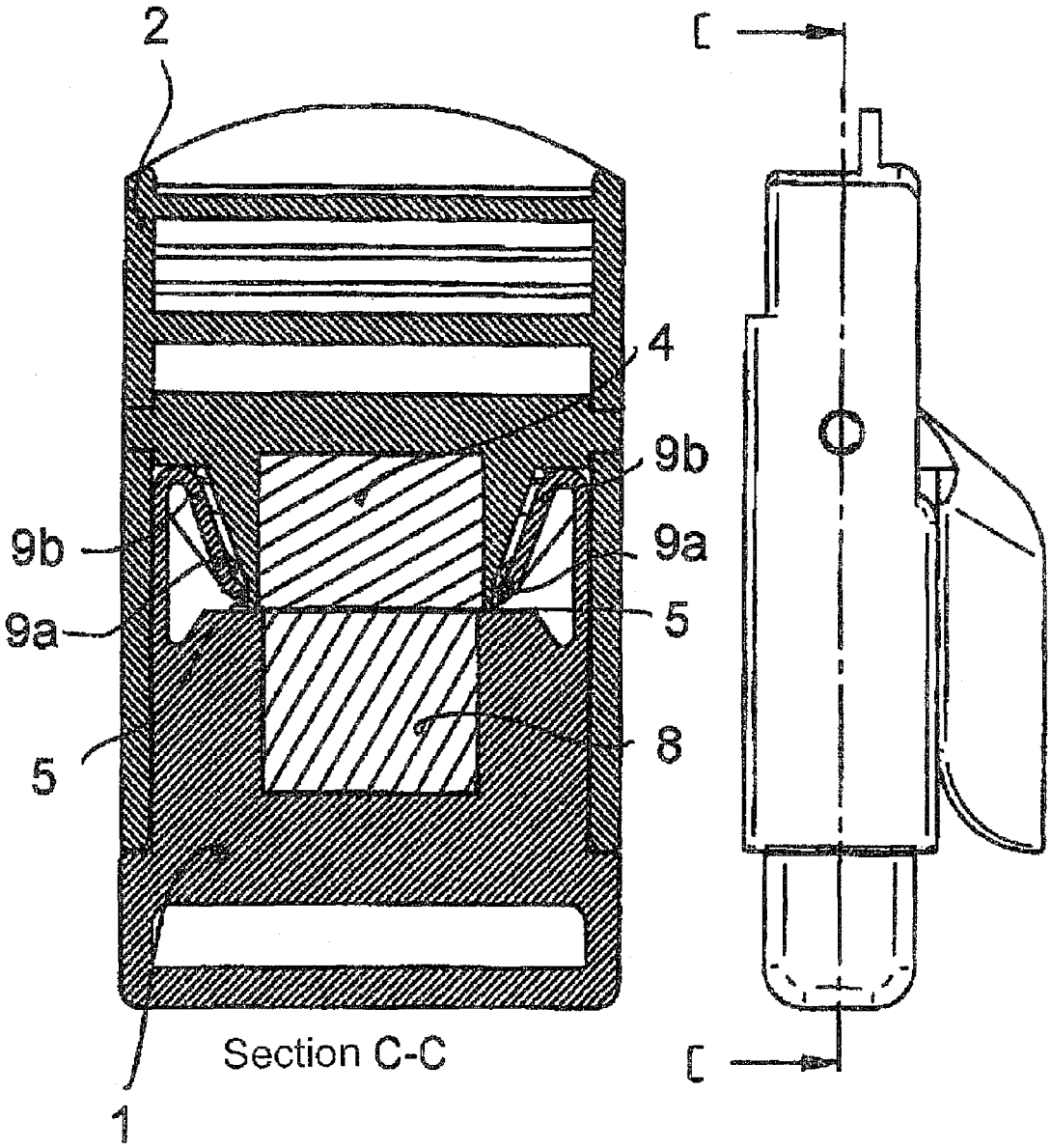
Figure 17C:
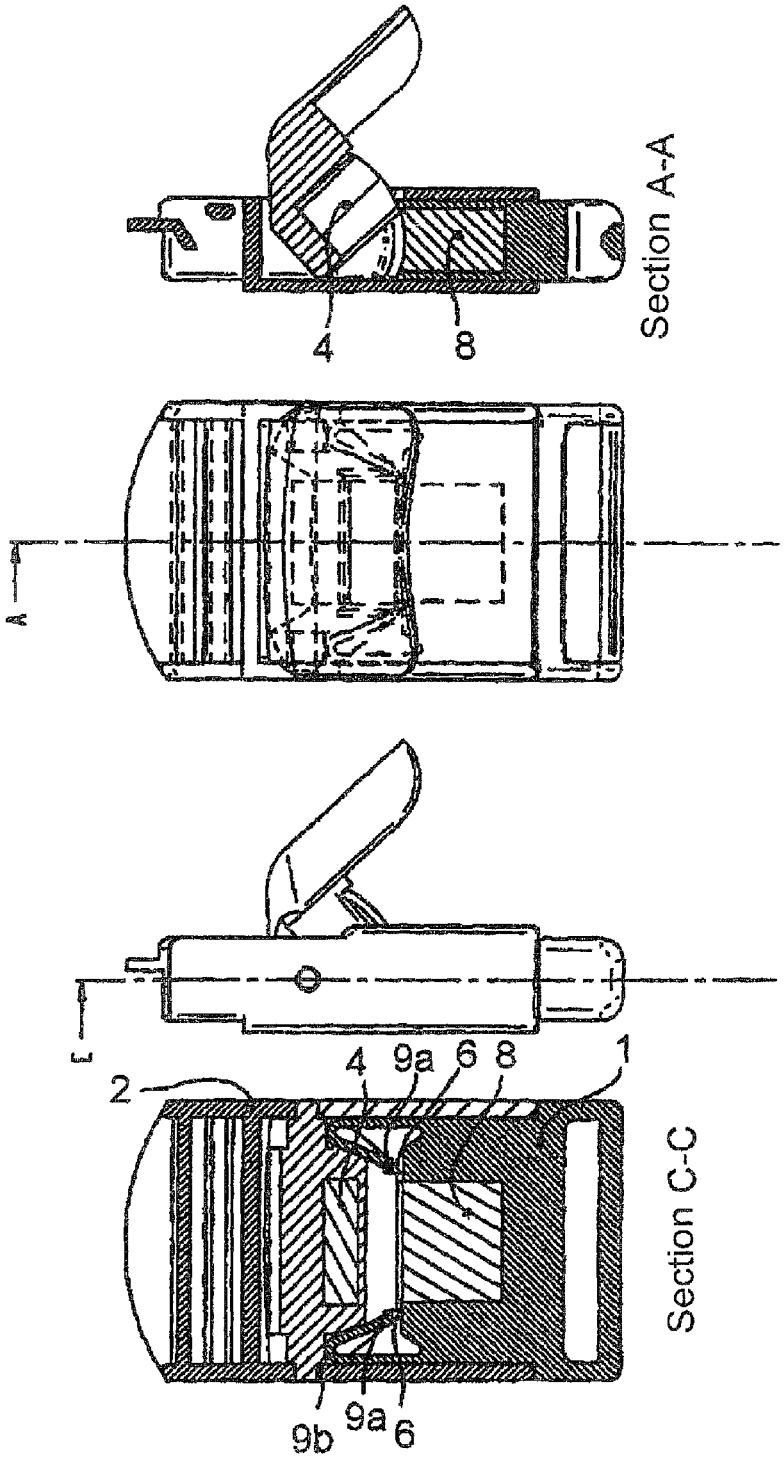
Figure 17D:
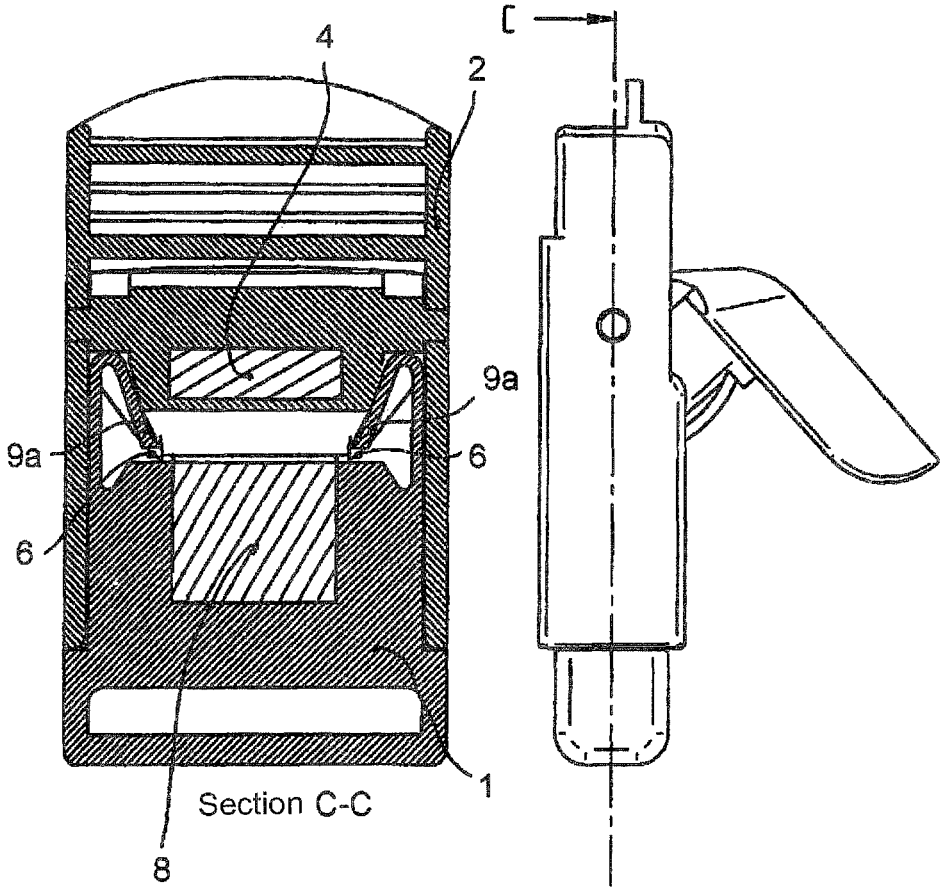
Figure 17E:
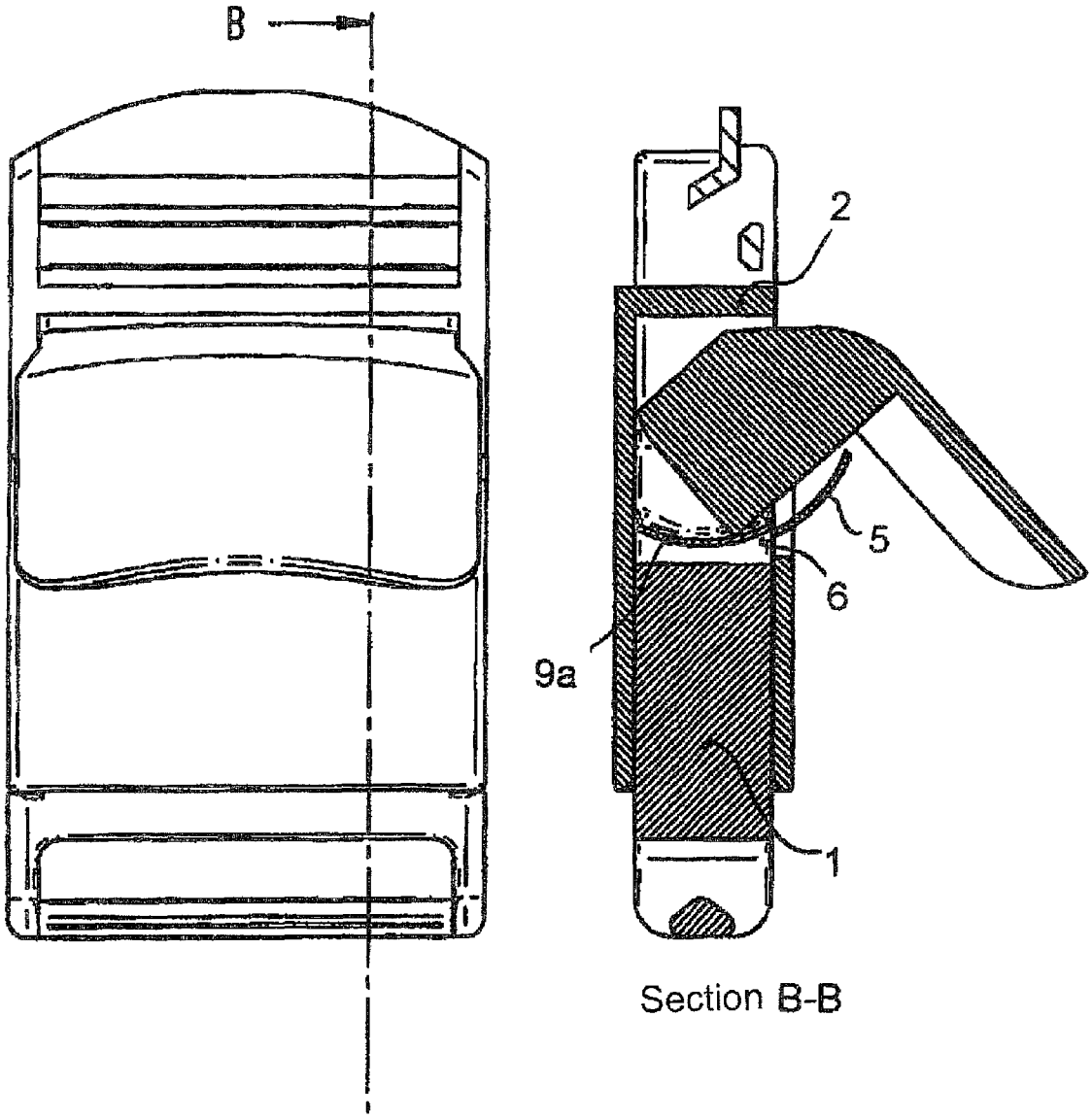
Figure 17F:
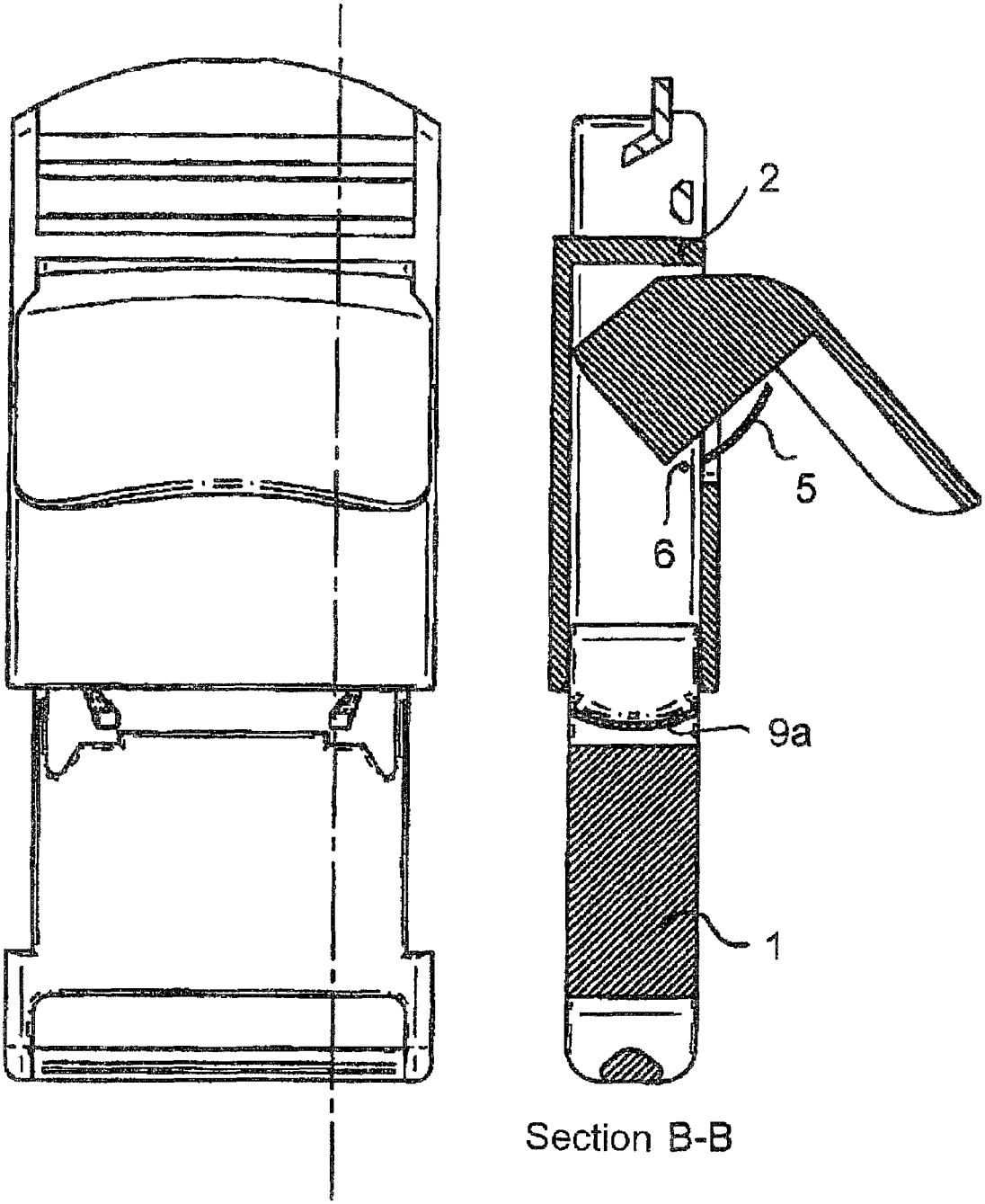

FIG. 14 shows a coupling based on the same inventive concept; however, the gap 6 is implemented fourfold. The locking piece is coupled via a magnet by way of a stop with play. If a rotatable closure 2 with two pairs of magnets is used, then the opening angle must be 90° to 180° for opening, advantageously 120°. If 4 spring locking elements are employed to provide a more secure closure, then the opening angle for displacing the gap must be 90°−x=preferably about 60°. In the illustrated embodiment, the movement of magnet and locking piece are coupled via an indirect coupling with about 60° play, making the closure and opening positions synchronous. This embodiment is also an example for a springy embodiment of the locking piece and an elastic deformation of locking piece and spring. The structure is illustrated in FIGS. 14*a* to 14*c*.

FIG. 15 shows a pivoting buckle in which another form of the travel direction, which so far has been the near or a rotation, is transformed. The basic construction and function can be seen from FIGS. 15*a* to 15*d*, wherein FIGS. 15*b* to 15*d* show a position that is not closed, a closed position and an opening operation, respectively, wherein the magnet/armature magnet system is pivoted relative to each other and thereby poled for repulsion. At the same time, the buckle is unlocked by way of the gap in the locking piece.

FIGS. 16*a-f* show a closure in particular for bags, wherein the connecting module 1 is arranged in the marginal region and the closure is opened by lifting the front edge with a pivoting motion. As in FIG. 15, the magnet-armature system is pivoted relative to each other. For better guidance, the two connecting modules are supported by an axle 30 and counter supports 31*a, b*. This bearing is advantageously constructed so that the counter supports release the axle only after pivoting.

FIGS. 7*a-f* show another embodiment of the pivoting buckle similar to FIG. 15, in which the spring locking element with springs 9*b* and locking member 9*a* is advantageously modified, in that the bent portion of the locking spring 9*c* serves as insertion aid for inserting the plug into the housing, the sensitive, resilient locking elements 9*a* are located for protection inside, whereas the locking element is advantageously supported under load on the housing interior, thereby enhancing the formfitting connection.

A person skilled in the art will understand that additional embodiments of the invention are feasible, wherein with each movement, i.e., rotation, pivoting or linear displacement, the connecting modules are either moved relative to one another as a whole or are moved relative to one another with an actuating device, i.e., the magnet or armature are movably supported in a connecting module.

The application of the invention illustrated in form of the different embodiments and recited in claim 1 is summarized below as follows:

The closing and opening phases are performed in a cycle:

Closing:

Phase 1: During the approach, i.e., in the effective region of the magnetic forces, the closure halves are urged laterally into the closed position with maximum attraction.

Phase 2: The magnetic force in the closed position with maximum attraction overcomes the snap-in lock.

Opening:

Phase 3: The magnetic force is weakened by lateral displacement of magnet and armature.

Phase 4: Together with this displacement, the snap-in lock is opened in a way that is different from the closing process, i.e., the snap-in elements are not bent open, but the snap-in lock is instead moved out of engagement by a lateral displacement, i.e., no force is required for bending the snap-in elements open.

In the aforedescribed cycle, the following forces operate:

Phase 1: The magnetic force is attractive and sideways.

Phase 2: The magnetic force exceeds the snap-in force or a short distance.

Phase 3: The user gradually overcomes with the displacement force the magnetic force along a greater travel distance, which results in a comfortable haptic.

Phase 4: The interlock is released by the lateral displacement. without applying a force.

What is claimed is:

1. A mechanical-magnetic connecting structure for connecting two elements, comprising:

a first connecting module connected to one of the two elements and comprising a spring locking element of a locking device, a second connecting module connected to the other of the two elements and comprising a locking piece of the locking device, the locking device constructed for formfittingly locking the connecting modules, a magnet-armature structure comprising a magnet arranged in one of the first and second connecting modules, and an armature arranged in the other one of the first and second connecting modules, wherein the magnet and the armature are movable relative to one another, and a coupling device coupling the magnet or the armature to the movable locking piece, wherein during a closing operation, the first and second connecting modules are moved towards each other, by means of the magnet-armature structure, are pulled towards each other starting from a predetermined minimum separation such that the spring locking element is urged against the locking piece until the spring locking element engages the locking piece in an engagement position in a formfitting manner such that the first and second connecting modules, by means of the locking piece and the spring locking element, are held with respect to each other, and during an opening operation, the magnet and the armature are moved relative to one another sideways with respect to the closing direction such that a magnetic force generated by the magnet-armature structure is weakened, wherein during the movement of the magnet and the armature relative to one another sideways with respect to the closing direction from the engagement position, in which the spring locking elements are moved relative to one another sideways with respect to the closing direction from the engagement position, in which the spring locking element is in engagement with the locking piece, into a non-engagement position, in which the spring locking element is no longer in engagement with the locking piece, thereby, allowing for a separation of the first and second connecting modules.

2. The connecting structure of claim 1, wherein the spring locking element comprises a plurality of locking members or a single locking member having several locking sections.

3. The connecting structure of claim 1, wherein the coupling device has play in a travel direction of the movable magnet, so that the locking piece is pulled by a limit stop towards the magnet only when the play it has been taken up.

4. The connecting structure of claim 1, wherein the coupling device is implemented as a coupling spring having a spring force extending along a travel direction of the magnet and the locking piece, wherein the spring force and a friction force between the locking piece and the spring locking element are dimensioned so that the friction force is greater than the spring force when a load is applied to the connecting device.

5. The connecting structure of claim 1, wherein the coupling device has play in a travel direction of the movable magnet, so that the locking piece is pulled by a limit stop towards the magnet only when the play it has been taken up, the connecting structure further comprising a return spring which has a return spring force extending along the travel direction of the movable magnet and the locking piece, so that the locking piece is pulled back into its initial position after the connecting structure is opened.

6. The connecting structure of claim 1, wherein the coupling device has play in a travel direction of the movable magnet, so that the locking piece is pulled by a limit stop towards the magnet only when the play it has been taken up, the connecting structure further comprising a return spring which has a return spring force extending along the travel direction of the movable magnet and the locking piece, so that the locking piece is pushed into its initial position after the connecting structure is opened.

7. The connecting structure of claim 1, further comprising an operating device which is movable by hand or by foot, and which is connected with the magnet-armature structure so that the magnet is movable relative to the armature and the moved part is movably supported in one of the first and second connecting modules.

8. The connecting structure of claim 1, wherein one of the first and second connecting modules is placeable on the other one of the first and second connecting modules, and wherein during removal of the one of the first and second connecting modules a relative movement is produced between the magnet and the armature.

9. The connecting structure of claim 1, wherein the armature in the other one of the first and second of the connecting modules comprises a ferromagnetic armature or a magnet poled for attraction to the magnet in the one of the first and second connecting modules.

10. The connecting structure of claim 1, wherein the magnet-armature structure comprises in one of the first and second connecting modules a magnet with two ferromagnetic guide plates and in the other one of the first and second connecting modules a ferromagnetic armature, wherein the guide plates are arranged so as to be in operative magnetic connection with the ferromagnetic armature.

11. The connecting structure of claim 1, wherein the magnet-armature structure comprises in one of the first and second connecting modules a magnet with two ferromagnetic guide plates and in the other one of the first and second connecting modules a ferromagnetic armature, wherein the magnet and the guide plates are arranged so as to be in operative magnetic connection with the ferromagnetic armature.

12. The connecting structure of claim 1, wherein the magnet-armature structure comprises in each of the first and second connecting modules a magnet with ferromagnetic guide plates, wherein the guide plates oppose one another in an attracting arrangement and are configured to establish mechanical contact.

13. The connecting structure of claim 1, wherein the magnet-armature structure comprises a magnet arrangement with at least two opposing magnets, which in the closed position of the connection are in an attracting position and in the open position in a repelling position.

14. The connecting structure of claim 1, wherein each of the first and second connecting modules comprises a magnet and a ferromagnetic armature, wherein the magnets and the ferromagnetic armatures are arranged such that in the closed position the magnet in one of the first and second connecting modules faces the armature in the other one of the first and second connecting modules, and in the open position the magnet in one of the first and second connecting modules faces the magnet in the other one of the first and second connecting modules with opposite polarity.

15. The connecting structure of claim 1, further comprising restoring means for restoring the locking piece to an initial position in which the spring locking element can be brought into engagement with the locking piece.

16. The connecting structure of claim 15, wherein the restoring means is constituted by the magnet-armature structure, with the magnetic force between the magnet and the armature of the magnet-armature structure restoring the locking piece to the initial position.

17. The connecting structure of claim 15, wherein the restoring means includes a return spring, said return spring being tensioned during a sideways movement of the magnet and the armature of the magnet-armature structure relative to one another.

* * * * *